US009885507B2

(12) United States Patent
Pham

(10) Patent No.: US 9,885,507 B2
(45) Date of Patent: Feb. 6, 2018

(54) PROTECTION AND DIAGNOSTIC MODULE FOR A REFRIGERATION SYSTEM

(71) Applicant: Emerson Climate Technologies, Inc., Sidney, OH (US)

(72) Inventor: Hung M. Pham, Dayton, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 662 days.

(21) Appl. No.: 14/080,473

(22) Filed: Nov. 14, 2013

(65) Prior Publication Data

US 2014/0069121 A1 Mar. 13, 2014

Related U.S. Application Data

(63) Continuation of application No. 11/776,879, filed on Jul. 12, 2007, now Pat. No. 8,590,325.

(60) Provisional application No. 60/831,755, filed on Jul. 19, 2006.

(51) Int. Cl.

| | |
|---|---|
| ***F25B 49/00*** | (2006.01) |
| ***G01K 13/00*** | (2006.01) |
| ***F25D 17/04*** | (2006.01) |
| ***F25B 49/02*** | (2006.01) |

(52) U.S. Cl.

CPC ..... *F25B 49/022* (2013.01); *F25B 49/005* (2013.01); *F25B 2500/19* (2013.01); *F25B 2700/151* (2013.01); *F25B 2700/2106* (2013.01); *F25B 2700/21152* (2013.01); *F25B 2700/21163* (2013.01)

(58) Field of Classification Search

CPC ..... F25B 49/005; F25B 2500/19; F25B 2700/151; F25B 2700/2106; F25B 49/022; G06F 17/30991

USPC ..... 62/127, 129, 186, 228.3

See application file for complete search history.

(56) References Cited

U.S. PATENT DOCUMENTS

| | | | |
|---|---|---|---|
| 2,054,542 | A | 9/1936 | Hoelle |
| 2,296,822 | A | 9/1942 | Wolfert |
| 2,631,050 | A | 3/1953 | Haeberlein |
| 2,804,839 | A | 9/1957 | Hallinan |

(Continued)

FOREIGN PATENT DOCUMENTS

| | | | |
|---|---|---|---|
| CA | 1147440 | A1 | 5/1983 |
| CA | 2528778 | A1 | 12/2004 |

(Continued)

OTHER PUBLICATIONS

Notice of Allowance regarding U.S. Appl. No. 13/932,611, dated Jul. 6, 2015.

(Continued)

*Primary Examiner* — Henry Crenshaw

(74) *Attorney, Agent, or Firm* — Harness, Dickey & Pierce, P.L.C.

(57) ABSTRACT

A system is provided and may include a compressor functioning in a refrigeration circuit. An ambient temperature sensor may produce a signal indicative of an ambient temperature. Processing circuitry may calculate an energy efficiency rating of the refrigeration circuit and may generate a relationship of the calculated energy efficiency rating and ambient temperature. The processing circuitry may compare the calculated energy efficiency rating to a base energy efficiency rating to determine if a fault condition exists.

17 Claims, 17 Drawing Sheets

(56) References Cited

U.S. PATENT DOCUMENTS 2,961,606 A 11/1960 Mead
2,962,702 A 11/1960 Derr et al.
2,978,879 A 4/1961 Heidorn
3,027,865 A 4/1962 Kautz et al.
3,047,696 A 7/1962 Heidorn
3,082,951 A 3/1963 Kayan
3,107,843 A 10/1963 Finn
3,170,304 A 2/1965 Hale
3,232,519 A 2/1966 Long
3,278,111 A 10/1966 Parker
3,327,197 A 6/1967 Marquis
3,339,164 A 8/1967 Landis et al.
3,400,374 A 9/1968 Schumann
3,513,662 A 5/1970 Golber
3,581,281 A 5/1971 Martin et al.
3,585,451 A 6/1971 Day, III
3,653,783 A 4/1972 Sauder
3,660,718 A 5/1972 Pinckaers
3,665,339 A 5/1972 Liu
3,665,399 A 5/1972 Zehr et al.
3,697,953 A 10/1972 Schoenwitz
3,707,851 A 1/1973 McAshan, Jr.
3,729,949 A 5/1973 Talbot
3,735,377 A 5/1973 Kaufman
3,742,302 A 6/1973 Neill
3,742,303 A 6/1973 Dageford
3,767,328 A 10/1973 Ladusaw
3,777,240 A 12/1973 Neill
3,783,681 A 1/1974 Hirt et al.
3,820,074 A 6/1974 Toman
3,882,305 A 5/1975 Johnstone
3,924,972 A 12/1975 Szymaszek
3,927,712 A 12/1975 Nakayama
3,935,519 A 1/1976 Pfarrer et al.
3,950,962 A 4/1976 Odashima
3,960,011 A 6/1976 Renz et al.
3,978,382 A 8/1976 Pfarrer et al.
3,998,068 A 12/1976 Chirnside
4,006,460 A 2/1977 Hewitt et al.
4,014,182 A 3/1977 Granryd
4,018,584 A 4/1977 Mullen
4,019,172 A 4/1977 Srodes
4,024,725 A 5/1977 Uchida et al.
4,027,289 A 5/1977 Toman
4,034,570 A 7/1977 Anderson et al.
4,038,061 A 7/1977 Anderson et al.
4,045,973 A 9/1977 Anderson et al.
4,046,532 A 9/1977 Nelson
RE29,450 E 10/1977 Goldsby et al.
4,060,716 A 11/1977 Pekrul et al.
4,066,869 A 1/1978 Apaloo et al.
4,090,248 A 5/1978 Swanson et al.
4,102,150 A 7/1978 Kountz
4,102,394 A 7/1978 Botts
4,104,888 A 8/1978 Reedy et al.
4,105,063 A 8/1978 Bergt
4,112,703 A 9/1978 Kountz
4,132,086 A 1/1979 Kountz
4,136,730 A 1/1979 Kinsey
4,137,057 A 1/1979 Piet et al.
4,137,725 A 2/1979 Martin
4,142,375 A 3/1979 Abe et al.
4,143,707 A 3/1979 Lewis et al.
4,146,085 A 3/1979 Wills
RE29,966 E 4/1979 Nussbaum
4,151,725 A 5/1979 Kountz et al.
4,153,003 A 5/1979 Willis
4,156,350 A 5/1979 Elliott et al.
4,161,106 A 7/1979 Savage et al.
4,165,619 A 8/1979 Girard
4,171,622 A 10/1979 Yamaguchi et al.
4,173,871 A 11/1979 Brooks
4,178,988 A * 12/1979 Cann ..... F24D 11/0271
165/242
RE30,242 E 4/1980 del Toro et al.
4,197,717 A 4/1980 Schumacher
4,205,381 A 5/1980 Games et al.
4,209,994 A 7/1980 Mueller et al.
4,211,089 A 7/1980 Mueller et al.
4,217,761 A 8/1980 Cornaire et al.
4,220,010 A 9/1980 Mueller et al.
4,227,862 A 10/1980 Andrew et al.
4,232,530 A 11/1980 Mueller
4,233,818 A 11/1980 Lastinger
4,236,379 A 12/1980 Mueller
4,244,182 A 1/1981 Behr
4,246,763 A 1/1981 Mueller et al.
4,248,051 A 2/1981 Darcy et al.
4,251,988 A 2/1981 Allard et al.
4,257,795 A 3/1981 Shaw
4,259,847 A 4/1981 Pearse, Jr.
4,267,702 A 5/1981 Houk
4,270,174 A 5/1981 Karlin et al.
4,271,898 A 6/1981 Freeman
4,281,358 A 7/1981 Plouffe et al.
4,284,849 A 8/1981 Anderson et al.
4,286,438 A 9/1981 Clarke
4,290,480 A 9/1981 Sulkowski
4,296,727 A 10/1981 Bryan
4,301,660 A 11/1981 Mueller et al.
4,306,293 A 12/1981 Marathe
4,307,775 A 12/1981 Saunders et al.
4,308,725 A 1/1982 Chiyoda
4,311,188 A 1/1982 Kojima et al.
4,319,461 A 3/1982 Shaw
4,321,529 A 3/1982 Simmonds et al.
4,325,223 A 4/1982 Cantley
4,328,678 A 5/1982 Kono et al.
4,328,680 A 5/1982 Stamp, Jr. et al.
4,333,316 A 6/1982 Stamp, Jr. et al.
4,333,317 A 6/1982 Sawyer
4,336,001 A 6/1982 Andrew et al.
4,338,790 A 7/1982 Saunders et al.
4,338,791 A 7/1982 Stamp, Jr. et al.
4,345,162 A 8/1982 Hammer et al.
4,346,755 A 8/1982 Alley et al.
4,350,021 A 9/1982 Lundstrom
4,350,023 A 9/1982 Kuwabara et al.
4,351,163 A 9/1982 Johannsen
4,356,703 A 11/1982 Vogel
4,361,273 A 11/1982 Levine et al.
4,365,983 A 12/1982 Abraham et al.
4,370,098 A 1/1983 McClain et al.
4,372,119 A 2/1983 Gillbrand et al.
4,376,926 A 3/1983 Senor
4,381,549 A 4/1983 Stamp, Jr. et al.
4,382,367 A 5/1983 Roberts
4,384,462 A 5/1983 Overman et al.
4,387,368 A 6/1983 Day, III et al.
4,387,578 A 6/1983 Paddock
4,390,058 A 6/1983 Otake et al.
4,390,321 A 6/1983 Langlois et al.
4,390,922 A 6/1983 Pelliccia
4,395,886 A 8/1983 Mayer
4,395,887 A 8/1983 Sweetman
4,399,548 A 8/1983 Castleberry
4,402,054 A 8/1983 Osborne et al.
4,406,133 A 9/1983 Saunders et al.
4,407,138 A 10/1983 Mueller
4,408,660 A 10/1983 Sutoh et al.
4,412,788 A 11/1983 Shaw et al.
4,415,896 A 11/1983 Allgood
4,418,388 A 11/1983 Allgor et al.
4,420,947 A 12/1983 Yoshino
4,425,010 A 1/1984 Bryant et al.
4,429,578 A 2/1984 Darrel et al.
4,432,232 A 2/1984 Brantley et al.
4,434,390 A 2/1984 Elms
4,441,329 A 4/1984 Dawley
4,448,038 A 5/1984 Barbier
4,449,375 A 5/1984 Briccetti
4,451,929 A 5/1984 Yoshida
4,460,123 A 7/1984 Beverly
4,463,571 A 8/1984 Wiggs

(56) References Cited

U.S. PATENT DOCUMENTS 4,463,574 A 8/1984 Spethmann et al.
4,463,576 A 8/1984 Burnett et al.
4,465,229 A 8/1984 Kompelien
4,467,230 A 8/1984 Rovinsky
4,467,385 A 8/1984 Bandoli et al.
4,467,613 A 8/1984 Behr et al.
4,470,092 A 9/1984 Lombardi
4,470,266 A 9/1984 Briccetti et al.
4,474,024 A 10/1984 Eplett et al.
4,474,542 A 10/1984 Kato et al.
4,479,389 A 10/1984 Anderson, III et al.
4,484,452 A 11/1984 Houser, Jr.
4,489,551 A 12/1984 Watanabe et al.
4,490,986 A 1/1985 Paddock
4,494,383 A 1/1985 Nagatomo et al.
4,495,779 A 1/1985 Tanaka et al.
4,496,296 A 1/1985 Arai et al.
4,497,031 A 1/1985 Froehling et al.
4,498,310 A 2/1985 Imanishi et al.
4,499,739 A 2/1985 Matsuoka et al.
4,502,084 A 2/1985 Hannett
4,502,833 A 3/1985 Hibino et al.
4,502,842 A 3/1985 Currier et al.
4,502,843 A 3/1985 Martin
4,505,125 A 3/1985 Baglione
4,506,518 A 3/1985 Yoshikawa et al.
4,507,934 A 4/1985 Tanaka et al.
4,510,547 A 4/1985 Rudich, Jr.
4,510,576 A 4/1985 MacArthur et al.
4,512,161 A 4/1985 Logan et al.
4,516,407 A 5/1985 Watabe
4,517,468 A 5/1985 Kemper et al.
4,520,674 A 6/1985 Canada et al.
4,523,435 A 6/1985 Lord
4,523,436 A 6/1985 Schedel et al.
4,527,247 A 7/1985 Kaiser et al.
4,527,399 A 7/1985 Lord
4,535,607 A 8/1985 Mount
4,538,420 A 9/1985 Nelson
4,538,422 A 9/1985 Mount et al.
4,539,820 A 9/1985 Zinsmeyer
4,540,040 A 9/1985 Fukumoto et al.
4,545,210 A 10/1985 Lord
4,545,214 A 10/1985 Kinoshita
4,548,549 A 10/1985 Murphy et al.
4,549,403 A 10/1985 Lord et al.
4,549,404 A 10/1985 Lord
4,550,770 A 11/1985 Nussdorfer et al.
4,553,400 A 11/1985 Branz
4,555,057 A 11/1985 Foster
4,555,910 A 12/1985 Sturges
4,557,317 A 12/1985 Harmon, Jr.
4,558,181 A 12/1985 Blanchard et al.
4,561,260 A 12/1985 Nishi et al.
4,563,624 A 1/1986 Yu
4,563,877 A 1/1986 Harnish
4,563,878 A 1/1986 Baglione
4,567,733 A 2/1986 Mecozzi
4,568,909 A 2/1986 Whynacht
4,574,871 A 3/1986 Parkinson et al.
4,575,318 A 3/1986 Blain
4,577,977 A 3/1986 Pejsa
4,580,947 A 4/1986 Shibata et al.
4,583,373 A 4/1986 Shaw
4,589,060 A 5/1986 Zinsmeyer
4,593,367 A 6/1986 Slack et al.
4,598,764 A 7/1986 Beckey
4,602,484 A 7/1986 Bendikson
4,603,556 A 8/1986 Suefuji et al.
4,604,036 A 8/1986 Sutou et al.
4,611,470 A 9/1986 Enstrom
4,612,775 A 9/1986 Branz et al.
4,614,089 A 9/1986 Dorsey
4,617,804 A 10/1986 Fukushima et al.
4,620,286 A 10/1986 Smith et al.
4,620,424 A 11/1986 Tanaka et al.
4,621,502 A 11/1986 Ibrahim et al.
4,626,753 A 12/1986 Letterman
4,627,245 A 12/1986 Levine
4,627,483 A 12/1986 Harshbarger, III et al.
4,627,484 A 12/1986 Harshbarger, Jr. et al.
4,630,572 A 12/1986 Evans
4,630,670 A 12/1986 Wellman et al.
4,642,034 A 2/1987 Terauchi
4,642,782 A 2/1987 Kemper et al.
4,644,479 A 2/1987 Kemper et al.
4,646,532 A 3/1987 Nose
4,648,044 A 3/1987 Hardy et al.
4,649,515 A 3/1987 Thompson et al.
4,649,710 A 3/1987 Inoue et al.
4,653,280 A 3/1987 Hansen et al.
4,653,285 A 3/1987 Pohl
4,655,688 A 4/1987 Bohn et al.
4,660,386 A 4/1987 Hansen et al.
4,662,184 A 5/1987 Pohl et al.
4,674,292 A 6/1987 Ohya et al.
4,677,830 A 7/1987 Sumikawa et al.
4,680,940 A 7/1987 Vaughn
4,682,473 A 7/1987 Rogers, III
4,684,060 A 8/1987 Adams et al.
4,685,615 A 8/1987 Hart
4,686,835 A 8/1987 Alsenz
4,689,967 A 9/1987 Han et al.
4,697,431 A 10/1987 Alsenz
4,698,978 A 10/1987 Jones
4,698,981 A 10/1987 Kaneko et al.
4,701,824 A 10/1987 Beggs et al.
4,703,325 A 10/1987 Chamberlin et al.
4,706,152 A 11/1987 DeFilippis et al.
4,706,469 A 11/1987 Oguni et al.
4,712,648 A 12/1987 Mattes et al.
4,713,717 A 12/1987 Pejouhy et al.
4,715,190 A 12/1987 Han et al.
4,715,792 A 12/1987 Nishizawa et al.
4,716,582 A 12/1987 Blanchard et al.
4,716,957 A 1/1988 Thompson et al.
4,720,980 A 1/1988 Howland
4,722,018 A 1/1988 Pohl
4,722,019 A 1/1988 Pohl
4,724,678 A 2/1988 Pohl
4,735,054 A 4/1988 Beckey
4,735,060 A 4/1988 Alsenz
4,744,223 A 5/1988 Umezu
4,745,765 A 5/1988 Pettitt
4,745,766 A 5/1988 Bahr
4,745,767 A 5/1988 Ohya et al.
4,750,332 A 6/1988 Jenski et al.
4,750,672 A 6/1988 Beckey et al.
4,751,501 A 6/1988 Gut
4,751,825 A 6/1988 Voorhis et al.
4,754,410 A 6/1988 Leech et al.
4,755,957 A 7/1988 White et al.
4,765,150 A 8/1988 Persem
4,768,346 A 9/1988 Mathur
4,768,348 A 9/1988 Noguchi
4,783,752 A 11/1988 Kaplan et al.
4,787,213 A 11/1988 Gras et al.
4,790,142 A 12/1988 Beckey
4,796,142 A 1/1989 Libert
4,796,466 A 1/1989 Farmer
4,798,055 A * 1/1989 Murray ..... G01K 7/22
165/11.1
4,805,118 A 2/1989 Rishel
4,807,445 A 2/1989 Matsuoka et al.
4,820,130 A 4/1989 Eber et al.
4,829,779 A 5/1989 Munson et al.
4,831,560 A 5/1989 Zaleski
4,831,832 A 5/1989 Alsenz
4,831,833 A 5/1989 Duenes et al.
4,835,706 A 5/1989 Asahi
4,835,980 A 6/1989 Oyanagi et al.
4,838,037 A 6/1989 Wood
4,841,734 A 6/1989 Torrence
4,843,575 A 6/1989 Crane

(56) References Cited

U.S. PATENT DOCUMENTS 4,845,956 A 7/1989 Berntsen et al.
4,848,099 A 7/1989 Beckey et al.
4,848,100 A 7/1989 Barthel et al.
4,850,198 A 7/1989 Helt et al.
4,850,204 A 7/1989 Bos et al.
4,852,363 A 8/1989 Kampf et al.
4,853,693 A 8/1989 Eaton-Williams
4,856,286 A 8/1989 Sulfstede et al.
4,858,676 A 8/1989 Bolfik et al.
4,866,635 A 9/1989 Kahn et al.
4,866,944 A 9/1989 Yamazaki
4,869,073 A 9/1989 Kawai et al.
4,873,836 A 10/1989 Thompson
4,875,589 A 10/1989 Lacey et al.
4,877,382 A 10/1989 Caillat et al.
4,878,355 A 11/1989 Beckey et al.
4,881,184 A 11/1989 Abegg, III et al.
4,882,747 A 11/1989 Williams
4,882,908 A 11/1989 White
4,884,412 A 12/1989 Sellers et al.
4,885,707 A 12/1989 Nichol et al.
4,885,914 A 12/1989 Pearman
4,887,436 A 12/1989 Enomoto et al.
4,887,857 A 12/1989 VanOmmeren
4,889,280 A 12/1989 Grald et al.
4,893,480 A 1/1990 Matsui et al.
4,899,551 A 2/1990 Weintraub
4,903,500 A 2/1990 Hanson
4,903,759 A 2/1990 Lapeyrouse
4,904,993 A 2/1990 Sato
4,909,041 A 3/1990 Jones
4,909,076 A 3/1990 Busch et al.
4,910,966 A 3/1990 Levine et al.
4,913,625 A 4/1990 Gerlowski
4,916,633 A 4/1990 Tychonievich et al.
4,916,909 A 4/1990 Mathur et al.
4,916,912 A 4/1990 Levine et al.
4,918,690 A 4/1990 Markkula, Jr. et al.
4,918,932 A 4/1990 Gustafson et al.
4,924,404 A 5/1990 Reinke, Jr.
4,924,418 A 5/1990 Bachman et al.
4,928,750 A 5/1990 Nurczyk
4,932,588 A 6/1990 Fedter et al.
4,939,909 A 7/1990 Tsuchiyama et al.
4,943,003 A 7/1990 Shimizu et al.
4,944,160 A 7/1990 Malone et al.
4,945,491 A 7/1990 Rishel
4,948,040 A 8/1990 Kobayashi et al.
4,949,550 A 8/1990 Hanson
4,953,784 A 9/1990 Yasufuku et al.
4,959,970 A 10/1990 Meckler
4,964,060 A 10/1990 Hartsog
4,964,125 A 10/1990 Kim
4,966,006 A 10/1990 Thuesen et al.
4,967,567 A 11/1990 Proctor et al.
4,970,496 A 11/1990 Kirkpatrick
4,974,427 A 12/1990 Diab
4,974,665 A 12/1990 Zillner, Jr.
4,975,024 A 12/1990 Heckel
4,977,751 A 12/1990 Hanson
4,985,857 A 1/1991 Bajpai et al.
4,987,748 A 1/1991 Meckler
4,990,057 A 2/1991 Rollins
4,990,893 A 2/1991 Kiluk
4,991,770 A 2/1991 Bird et al.
5,000,009 A 3/1991 Clanin
5,005,365 A 4/1991 Lynch
5,009,074 A 4/1991 Goubeaux et al.
5,009,075 A 4/1991 Okoren
5,009,076 A 4/1991 Winslow
5,012,629 A 5/1991 Rehman et al.
5,018,357 A 5/1991 Livingstone et al.
5,018,665 A 5/1991 Sulmone
RE33,620 E 6/1991 Persem
5,022,234 A 6/1991 Goubeaux et al.
5,039,009 A 8/1991 Baldwin et al.
5,042,264 A 8/1991 Dudley
5,051,720 A 9/1991 Kittirutsunetorn
5,056,036 A 10/1991 Van Bork
5,056,329 A 10/1991 Wilkinson
5,058,388 A 10/1991 Shaw et al.
5,062,278 A 11/1991 Sugiyama
5,065,593 A 11/1991 Dudley et al.
5,067,099 A 11/1991 McCown et al.
RE33,775 E 12/1991 Behr et al.
5,070,468 A 12/1991 Niinomi et al.
5,071,065 A 12/1991 Aalto et al.
5,073,091 A 12/1991 Burgess et al.
5,073,862 A 12/1991 Carlson
5,076,067 A 12/1991 Prenger et al.
5,076,494 A 12/1991 Ripka
5,077,983 A 1/1992 Dudley
5,083,438 A * 1/1992 McMullin ..... G01L 3/26 165/11.1
5,086,385 A 2/1992 Launey et al.
5,088,297 A 2/1992 Maruyama et al.
5,094,086 A 3/1992 Shyu
5,095,712 A 3/1992 Narreau
5,095,715 A 3/1992 Dudley
5,099,654 A 3/1992 Baruschke et al.
5,102,316 A 4/1992 Caillat et al.
5,103,391 A 4/1992 Barrett
5,107,500 A 4/1992 Wakamoto et al.
5,109,222 A 4/1992 Welty
5,109,676 A 5/1992 Waters et al.
5,109,700 A 5/1992 Hicho
5,109,916 A 5/1992 Thompson
5,115,406 A 5/1992 Zatezalo et al.
5,115,643 A 5/1992 Hayata et al.
5,115,644 A 5/1992 Alsenz
5,115,967 A 5/1992 Wedekind
5,118,260 A 6/1992 Fraser, Jr.
5,119,466 A 6/1992 Suzuki
5,119,637 A 6/1992 Bard et al.
5,121,610 A 6/1992 Atkinson et al.
5,123,017 A 6/1992 Simpkins et al.
5,123,252 A 6/1992 Hanson
5,123,253 A 6/1992 Hanson et al.
5,123,255 A 6/1992 Ohizumi
5,125,067 A 6/1992 Erdman
RE34,001 E 7/1992 Wrobel
5,127,232 A 7/1992 Paige et al.
5,131,237 A 7/1992 Valbjorn
5,136,855 A * 8/1992 Lenarduzzi ..... F24J 3/081 62/129
5,140,394 A 8/1992 Cobb, III et al.
5,141,407 A 8/1992 Ramsey et al.
5,142,877 A 9/1992 Shimizu
5,150,584 A 9/1992 Tomasov et al.
5,156,539 A 10/1992 Anderson et al.
5,167,494 A 12/1992 Inagaki et al.
5,170,935 A 12/1992 Federspiel et al.
5,170,936 A 12/1992 Kubo et al.
5,181,389 A 1/1993 Hanson et al.
5,186,014 A 2/1993 Runk
5,197,666 A 3/1993 Wedekind
5,199,855 A 4/1993 Nakajima et al.
5,200,872 A 4/1993 D'Entremont et al.
5,200,987 A 4/1993 Gray
5,201,862 A 4/1993 Pettitt
5,203,178 A 4/1993 Shyu
5,203,179 A 4/1993 Powell
5,209,076 A 5/1993 Kauffman et al.
5,209,400 A 5/1993 Winslow et al.
5,219,041 A 6/1993 Greve
5,224,354 A 7/1993 Ito et al.
5,224,835 A 7/1993 Oltman
5,226,472 A 7/1993 Benevelli et al.
5,228,300 A 7/1993 Shim
5,228,304 A 7/1993 Ryan
5,228,307 A 7/1993 Koce
5,230,223 A 7/1993 Hullar et al.
5,231,844 A 8/1993 Park
5,233,841 A 8/1993 Jyrek

(56) References Cited

U.S. PATENT DOCUMENTS 5,235,526 A 8/1993 Saffell
5,237,830 A 8/1993 Grant
5,241,664 A 8/1993 Ohba et al.
5,241,833 A 9/1993 Ohkoshi
5,243,827 A 9/1993 Hagita et al.
5,243,829 A 9/1993 Bessler
5,245,833 A 9/1993 Mei et al.
5,248,244 A 9/1993 Ho et al.
5,251,453 A 10/1993 Stanke et al.
5,251,454 A 10/1993 Yoon
5,255,977 A 10/1993 Eimer et al.
5,257,506 A 11/1993 DeWolf et al.
5,262,704 A 11/1993 Farr
5,265,434 A 11/1993 Alsenz
5,269,458 A 12/1993 Sol
5,271,556 A 12/1993 Helt et al.
5,274,571 A 12/1993 Hesse et al.
5,276,630 A 1/1994 Baldwin et al.
5,279,458 A 1/1994 DeWolf et al.
5,282,728 A 2/1994 Swain
5,284,026 A 2/1994 Powell
5,289,362 A 2/1994 Liebl et al.
5,290,154 A 3/1994 Kotlarek et al.
5,291,752 A 3/1994 Alvarez et al.
5,299,504 A 4/1994 Abele
5,303,112 A 4/1994 Zulaski et al.
5,303,560 A 4/1994 Hanson et al.
5,311,451 A 5/1994 Barrett
5,311,562 A 5/1994 Palusamy et al.
5,316,448 A 5/1994 Ziegler et al.
5,320,506 A 6/1994 Fogt
5,333,460 A 8/1994 Lewis et al.
5,335,507 A 8/1994 Powell
5,336,058 A 8/1994 Yokoyama
5,337,576 A 8/1994 Dorfman et al.
5,347,476 A 9/1994 McBean, Sr.
5,351,037 A 9/1994 Martell et al.
5,362,206 A 11/1994 Westerman et al.
5,362,211 A 11/1994 Iizuka et al.
5,368,446 A 11/1994 Rode
5,369,958 A 12/1994 Kasai et al.
5,381,669 A 1/1995 Bahel et al.
5,381,692 A 1/1995 Winslow et al.
5,388,176 A 2/1995 Dykstra et al.
5,395,042 A * 3/1995 Riley ..... F24F 11/0009 165/237
5,410,230 A 4/1995 Bessler et al.
5,414,792 A 5/1995 Shorey
5,415,008 A 5/1995 Bessler
5,416,781 A 5/1995 Ruiz
5,423,190 A 6/1995 Friedland
5,423,192 A 6/1995 Young et al.
5,426,952 A 6/1995 Bessler
5,431,026 A 7/1995 Jaster
5,432,500 A 7/1995 Scripps
5,435,145 A 7/1995 Jaster
5,435,148 A 7/1995 Sandofsky et al.
5,440,890 A 8/1995 Bahel et al.
5,440,891 A 8/1995 Hindmon, Jr. et al.
5,440,895 A 8/1995 Bahel et al.
5,446,677 A 8/1995 Jensen et al.
5,450,359 A 9/1995 Sharma et al.
5,452,291 A 9/1995 Eisenhandler et al.
5,454,229 A 10/1995 Hanson et al.
5,457,965 A 10/1995 Blair et al.
5,460,006 A 10/1995 Torimitsu
5,467,011 A 11/1995 Hunt
5,467,264 A 11/1995 Rauch et al.
5,469,045 A 11/1995 Dove et al.
5,475,986 A 12/1995 Bahel et al.
5,478,212 A 12/1995 Sakai et al.
5,481,481 A 1/1996 Frey et al.
5,481,884 A 1/1996 Scoccia
5,483,141 A 1/1996 Uesugi
5,491,978 A 2/1996 Young et al.
5,495,722 A 3/1996 Manson et al.
5,499,512 A 3/1996 Jurewicz et al.
5,509,786 A 4/1996 Mizutani et al.
5,511,387 A 4/1996 Tinsler
5,512,883 A 4/1996 Lane, Jr.
5,515,267 A 5/1996 Alsenz
5,515,692 A 5/1996 Sterber et al.
5,519,301 A 5/1996 Yoshida et al.
5,519,337 A 5/1996 Casada
5,528,908 A 6/1996 Bahel et al.
5,532,534 A 7/1996 Baker et al.
5,533,347 A 7/1996 Ott et al.
5,535,136 A 7/1996 Standifer
5,535,597 A 7/1996 An
5,546,015 A 8/1996 Okabe
5,546,073 A 8/1996 Duff et al.
5,546,756 A 8/1996 Ali
5,546,757 A 8/1996 Whipple, III
5,548,966 A 8/1996 Tinsler
5,555,195 A 9/1996 Jensen et al.
5,562,426 A 10/1996 Watanabe et al.
5,563,490 A 10/1996 Kawaguchi et al.
5,564,280 A 10/1996 Schilling et al.
5,566,084 A 10/1996 Cmar
5,570,085 A 10/1996 Bertsch
5,570,258 A 10/1996 Manning
5,572,643 A 11/1996 Judson
5,577,905 A 11/1996 Momber et al.
5,579,648 A 12/1996 Hanson et al.
5,581,229 A 12/1996 Hunt
5,586,445 A 12/1996 Bessler
5,586,446 A 12/1996 Torimitsu
5,590,830 A 1/1997 Kettler et al.
5,592,058 A 1/1997 Archer et al.
5,592,824 A 1/1997 Sogabe et al.
5,596,507 A 1/1997 Jones et al.
5,600,960 A 2/1997 Schwedler et al.
5,602,749 A 2/1997 Vosburgh
5,602,757 A 2/1997 Haseley et al.
5,602,761 A 2/1997 Spoerre et al.
5,610,339 A 3/1997 Haseley et al.
5,611,674 A 3/1997 Bass et al.
5,613,841 A 3/1997 Bass et al.
5,615,071 A 3/1997 Higashikata et al.
5,616,829 A 4/1997 Balaschak et al.
5,623,834 A 4/1997 Bahel et al.
5,628,201 A 5/1997 Bahel et al.
5,630,325 A 5/1997 Bahel et al.
5,635,896 A 6/1997 Tinsley et al.
5,641,270 A 6/1997 Sgourakes et al.
5,643,482 A 7/1997 Sandelman et al.
5,650,936 A 7/1997 Loucks et al.
5,651,263 A 7/1997 Nonaka et al.
5,655,379 A 8/1997 Jaster et al.
5,655,380 A 8/1997 Calton
5,656,765 A * 8/1997 Gray ..... F02D 41/1441 60/276
5,656,767 A 8/1997 Garvey, III et al.
5,666,815 A 9/1997 Aloise
5,682,949 A 11/1997 Ratcliffe et al.
5,684,463 A 11/1997 Diercks et al.
5,689,963 A 11/1997 Bahel et al.
5,691,692 A 11/1997 Herbstritt
5,694,010 A 12/1997 Oomura et al.
5,696,501 A 12/1997 Ouellette et al.
5,699,670 A 12/1997 Jurewicz et al.
5,706,007 A 1/1998 Fragnito et al.
5,707,210 A 1/1998 Ramsey et al.
5,711,785 A 1/1998 Maxwell
5,713,724 A 2/1998 Centers et al.
5,714,931 A 2/1998 Petite et al.
5,715,704 A 2/1998 Cholkeri et al.
5,718,822 A 2/1998 Richter
5,724,571 A 3/1998 Woods
5,729,474 A 3/1998 Hildebrand et al.
5,737,931 A 4/1998 Ueno et al.
5,741,120 A 4/1998 Bass et al.
5,743,109 A 4/1998 Schulak
5,745,114 A 4/1998 King et al.

(56) References Cited

U.S. PATENT DOCUMENTS 5,749,238 A 5/1998 Schmidt
5,751,916 A 5/1998 Kon et al.
5,752,385 A 5/1998 Nelson
5,754,450 A 5/1998 Solomon et al.
5,754,732 A 5/1998 Vlahu
5,757,664 A 5/1998 Rogers et al.
5,757,892 A 5/1998 Blanchard et al.
5,761,083 A 6/1998 Brown, Jr. et al.
5,764,509 A 6/1998 Gross et al.
5,772,214 A 6/1998 Stark
5,772,403 A 6/1998 Allison et al.
5,782,101 A * 7/1998 Dennis ..... F25B 5/02 62/160
5,784,232 A 7/1998 Farr
5,790,898 A 8/1998 Kishima et al.
5,795,381 A 8/1998 Holder
5,798,941 A 8/1998 McLeister
5,802,860 A 9/1998 Barrows
5,805,856 A 9/1998 Hanson
5,807,336 A 9/1998 Russo et al.
5,808,441 A 9/1998 Nehring
5,810,908 A 9/1998 Gray et al.
5,812,061 A 9/1998 Simons
5,825,597 A 10/1998 Young
5,827,963 A 10/1998 Selegatto et al.
5,839,094 A 11/1998 French
5,839,291 A 11/1998 Chang et al.
5,841,654 A 11/1998 Verissimo et al.
5,857,348 A 1/1999 Conry
5,860,286 A 1/1999 Tulpule
5,861,807 A 1/1999 Leyden et al.
5,867,998 A 2/1999 Guertin
5,869,960 A 2/1999 Brand
5,873,257 A 2/1999 Peterson
5,875,430 A 2/1999 Koether
5,875,638 A 3/1999 Tinsler
5,884,494 A 3/1999 Okoren et al.
5,887,786 A 3/1999 Sandelman
5,900,801 A 5/1999 Heagle et al.
5,904,049 A 5/1999 Jaster et al.
5,918,200 A 6/1999 Tsutsui et al.
5,924,295 A 7/1999 Park
5,924,486 A 7/1999 Ehlers et al.
5,926,103 A 7/1999 Petite
5,926,531 A 7/1999 Petite
5,930,773 A 7/1999 Crooks et al.
5,934,087 A 8/1999 Watanabe et al.
5,939,974 A 8/1999 Heagle et al.
5,946,922 A 9/1999 Viard et al.
5,947,693 A 9/1999 Yang
5,947,701 A 9/1999 Hugenroth
5,949,677 A 9/1999 Ho
5,950,443 A 9/1999 Meyer et al.
5,953,490 A 9/1999 Wiklund et al.
5,956,658 A 9/1999 McMahon
5,971,712 A 10/1999 Kann
5,975,854 A 11/1999 Culp, III et al.
5,984,645 A 11/1999 Cummings
5,986,571 A 11/1999 Flick
5,987,903 A 11/1999 Bathla
5,988,986 A 11/1999 Brinken et al.
5,995,347 A 11/1999 Rudd et al.
5,995,351 A 11/1999 Katsumata et al.
6,006,142 A 12/1999 Seem et al.
6,006,171 A 12/1999 Vines et al.
6,011,368 A 1/2000 Kalpathi et al.
6,013,108 A 1/2000 Karolys et al.
6,017,192 A 1/2000 Clack et al.
6,020,702 A 2/2000 Farr
6,023,420 A 2/2000 McCormick et al.
6,026,651 A 2/2000 Sandelman
6,028,522 A 2/2000 Petite
6,035,653 A 3/2000 Itoh et al.
6,035,661 A 3/2000 Sunaga et al.
6,038,871 A 3/2000 Gutierrez et al.
6,041,605 A 3/2000 Heinrichs
6,041,609 A 3/2000 Hornsleth et al.
6,041,856 A 3/2000 Thrasher et al.
6,042,344 A 3/2000 Lifson
6,044,062 A 3/2000 Brownrigg et al.
6,047,557 A 4/2000 Pham et al.
6,050,098 A 4/2000 Meyer et al.
6,050,780 A 4/2000 Hasegawa et al.
6,052,731 A 4/2000 Holdsworth et al.
6,057,771 A 5/2000 Lakra
6,065,946 A 5/2000 Lathrop
6,068,447 A 5/2000 Foege
6,070,110 A 5/2000 Shah et al.
6,075,530 A 6/2000 Lucas et al.
6,077,051 A 6/2000 Centers et al.
6,081,750 A 6/2000 Hoffberg et al.
6,082,495 A 7/2000 Steinbarger et al.
6,082,971 A 7/2000 Gunn et al.
6,085,530 A 7/2000 Barito
6,088,659 A 7/2000 Kelley et al.
6,088,688 A 7/2000 Crooks et al.
6,092,370 A 7/2000 Tremoulet, Jr. et al.
6,092,378 A 7/2000 Das et al.
6,092,992 A 7/2000 Imblum et al.
6,095,674 A 8/2000 Verissimo et al.
6,098,893 A 8/2000 Berglund et al.
6,102,665 A 8/2000 Centers et al.
6,110,260 A 8/2000 Kubokawa
6,119,949 A 9/2000 Lindstrom
6,122,603 A 9/2000 Budike, Jr.
6,125,642 A 10/2000 Seener et al.
6,128,583 A 10/2000 Dowling
6,128,953 A 10/2000 Mizukoshi
6,129,527 A 10/2000 Donahoe et al.
6,138,461 A 10/2000 Park et al.
6,142,741 A 11/2000 Nishihata et al.
6,144,888 A 11/2000 Lucas et al.
6,145,328 A 11/2000 Choi
6,147,601 A 11/2000 Sandelman et al.
6,152,375 A 11/2000 Robison
6,152,376 A 11/2000 Sandelman et al.
6,153,942 A 11/2000 Roseman et al.
6,153,993 A 11/2000 Oomura et al.
6,154,488 A 11/2000 Hunt
6,157,310 A 12/2000 Milne et al.
6,158,230 A 12/2000 Katsuki
6,160,477 A 12/2000 Sandelman et al.
6,169,979 B1 1/2001 Johnson
6,172,476 B1 1/2001 Tolbert, Jr. et al.
6,174,136 B1 1/2001 Kilayko et al.
6,176,683 B1 1/2001 Yang
6,176,686 B1 1/2001 Wallis et al.
6,177,884 B1 1/2001 Hunt et al.
6,178,362 B1 1/2001 Woolard et al.
6,179,214 B1 1/2001 Key et al.
6,181,033 B1 1/2001 Wright
6,190,442 B1 2/2001 Redner
6,191,545 B1 2/2001 Kawabata et al.
6,192,282 B1 2/2001 Smith et al.
6,199,018 B1 3/2001 Quist et al.
6,211,782 B1 4/2001 Sandelman et al.
6,213,731 B1 4/2001 Doepker et al.
6,215,405 B1 4/2001 Handley et al.
6,216,956 B1 4/2001 Ehlers et al.
6,218,953 B1 4/2001 Petite
6,223,543 B1 5/2001 Sandelman
6,223,544 B1 5/2001 Seem
6,228,155 B1 5/2001 Tai
6,230,501 B1 5/2001 Bailey, Sr. et al.
6,233,327 B1 5/2001 Petite
6,234,019 B1 5/2001 Caldeira
6,240,733 B1 6/2001 Brandon et al.
6,240,736 B1 6/2001 Fujita et al.
6,244,061 B1 6/2001 Takagi et al.
6,249,516 B1 6/2001 Brownrigg et al.
6,260,004 B1 7/2001 Hays et al.
6,266,968 B1 7/2001 Redlich
6,268,664 B1 7/2001 Rolls et al.
6,272,868 B1 8/2001 Grabon et al.

(56) References Cited

U.S. PATENT DOCUMENTS 6,276,901 B1 8/2001 Farr et al.
6,279,332 B1 8/2001 Yeo et al.
6,290,043 B1 9/2001 Ginder et al.
6,293,114 B1 9/2001 Kamemoto
6,293,767 B1 9/2001 Bass
6,302,654 B1 10/2001 Millet et al.
6,304,934 B1 10/2001 Pimenta et al.
6,320,275 B1 11/2001 Okamoto et al.
6,324,854 B1 12/2001 Jayanth
6,327,541 B1 12/2001 Pitchford et al.
6,332,327 B1 12/2001 Street et al.
6,334,093 B1 12/2001 More
6,349,883 B1 2/2002 Simmons et al.
6,359,410 B1 3/2002 Randolph
6,360,551 B1 3/2002 Renders
6,366,889 B1 4/2002 Zaloom
6,375,439 B1 4/2002 Missio
6,378,315 B1 4/2002 Gelber et al.
6,381,971 B2 5/2002 Honda
6,385,510 B1 5/2002 Hoog et al.
6,389,823 B1 5/2002 Loprete et al.
6,390,779 B1 5/2002 Cunkelman
6,391,102 B1 5/2002 Bodden et al.
6,393,848 B2 5/2002 Roh et al.
6,397,606 B1 6/2002 Roh et al.
6,397,612 B1 6/2002 Kernkamp et al.
6,406,265 B1 6/2002 Hahn et al.
6,406,266 B1 6/2002 Hugenroth et al.
6,408,228 B1 6/2002 Seem et al.
6,408,258 B1 6/2002 Richer
6,412,293 B1 7/2002 Pham et al.
6,414,594 B1 7/2002 Guerlain
6,430,268 B1 8/2002 Petite
6,433,791 B2 8/2002 Selli et al.
6,437,691 B1 8/2002 Sandelman et al.
6,437,692 B1 8/2002 Petite et al.
6,438,981 B1 8/2002 Whiteside
6,442,953 B1 9/2002 Trigiani et al.
6,449,972 B2 9/2002 Pham et al.
6,450,771 B1 9/2002 Centers et al.
6,451,210 B1 9/2002 Sivavec et al.
6,453,687 B2 9/2002 Sharood et al.
6,454,177 B1 9/2002 Sasao et al.
6,454,538 B1 9/2002 Witham et al.
6,456,928 B1 9/2002 Johnson
6,457,319 B1 10/2002 Ota et al.
6,457,948 B1 10/2002 Pham
6,460,731 B2 10/2002 Estelle et al.
6,462,654 B1 10/2002 Sandelman et al.
6,463,747 B1 10/2002 Temple
6,466,971 B1 10/2002 Humpleman et al.
6,467,280 B2 10/2002 Pham et al.
6,471,486 B1 10/2002 Centers et al.
6,474,084 B2 11/2002 Gauthier et al.
6,484,520 B2 11/2002 Kawaguchi et al.
6,487,457 B1 11/2002 Hull et al.
6,490,506 B1 12/2002 March
6,492,923 B1 12/2002 Inoue et al.
6,497,554 B2 12/2002 Yang et al.
6,501,240 B2 12/2002 Ueda et al.
6,501,629 B1 12/2002 Marriott
6,502,409 B1 1/2003 Gatling et al.
6,505,087 B1 1/2003 Lucas et al.
6,505,475 B1 1/2003 Zugibe et al.
6,510,350 B1 1/2003 Steen, III et al.
6,522,974 B2 2/2003 Sitton
6,523,130 B1 2/2003 Hickman et al.
6,526,766 B1 3/2003 Hiraoka et al.
6,529,590 B1 3/2003 Centers
6,529,839 B1 3/2003 Uggerud et al.
6,533,552 B2 3/2003 Centers et al.
6,535,123 B2 3/2003 Sandelman et al.
6,535,270 B1 * 3/2003 Murayama ..... G03F 7/70858 355/30
6,535,859 B1 3/2003 Yablonowski et al.
6,537,034 B2 3/2003 Park et al.
6,542,062 B1 4/2003 Herrick
6,549,135 B2 4/2003 Singh et al.
6,551,069 B2 4/2003 Narney, II et al.
6,553,774 B1 4/2003 Ishio et al.
6,558,126 B1 5/2003 Hahn et al.
6,560,976 B2 5/2003 Jayanth
6,571,280 B1 5/2003 Hubacher
6,571,566 B1 6/2003 Temple et al.
6,571,586 B1 6/2003 Ritson et al.
6,574,561 B2 6/2003 Alexander et al.
6,577,959 B1 6/2003 Chajec et al.
6,577,962 B1 6/2003 Afshari
6,578,373 B1 6/2003 Barbier
6,583,720 B1 6/2003 Quigley
6,589,029 B1 7/2003 Heller
6,591,620 B2 7/2003 Kikuchi et al.
6,595,475 B2 7/2003 Svabek et al.
6,595,757 B2 7/2003 Shen
6,598,056 B1 7/2003 Hull et al.
6,601,397 B2 8/2003 Pham et al.
6,604,093 B1 8/2003 Etzion et al.
6,609,070 B1 8/2003 Lueck
6,609,078 B2 8/2003 Starling et al.
6,615,594 B2 9/2003 Jayanth et al.
6,616,415 B1 9/2003 Renken et al.
6,618,578 B1 9/2003 Petite
6,618,709 B1 9/2003 Sneeringer
6,621,443 B1 9/2003 Selli et al.
6,622,925 B2 9/2003 Carner et al.
6,622,926 B1 9/2003 Sartain et al.
6,628,764 B1 9/2003 Petite
6,629,420 B2 10/2003 Renders
6,630,749 B1 10/2003 Takagi et al.
6,631,298 B1 10/2003 Pagnano et al.
6,636,893 B1 10/2003 Fong
6,643,567 B2 11/2003 Kolk et al.
6,644,848 B1 11/2003 Clayton et al.
6,647,735 B2 11/2003 Street et al.
6,658,345 B2 12/2003 Miller
6,658,373 B2 12/2003 Rossi et al.
6,662,584 B1 12/2003 Whiteside
6,662,653 B1 12/2003 Scaliante et al.
6,671,586 B2 12/2003 Davis et al.
6,672,846 B2 1/2004 Rajendran et al.
6,675,591 B2 1/2004 Singh et al.
6,679,072 B2 1/2004 Pham et al.
6,684,349 B2 1/2004 Gullo et al.
6,685,438 B2 2/2004 Yoo et al.
6,698,218 B2 3/2004 Goth et al.
6,701,725 B2 3/2004 Rossi et al.
6,708,083 B2 3/2004 Orthlieb et al.
6,708,508 B2 3/2004 Demuth et al.
6,709,244 B2 3/2004 Pham
6,711,470 B1 3/2004 Hartenstein et al.
6,711,911 B1 3/2004 Grabon et al.
6,717,513 B1 4/2004 Sandelman et al.
6,721,770 B1 4/2004 Morton et al.
6,725,182 B2 4/2004 Pagnano et al.
6,732,538 B2 5/2004 Trigiani et al.
6,745,107 B1 6/2004 Miller
6,747,557 B1 6/2004 Petite et al.
6,757,665 B1 6/2004 Unsworth et al.
6,758,050 B2 7/2004 Jayanth et al.
6,758,051 B2 7/2004 Jayanth et al.
6,760,207 B2 7/2004 Wyatt et al.
6,772,096 B2 8/2004 Murakami et al.
6,772,598 B1 8/2004 Rinehart
6,775,995 B1 8/2004 Bahel et al.
6,784,807 B2 8/2004 Petite et al.
6,785,592 B1 8/2004 Smith et al.
6,786,473 B1 9/2004 Alles
6,799,951 B2 10/2004 Lifson et al.
6,804,993 B2 10/2004 Selli
6,811,380 B2 11/2004 Kim
6,813,897 B1 11/2004 Bash et al.
6,816,811 B2 11/2004 Seem
6,823,680 B2 11/2004 Jayanth
6,829,542 B1 12/2004 Reynolds et al.

(56) References Cited

U.S. PATENT DOCUMENTS

| | | | |
|---|---|---|---|
| 6,832,120 | B1 | 12/2004 | Frank et al. |
| 6,832,898 | B2 | 12/2004 | Yoshida et al. |
| 6,836,737 | B2 | 12/2004 | Petite et al. |
| 6,837,922 | B2 | 1/2005 | Gorin |
| 6,839,790 | B2 | 1/2005 | Barros De Almeida et al. |
| 6,854,345 | B2 | 2/2005 | Alves et al. |
| 6,862,498 | B2 | 3/2005 | Davis et al. |
| 6,868,678 | B2 | 3/2005 | Mei et al. |
| 6,868,686 | B2 | 3/2005 | Ueda et al. |
| 6,869,272 | B2 | 3/2005 | Odachi et al. |
| 6,870,486 | B2 | 3/2005 | Souza et al. |
| 6,885,949 | B2 | 4/2005 | Selli |
| 6,889,173 | B2 | 5/2005 | Singh |
| 6,891,838 | B1 | 5/2005 | Petite et al. |
| 6,892,546 | B2 | 5/2005 | Singh et al. |
| 6,897,772 | B1 | 5/2005 | Scheffler et al. |
| 6,900,738 | B2 | 5/2005 | Crichlow |
| 6,901,066 | B1 | 5/2005 | Helgeson |
| 6,904,385 | B1 | 6/2005 | Budike, Jr. |
| 6,914,533 | B2 | 7/2005 | Petite |
| 6,914,893 | B2 | 7/2005 | Petite |
| 6,922,155 | B1 | 7/2005 | Evans et al. |
| 6,931,445 | B2 | 8/2005 | Davis |
| 6,934,862 | B2 | 8/2005 | Sharood et al. |
| 6,952,658 | B2 | 10/2005 | Greulich et al. |
| 6,953,630 | B2 | 10/2005 | Wells |
| 6,956,344 | B2 | 10/2005 | Robertson et al. |
| 6,964,558 | B2 | 11/2005 | Hahn et al. |
| 6,966,759 | B2 | 11/2005 | Hahn et al. |
| 6,968,295 | B1 | 11/2005 | Carr |
| 6,973,410 | B2 | 12/2005 | Seigel |
| 6,973,793 | B2 | 12/2005 | Douglas et al. |
| 6,973,794 | B2 | 12/2005 | Street et al. |
| 6,976,366 | B2 | 12/2005 | Starling et al. |
| 6,978,225 | B2 | 12/2005 | Retlich et al. |
| 6,981,384 | B2 | 1/2006 | Dobmeier et al. |
| 6,983,321 | B2 | 1/2006 | Trinon et al. |
| 6,983,889 | B2 | 1/2006 | Alles |
| 6,986,469 | B2 | 1/2006 | Gauthier et al. |
| 6,987,450 | B2 | 1/2006 | Marino et al. |
| 6,990,821 | B2 | 1/2006 | Singh et al. |
| 6,992,452 | B1 | 1/2006 | Sachs et al. |
| 6,996,441 | B1 | 2/2006 | Tobias |
| 6,997,390 | B2 | 2/2006 | Alles |
| 6,998,807 | B2 | 2/2006 | Phillips et al. |
| 6,998,963 | B2 | 2/2006 | Flen et al. |
| 6,999,996 | B2 | 2/2006 | Sunderland |
| 7,000,422 | B2 | 2/2006 | Street et al. |
| 7,003,378 | B2 | 2/2006 | Poth |
| 7,009,510 | B1 | 3/2006 | Douglass et al. |
| 7,010,925 | B2 | 3/2006 | Sienel et al. |
| 7,019,667 | B2 | 3/2006 | Petite et al. |
| 7,024,665 | B2 | 4/2006 | Ferraz et al. |
| 7,024,870 | B2 | 4/2006 | Singh et al. |
| 7,030,752 | B2 | 4/2006 | Tyroler |
| 7,031,880 | B1 | 4/2006 | Seem et al. |
| 7,035,693 | B2 | 4/2006 | Cassiolato et al. |
| 7,039,532 | B2 | 5/2006 | Hunter |
| 7,042,180 | B2 | 5/2006 | Terry et al. |
| 7,042,350 | B2 | 5/2006 | Patrick et al. |
| 7,043,339 | B2 | 5/2006 | Maeda et al. |
| 7,043,459 | B2 | 5/2006 | Peevey |
| 7,047,753 | B2 | 5/2006 | Street et al. |
| 7,053,766 | B2 | 5/2006 | Fisler et al. |
| 7,053,767 | B2 | 5/2006 | Petite et al. |
| 7,054,271 | B2 | 5/2006 | Brownrigg et al. |
| 7,062,580 | B2 | 6/2006 | Donaires |
| 7,062,830 | B2 | 6/2006 | Alles |
| 7,063,537 | B2 | 6/2006 | Selli et al. |
| 7,072,797 | B2 | 7/2006 | Gorinevsky |
| 7,075,327 | B2 | 7/2006 | Dimino et al. |
| 7,079,810 | B2 | 7/2006 | Petite et al. |
| 7,079,967 | B2 | 7/2006 | Rossi et al. |
| 7,082,380 | B2 | 7/2006 | Wiebe et al. |
| 7,089,125 | B2 | 8/2006 | Sonderegger |
| 7,091,847 | B2 | 8/2006 | Capowski et al. |
| 7,092,767 | B2 | 8/2006 | Pagnano et al. |
| 7,092,794 | B1 | 8/2006 | Hill et al. |
| 7,096,153 | B2 | 8/2006 | Guralnik et al. |
| 7,102,490 | B2 | 9/2006 | Flen et al. |
| 7,103,511 | B2 | 9/2006 | Petite |
| 7,110,843 | B2 | 9/2006 | Pagnano et al. |
| 7,110,898 | B2 | 9/2006 | Montijo et al. |
| 7,113,376 | B2 | 9/2006 | Nomura et al. |
| 7,114,343 | B2 | 10/2006 | Kates |
| 7,123,020 | B2 | 10/2006 | Hill et al. |
| 7,123,458 | B2 | 10/2006 | Mohr et al. |
| 7,124,728 | B2 | 10/2006 | Carey et al. |
| 7,126,465 | B2 | 10/2006 | Faltesek |
| 7,130,170 | B2 | 10/2006 | Wakefield et al. |
| 7,130,832 | B2 | 10/2006 | Bannai et al. |
| 7,134,295 | B2 | 11/2006 | Maekawa |
| 7,137,550 | B1 | 11/2006 | Petite |
| 7,142,125 | B2 | 11/2006 | Larson et al. |
| 7,145,438 | B2 | 12/2006 | Flen et al. |
| 7,145,462 | B2 | 12/2006 | Dewing et al. |
| 7,159,408 | B2 | 1/2007 | Sadegh et al. |
| 7,162,884 | B2 | 1/2007 | Alles |
| 7,163,158 | B2 | 1/2007 | Rossi et al. |
| 7,171,372 | B2 | 1/2007 | Daniel et al. |
| 7,174,728 | B2 | 2/2007 | Jayanth |
| 7,180,412 | B2 | 2/2007 | Bonicatto et al. |
| 7,184,861 | B2 | 2/2007 | Petite |
| 7,188,482 | B2 | 3/2007 | Sadegh et al. |
| 7,188,779 | B2 | 3/2007 | Alles |
| 7,201,006 | B2 | 4/2007 | Kates |
| 7,207,496 | B2 | 4/2007 | Alles |
| 7,209,840 | B2 | 4/2007 | Petite et al. |
| 7,212,887 | B2 | 5/2007 | Shah et al |
| 7,222,493 | B2 | 5/2007 | Jayanth et al. |
| 7,224,740 | B2 | 5/2007 | Hunt |
| 7,225,193 | B2 | 5/2007 | Mets et al. |
| 7,227,450 | B2 | 6/2007 | Garvy et al. |
| 7,228,691 | B2 | 6/2007 | Street et al. |
| 7,230,528 | B2 | 6/2007 | Kates |
| 7,234,313 | B2 | 6/2007 | Bell et al. |
| 7,236,765 | B2 | 6/2007 | Bonicatto et al. |
| 7,244,294 | B2 | 7/2007 | Kates |
| 7,246,014 | B2 | 7/2007 | Forth et al. |
| 7,255,285 | B2 | 8/2007 | Troost et al. |
| 7,257,501 | B2 | 8/2007 | Zhan et al. |
| 7,260,505 | B2 | 8/2007 | Felke et al. |
| 7,261,762 | B2 | 8/2007 | Kang et al. |
| 7,263,073 | B2 | 8/2007 | Petite et al. |
| 7,263,446 | B2 | 8/2007 | Morin et al. |
| 7,266,812 | B2 | 9/2007 | Pagnano |
| 7,270,278 | B2 | 9/2007 | Street et al. |
| 7,274,995 | B2 | 9/2007 | Zhan et al. |
| 7,275,377 | B2 | 10/2007 | Kates |
| 7,286,945 | B2 | 10/2007 | Zhan et al. |
| 7,290,398 | B2 | 11/2007 | Wallace et al. |
| 7,290,989 | B2 | 11/2007 | Jayanth |
| 7,295,128 | B2 | 11/2007 | Petite |
| 7,295,896 | B2 | 11/2007 | Norbeck |
| 7,317,952 | B2 | 1/2008 | Bhandiwad et al. |
| 7,328,192 | B1 | 2/2008 | Stengard et al. |
| 7,330,886 | B2 | 2/2008 | Childers et al. |
| 7,331,187 | B2 | 2/2008 | Kates |
| 7,336,168 | B2 | 2/2008 | Kates |
| 7,337,191 | B2 | 2/2008 | Haeberle et al. |
| 7,343,750 | B2 | 3/2008 | Lifson et al. |
| 7,343,751 | B2 | 3/2008 | Kates |
| 7,346,463 | B2 | 3/2008 | Petite et al. |
| 7,346,472 | B1 | 3/2008 | Moskowitz et al. |
| 7,349,824 | B2 | 3/2008 | Seigel |
| 7,350,112 | B2 | 3/2008 | Fox et al. |
| 7,351,274 | B2 | 4/2008 | Helt et al. |
| 7,352,545 | B2 | 4/2008 | Wyatt et al. |
| 7,363,200 | B2 | 4/2008 | Lu |
| 7,376,712 | B1 | 5/2008 | Granatelli et al. |
| 7,377,118 | B2 | 5/2008 | Esslinger |
| 7,383,030 | B2 | 6/2008 | Brown et al. |
| 7,383,158 | B2 | 6/2008 | Krocker et al. |
| 7,392,661 | B2 | 7/2008 | Alles |

(56) References Cited

U.S. PATENT DOCUMENTS

| | | | |
|---|---|---|---|
| 7,397,907 | B2 | 7/2008 | Petite |
| 7,400,240 | B2 | 7/2008 | Shrode et al. |
| 7,412,842 | B2 | 8/2008 | Pham |
| 7,414,525 | B2 | 8/2008 | Costea et al. |
| 7,421,374 | B2 | 9/2008 | Zhan et al. |
| 7,421,850 | B2 | 9/2008 | Street et al. |
| 7,424,343 | B2 | 9/2008 | Kates |
| 7,424,345 | B2 | 9/2008 | Norbeck |
| 7,424,527 | B2 | 9/2008 | Petite |
| 7,432,824 | B2 | 10/2008 | Flen et al. |
| 7,433,854 | B2 | 10/2008 | Joseph et al. |
| 7,434,742 | B2 | 10/2008 | Mueller et al. |
| 7,437,150 | B1 | 10/2008 | Morelli et al. |
| 7,440,560 | B1 | 10/2008 | Barry |
| 7,440,767 | B2 | 10/2008 | Ballay et al. |
| 7,443,313 | B2 | 10/2008 | Davis et al. |
| 7,444,251 | B2 | 10/2008 | Nikovski et al. |
| 7,445,665 | B2 | 11/2008 | Hsieh et al. |
| 7,447,603 | B2 | 11/2008 | Bruno |
| 7,447,609 | B2 | 11/2008 | Guralnik et al. |
| 7,451,606 | B2 | 11/2008 | Harrod |
| 7,454,439 | B1 | 11/2008 | Gansner et al. |
| 7,458,223 | B2 | 12/2008 | Pham |
| 7,468,661 | B2 | 12/2008 | Petite et al. |
| 7,469,546 | B2 | 12/2008 | Kates |
| 7,474,992 | B2 | 1/2009 | Ariyur |
| 7,480,501 | B2 | 1/2009 | Petite |
| 7,483,810 | B2 | 1/2009 | Jackson et al. |
| 7,484,376 | B2 | 2/2009 | Pham |
| 7,490,477 | B2 | 2/2009 | Singh et al. |
| 7,491,034 | B2 | 2/2009 | Jayanth |
| 7,503,182 | B2 | 3/2009 | Bahel et al. |
| 7,510,126 | B2 | 3/2009 | Rossi et al. |
| 7,523,619 | B2 | 4/2009 | Kojima et al. |
| 7,528,711 | B2 | 5/2009 | Kates |
| 7,533,070 | B2 | 5/2009 | Guralnik et al. |
| 7,537,172 | B2 | 5/2009 | Rossi et al. |
| 7,552,030 | B2 | 6/2009 | Guralnik et al. |
| 7,552,596 | B2 | 6/2009 | Galante et al. |
| 7,555,364 | B2 | 6/2009 | Poth et al. |
| 7,574,333 | B2 | 8/2009 | Lu |
| 7,580,812 | B2 | 8/2009 | Ariyur et al. |
| 7,594,407 | B2 | 9/2009 | Singh et al. |
| 7,596,959 | B2 | 10/2009 | Singh et al. |
| 7,606,683 | B2 | 10/2009 | Bahel et al. |
| 7,631,508 | B2 | 12/2009 | Braun et al. |
| 7,636,901 | B2 | 12/2009 | Munson et al. |
| 7,644,591 | B2 | 1/2010 | Singh et al. |
| 7,648,077 | B2 | 1/2010 | Rossi et al. |
| 7,648,342 | B2 | 1/2010 | Jayanth |
| 7,650,425 | B2 | 1/2010 | Davis et al. |
| 7,660,700 | B2 | 2/2010 | Moskowitz et al. |
| 7,660,774 | B2 | 2/2010 | Mukherjee et al. |
| 7,665,315 | B2 | 2/2010 | Singh et al. |
| 7,686,872 | B2 | 3/2010 | Kang |
| 7,697,492 | B2 | 4/2010 | Petite |
| 7,703,694 | B2 | 4/2010 | Mueller et al. |
| 7,704,052 | B2 | 4/2010 | Iimura et al. |
| 7,706,320 | B2 | 4/2010 | Davis et al. |
| 7,726,583 | B2 | 6/2010 | Maekawa |
| 7,734,451 | B2 | 6/2010 | MacArthur et al. |
| 7,738,999 | B2 | 6/2010 | Petite |
| 7,739,378 | B2 | 6/2010 | Petite |
| 7,742,393 | B2 | 6/2010 | Bonicatto et al. |
| 7,752,853 | B2 | 7/2010 | Singh et al. |
| 7,752,854 | B2 | 7/2010 | Singh et al. |
| 7,756,086 | B2 | 7/2010 | Petite et al. |
| 7,791,468 | B2 | 9/2010 | Bonicatto et al. |
| 7,844,366 | B2 | 11/2010 | Singh |
| 7,845,179 | B2 | 12/2010 | Singh et al. |
| 7,848,827 | B2 | 12/2010 | Chen |
| 7,878,006 | B2 | 2/2011 | Pham |
| 7,885,959 | B2 | 2/2011 | Horowitz et al. |
| 7,885,961 | B2 | 2/2011 | Horowitz et al. |
| 7,905,098 | B2 | 3/2011 | Pham |
| 7,949,494 | B2 | 5/2011 | Moskowitz et al. |
| 7,949,615 | B2 | 5/2011 | Ehlers et al. |
| 7,978,059 | B2 | 7/2011 | Petite et al. |
| 7,987,679 | B2 | 8/2011 | Tanaka et al. |
| 8,000,314 | B2 | 8/2011 | Brownrigg et al. |
| 8,013,732 | B2 | 9/2011 | Petite et al. |
| 8,018,182 | B2 | 9/2011 | Roehm et al. |
| 8,031,455 | B2 | 10/2011 | Paik et al. |
| 8,031,650 | B2 | 10/2011 | Petite et al. |
| 8,034,170 | B2 | 10/2011 | Kates |
| 8,041,539 | B2 | 10/2011 | Guralnik et al. |
| 8,046,107 | B2 | 10/2011 | Zugibe et al. |
| 8,064,412 | B2 | 11/2011 | Petite |
| 8,065,886 | B2 | 11/2011 | Singh et al. |
| 8,150,720 | B2 | 4/2012 | Singh et al. |
| 8,156,208 | B2 | 4/2012 | Bornhoevd et al. |
| 8,171,136 | B2 | 5/2012 | Petite |
| 8,214,175 | B2 | 7/2012 | Moskowitz et al. |
| 8,228,648 | B2 | 7/2012 | Jayanth et al. |
| 8,279,565 | B2 | 10/2012 | Hall et al. |
| 8,328,524 | B2 | 12/2012 | Iimura et al. |
| 8,380,556 | B2 | 2/2013 | Singh et al. |
| 8,393,169 | B2 | 3/2013 | Pham |
| 8,625,244 | B2 | 1/2014 | Paik et al. |
| 9,168,315 | B1 | 10/2015 | Scaringe et al. |
| 9,310,439 | B2 | 4/2016 | Pham et al. |
| 2001/0005320 | A1 | 6/2001 | Ueda et al. |
| 2001/0025349 | A1 | 9/2001 | Sharood et al. |
| 2001/0054291 | A1 | 12/2001 | Roh et al. |
| 2001/0054293 | A1 | 12/2001 | Gustafson et al. |
| 2001/0054294 | A1 | 12/2001 | Tsuboi |
| 2002/0000092 | A1 | 1/2002 | Sharood et al. |
| 2002/0013679 | A1 | 1/2002 | Petite |
| 2002/0016639 | A1 | 2/2002 | Smith et al. |
| 2002/0017057 | A1 | 2/2002 | Weder |
| 2002/0018724 | A1 | 2/2002 | Millet et al. |
| 2002/0020175 | A1 | 2/2002 | Street et al. |
| 2002/0029575 | A1 | 3/2002 | Okamoto |
| 2002/0031101 | A1 | 3/2002 | Petite et al. |
| 2002/0035495 | A1 | 3/2002 | Spira et al. |
| 2002/0040280 | A1 | 4/2002 | Morgan |
| 2002/0059803 | A1 | 5/2002 | Jayanth |
| 2002/0064463 | A1 | 5/2002 | Park et al. |
| 2002/0067999 | A1 | 6/2002 | Suitou et al. |
| 2002/0082747 | A1 | 6/2002 | Kramer |
| 2002/0082924 | A1 | 6/2002 | Koether |
| 2002/0093259 | A1 | 7/2002 | Sunaga et al. |
| 2002/0095269 | A1 | 7/2002 | Natalini et al. |
| 2002/0103655 | A1 | 8/2002 | Boies et al. |
| 2002/0113877 | A1 | 8/2002 | Welch |
| 2002/0117992 | A1 | 8/2002 | Hirono et al. |
| 2002/0118106 | A1 | 8/2002 | Brenn |
| 2002/0127120 | A1 | 9/2002 | Hahn et al. |
| 2002/0138217 | A1* | 9/2002 | Shen ..... G01H 1/003 702/56 |
| 2002/0139128 | A1 | 10/2002 | Suzuki et al. |
| 2002/0143482 | A1 | 10/2002 | Karanam et al. |
| 2002/0152298 | A1 | 10/2002 | Kikta et al. |
| 2002/0157408 | A1 | 10/2002 | Egawa et al. |
| 2002/0157409 | A1 | 10/2002 | Pham et al. |
| 2002/0159890 | A1 | 10/2002 | Kajiwara et al. |
| 2002/0161545 | A1 | 10/2002 | Starling et al. |
| 2002/0163436 | A1 | 11/2002 | Singh et al. |
| 2002/0170299 | A1 | 11/2002 | Jayanth et al. |
| 2002/0173929 | A1 | 11/2002 | Seigel |
| 2002/0187057 | A1 | 12/2002 | Loprete et al. |
| 2002/0189267 | A1 | 12/2002 | Singh et al. |
| 2002/0193890 | A1 | 12/2002 | Pouchak |
| 2002/0198629 | A1 | 12/2002 | Ellis |
| 2003/0004660 | A1 | 1/2003 | Hunter |
| 2003/0004765 | A1 | 1/2003 | Wiegand |
| 2003/0005710 | A1 | 1/2003 | Singh et al. |
| 2003/0006884 | A1 | 1/2003 | Hunt |
| 2003/0014218 | A1 | 1/2003 | Trigiani et al. |
| 2003/0019221 | A1 | 1/2003 | Rossi et al. |
| 2003/0036810 | A1 | 2/2003 | Petite |
| 2003/0037555 | A1 | 2/2003 | Street et al. |
| 2003/0050737 | A1 | 3/2003 | Osann |
| 2003/0050824 | A1 | 3/2003 | Suermondt et al. |

(56) References Cited

U.S. PATENT DOCUMENTS

2003/0051490 A1 3/2003 Jayanth
2003/0055603 A1 3/2003 Rossi et al.
2003/0055663 A1* 3/2003 Struble ..... G06Q 30/0211 705/14.13
2003/0061825 A1 4/2003 Sullivan
2003/0063983 A1 4/2003 Ancel et al.
2003/0070438 A1 4/2003 Kikuchi et al.
2003/0070544 A1 4/2003 Mulvaney et al.
2003/0074285 A1 4/2003 Hoffman et al.
2003/0077179 A1 4/2003 Collins et al.
2003/0078677 A1 4/2003 Hull et al.
2003/0078742 A1 4/2003 VanderZee et al.
2003/0089493 A1 5/2003 Takano et al.
2003/0094004 A1 5/2003 Pham et al.
2003/0108430 A1 6/2003 Yoshida et al.
2003/0115890 A1 6/2003 Jayanth et al.
2003/0135786 A1 7/2003 Vollmar et al.
2003/0137396 A1 7/2003 Durej et al.
2003/0150924 A1 8/2003 Peter
2003/0150926 A1 8/2003 Rosen
2003/0150927 A1 8/2003 Rosen
2003/0171851 A1 9/2003 Brickfield et al.
2003/0183085 A1 10/2003 Alexander
2003/0191606 A1 10/2003 Fujiyama et al.
2003/0199247 A1 10/2003 Striemer
2003/0205143 A1 11/2003 Cheng
2003/0213851 A1 11/2003 Burd et al.
2003/0216837 A1 11/2003 Reich et al.
2003/0216888 A1 11/2003 Ridolfo
2003/0233172 A1 12/2003 Granqvist et al.
2004/0016241 A1 1/2004 Street et al.
2004/0016244 A1 1/2004 Street et al.
2004/0016251 A1 1/2004 Street et al.
2004/0016253 A1 1/2004 Street et al.
2004/0019584 A1 1/2004 Greening et al.
2004/0024495 A1 2/2004 Sunderland
2004/0026522 A1 2/2004 Keen et al.
2004/0037706 A1 2/2004 Hahn et al.
2004/0042904 A1 3/2004 Kim
2004/0047406 A1 3/2004 Hunt
2004/0049715 A1 3/2004 Jaw
2004/0059691 A1 3/2004 Higgins
2004/0068390 A1 4/2004 Saunders
2004/0078695 A1 4/2004 Bowers et al.
2004/0079093 A1 4/2004 Gauthier et al.
2004/0093879 A1 5/2004 Street et al.
2004/0095237 A1 5/2004 Chen et al.
2004/0111186 A1 6/2004 Rossi et al.
2004/0117166 A1 6/2004 Cassiolato
2004/0133314 A1 7/2004 Ehlers et al.
2004/0133367 A1 7/2004 Hart
2004/0140772 A1 7/2004 Gullo et al.
2004/0140812 A1 7/2004 Scallante et al.
2004/0144106 A1 7/2004 Douglas et al.
2004/0153437 A1 8/2004 Buchan
2004/0159113 A1 8/2004 Singh et al.
2004/0159114 A1 8/2004 Demuth et al.
2004/0183687 A1 9/2004 Petite et al.
2004/0184627 A1 9/2004 Kost et al.
2004/0184928 A1 9/2004 Millet et al.
2004/0184929 A1 9/2004 Millet et al.
2004/0184930 A1 9/2004 Millet et al.
2004/0184931 A1 9/2004 Millet et al.
2004/0187502 A1 9/2004 Jayanth et al.
2004/0191073 A1 9/2004 Iimura et al.
2004/0199480 A1 10/2004 Unsworth et al.
2004/0210419 A1 10/2004 Wiebe et al.
2004/0213384 A1 10/2004 Alles et al.
2004/0230582 A1 11/2004 Pagnano et al.
2004/0230899 A1 11/2004 Pagnano et al.
2004/0239266 A1 12/2004 Lee et al.
2004/0258542 A1 12/2004 Wiertz et al.
2004/0261431 A1 12/2004 Singh et al.
2005/0040249 A1 2/2005 Wacker et al.
2005/0043923 A1 2/2005 Forster et al.
2005/0053471 A1 3/2005 Hong et al.
2005/0056031 A1 3/2005 Jeong
2005/0066675 A1* 3/2005 Manole ..... F25B 9/008 62/228.3
2005/0073532 A1 4/2005 Scott et al.
2005/0086341 A1 4/2005 Enga et al.
2005/0100449 A1 5/2005 Hahn et al.
2005/0103036 A1 5/2005 Maekawa
2005/0125439 A1 6/2005 Nourbakhsh et al.
2005/0126190 A1 6/2005 Lifson et al.
2005/0131624 A1 6/2005 Gaessler et al.
2005/0149570 A1 7/2005 Sasaki et al.
2005/0154495 A1 7/2005 Shah
2005/0159924 A1 7/2005 Shah et al.
2005/0166610 A1 8/2005 Jayanth
2005/0169636 A1 8/2005 Aronson et al.
2005/0172647 A1 8/2005 Thybo et al.
2005/0195775 A1 9/2005 Petite et al.
2005/0196285 A1 9/2005 Jayanth
2005/0198063 A1 9/2005 Thomas et al.
2005/0201397 A1 9/2005 Petite
2005/0204756 A1 9/2005 Dobmeier et al.
2005/0207741 A1 9/2005 Shah et al.
2005/0214148 A1 9/2005 Ogawa et al.
2005/0222715 A1 10/2005 Ruhnke et al.
2005/0228607 A1 10/2005 Simons
2005/0229612 A1 10/2005 Hrejsa et al.
2005/0229777 A1 10/2005 Brown et al.
2005/0232781 A1 10/2005 Herbert et al.
2005/0235660 A1 10/2005 Pham
2005/0235661 A1 10/2005 Pham
2005/0235662 A1 10/2005 Pham
2005/0235663 A1 10/2005 Pham
2005/0235664 A1 10/2005 Pham
2005/0247194 A1 11/2005 Kang et al.
2005/0251293 A1 11/2005 Seigel
2005/0252220 A1 11/2005 Street et al.
2005/0262856 A1 12/2005 Street et al.
2005/0262923 A1 12/2005 Kates
2006/0010898 A1 1/2006 Suharno et al.
2006/0015777 A1 1/2006 Loda
2006/0020426 A1 1/2006 Singh
2006/0021362 A1 2/2006 Sadegh et al.
2006/0032245 A1 2/2006 Kates
2006/0032246 A1 2/2006 Kates
2006/0032247 A1 2/2006 Kates
2006/0032248 A1 2/2006 Kates
2006/0032379 A1 2/2006 Kates
2006/0036349 A1 2/2006 Kates
2006/0041335 A9 2/2006 Rossi et al.
2006/0042276 A1 3/2006 Doll et al.
2006/0071089 A1 4/2006 Kates
2006/0071666 A1 4/2006 Unsworth et al.
2006/0074917 A1 4/2006 Chand et al.
2006/0097063 A1 5/2006 Zeevi
2006/0098576 A1 5/2006 Brownrigg et al.
2006/0117773 A1 6/2006 Street et al.
2006/0123807 A1 6/2006 Sullivan et al.
2006/0129339 A1 6/2006 Bruno
2006/0130500 A1 6/2006 Gauthier et al.
2006/0137364 A1 6/2006 Braun et al.
2006/0137368 A1 6/2006 Kang et al.
2006/0138866 A1 6/2006 Bergmann et al.
2006/0140209 A1 6/2006 Cassiolato et al.
2006/0151037 A1 7/2006 Lepola et al.
2006/0179854 A1 8/2006 Esslinger
2006/0182635 A1 8/2006 Jayanth
2006/0185373 A1 8/2006 Butler et al.
2006/0196196 A1 9/2006 Kates
2006/0196197 A1 9/2006 Kates
2006/0201168 A1 9/2006 Kates
2006/0222507 A1 10/2006 Jayanth
2006/0229739 A1 10/2006 Morikawa
2006/0235650 A1 10/2006 Vinberg et al.
2006/0238388 A1 10/2006 Jayanth
2006/0242200 A1 10/2006 Horowitz et al.
2006/0244641 A1 11/2006 Jayanth et al.
2006/0256488 A1 11/2006 Benzing et al.
2006/0259276 A1 11/2006 Rossi et al.

(56) References Cited

U.S. PATENT DOCUMENTS

| | | | |
|---|---|---|---|
| 2006/0271589 | A1 | 11/2006 | Horowitz et al. |
| 2006/0271623 | A1 | 11/2006 | Horowitz et al. |
| 2006/0280627 | A1 | 12/2006 | Jayanth |
| 2007/0002505 | A1 | 1/2007 | Watanabe et al. |
| 2007/0006124 | A1 | 1/2007 | Ahmed et al. |
| 2007/0027735 | A1 | 2/2007 | Rokos |
| 2007/0067512 | A1 | 3/2007 | Donaires et al. |
| 2007/0089434 | A1 | 4/2007 | Singh et al. |
| 2007/0089435 | A1 | 4/2007 | Singh et al. |
| 2007/0089438 | A1 | 4/2007 | Singh et al. |
| 2007/0089439 | A1 | 4/2007 | Singh et al. |
| 2007/0089440 | A1 | 4/2007 | Singh et al. |
| 2007/0101750 | A1 | 5/2007 | Pham et al. |
| 2007/0159978 | A1 | 7/2007 | Anglin et al. |
| 2007/0186569 | A1 | 8/2007 | Street et al. |
| 2007/0204635 | A1 | 9/2007 | Tanaka et al. |
| 2007/0204921 | A1 | 9/2007 | Alles |
| 2007/0205296 | A1 | 9/2007 | Bell et al. |
| 2007/0229305 | A1 | 10/2007 | Bonicatto et al. |
| 2007/0239894 | A1 | 10/2007 | Thind et al. |
| 2008/0000241 | A1 | 1/2008 | Larsen et al. |
| 2008/0015797 | A1 | 1/2008 | Kates |
| 2008/0016888 | A1 | 1/2008 | Kates |
| 2008/0051945 | A1 | 2/2008 | Kates |
| 2008/0078289 | A1 | 4/2008 | Sergi et al. |
| 2008/0109185 | A1 | 5/2008 | Cheung et al. |
| 2008/0114569 | A1 | 5/2008 | Seigel |
| 2008/0183424 | A1 | 7/2008 | Seem |
| 2008/0186898 | A1 | 8/2008 | Petite |
| 2008/0209925 | A1 | 9/2008 | Pham |
| 2008/0216494 | A1 | 9/2008 | Pham et al. |
| 2008/0216495 | A1 | 9/2008 | Kates |
| 2008/0223051 | A1 | 9/2008 | Kates |
| 2008/0315000 | A1 | 12/2008 | Gorthala et al. |
| 2008/0319688 | A1 | 12/2008 | Kim |
| 2009/0007777 | A1 | 1/2009 | Cohen et al. |
| 2009/0068947 | A1 | 3/2009 | Petite |
| 2009/0071175 | A1 | 3/2009 | Pham |
| 2009/0093916 | A1 | 4/2009 | Parsonnet et al. |
| 2009/0094998 | A1 | 4/2009 | McSweeney et al. |
| 2009/0096605 | A1 | 4/2009 | Petite et al. |
| 2009/0112672 | A1 | 4/2009 | Flamig et al. |
| 2009/0119036 | A1 | 5/2009 | Jayanth et al. |
| 2009/0125257 | A1 | 5/2009 | Jayanth et al. |
| 2009/0140880 | A1 | 6/2009 | Flen et al. |
| 2009/0151374 | A1 | 6/2009 | Kasahara |
| 2009/0187281 | A1 | 7/2009 | Kates |
| 2009/0215424 | A1 | 8/2009 | Petite |
| 2009/0241570 | A1 | 10/2009 | Kuribayashi et al. |
| 2009/0296832 | A1 | 12/2009 | Hunt |
| 2010/0011962 | A1 | 1/2010 | Totsugi |
| 2010/0017465 | A1 | 1/2010 | Brownrigg et al. |
| 2010/0039984 | A1 | 2/2010 | Brownrigg |
| 2010/0089076 | A1 | 4/2010 | Schuster et al. |
| 2010/0111709 | A1 | 5/2010 | Jayanth |
| 2010/0168924 | A1 | 7/2010 | Tessier et al. |
| 2010/0179703 | A1 | 7/2010 | Singh et al. |
| 2010/0191487 | A1 | 7/2010 | Rada et al. |
| 2010/0194582 | A1 | 8/2010 | Petite |
| 2010/0214709 | A1 | 8/2010 | Hall et al. |
| 2010/0217550 | A1 | 8/2010 | Crabtree et al. |
| 2010/0250054 | A1 | 9/2010 | Petite |
| 2010/0265909 | A1 | 10/2010 | Petite et al. |
| 2010/0312881 | A1 | 12/2010 | Davis et al. |
| 2011/0004350 | A1 | 1/2011 | Cheifetz et al. |
| 2011/0054842 | A1 | 3/2011 | Kates |
| 2011/0071960 | A1 | 3/2011 | Singh |
| 2011/0112814 | A1 | 5/2011 | Clark |
| 2011/0121952 | A1 | 5/2011 | Bonicatto et al. |
| 2011/0144944 | A1 | 6/2011 | Pham |
| 2011/0212700 | A1 | 9/2011 | Petite |
| 2011/0264324 | A1 | 10/2011 | Petite et al. |
| 2011/0309953 | A1 | 12/2011 | Petite et al. |
| 2011/0310929 | A1 | 12/2011 | Petite et al. |
| 2011/0320050 | A1 | 12/2011 | Petite et al. |
| 2012/0054242 | A1 | 3/2012 | Ferrara et al. |
| 2012/0075092 | A1 | 3/2012 | Petite et al. |
| 2012/0092154 | A1 | 4/2012 | Petite |
| 2012/0179300 | A1 | 7/2012 | Warren et al. |
| 2012/0260804 | A1 | 10/2012 | Kates |
| 2012/0265586 | A1 | 10/2012 | Mammone |
| 2012/0271673 | A1 | 10/2012 | Riley |
| 2013/0066479 | A1 | 3/2013 | Shetty et al. |
| 2013/0156607 | A1 | 6/2013 | Jayanth |
| 2013/0166231 | A1 | 6/2013 | Jayanth et al. |
| 2013/0174588 | A1 | 7/2013 | Pham |
| 2013/0176649 | A1 | 7/2013 | Wallis et al. |
| 2013/0182285 | A1 | 7/2013 | Matsuhara et al. |
| 2013/0287063 | A1 | 10/2013 | Kates |
| 2013/0294933 | A1 | 11/2013 | Pham |
| 2014/0000290 | A1 | 1/2014 | Kates |
| 2014/0000291 | A1 | 1/2014 | Kates |
| 2014/0000292 | A1 | 1/2014 | Kates |
| 2014/0000293 | A1 | 1/2014 | Kates |
| 2014/0000294 | A1 | 1/2014 | Kates |
| 2014/0012422 | A1 | 1/2014 | Kates |
| 2014/0074730 | A1 | 3/2014 | Arensmeier et al. |
| 2014/0084836 | A1 | 3/2014 | Pham et al. |
| 2014/0229014 | A1 | 8/2014 | Pham et al. |
| 2014/0260342 | A1 | 9/2014 | Pham |
| 2014/0260390 | A1 | 9/2014 | Pham |
| 2014/0262134 | A1 | 9/2014 | Arensmeier et al. |
| 2014/0266755 | A1 | 9/2014 | Arensmeier et al. |
| 2014/0297208 | A1 | 10/2014 | Arensmeier |
| 2014/0299289 | A1 | 10/2014 | Alsaleem et al. |
| 2015/0135748 | A1 | 5/2015 | Alsaleem et al. |
| 2015/0155701 | A1 | 6/2015 | Wallis et al. |
| 2015/0261230 | A1 | 9/2015 | Kates |
| 2015/0367463 | A1 | 12/2015 | Pham |
| 2016/0076536 | A1 | 3/2016 | Jayanth et al. |
| 2016/0223238 | A1 | 8/2016 | Kates |
| 2016/0226416 | A1 | 8/2016 | Pham et al. |

FOREIGN PATENT DOCUMENTS

| | | | |
|---|---|---|---|
| CH | 173493 | A | 11/1934 |
| CN | 1133425 | A | 10/1996 |
| CN | 1169619 | A | 1/1998 |
| CN | 1297522 | A | 5/2001 |
| CN | 1356472 | A | 7/2002 |
| CN | 1742427 | A | 3/2006 |
| CN | 1922445 | A | 2/2007 |
| CN | 101048713 | A | 10/2007 |
| CN | 101156033 | A | 4/2008 |
| CN | 101270908 | A | 9/2008 |
| CN | 101361244 | A | 2/2009 |
| CN | 101466193 | A | 6/2009 |
| CN | 101506600 | A | 8/2009 |
| CN | 101802521 | A | 8/2010 |
| CN | 101821693 | A | 9/2010 |
| DE | 842351 | C | 6/1952 |
| DE | 764179 | C | 4/1953 |
| DE | 1144461 | B | 2/1963 |
| DE | 1403516 | A1 | 10/1968 |
| DE | 1403467 | A1 | 10/1969 |
| DE | 3118638 | A1 | 5/1982 |
| DE | 3133502 | A1 | 6/1982 |
| DE | 3508353 | A1 | 9/1985 |
| DE | 3422398 | A1 | 12/1985 |
| DE | 29723145 | U1 | 4/1998 |
| EP | 008524 | A1 | 3/1980 |
| EP | 0060172 | A1 | 9/1982 |
| EP | 0085246 | A1 | 8/1983 |
| EP | 0124603 | A1 | 11/1984 |
| EP | 0254253 | A2 | 1/1988 |
| EP | 0346152 | A2 | 12/1989 |
| EP | 0351272 | A1 | 1/1990 |
| EP | 0351833 | A2 | 1/1990 |
| EP | 0355255 | A2 | 2/1990 |
| EP | 0361394 | A2 | 4/1990 |
| EP | 0398436 | A1 | 11/1990 |
| EP | 0410330 | A2 | 1/1991 |
| EP | 0419857 | A2 | 4/1991 |
| EP | 0432085 | A2 | 6/1991 |

(56) References Cited

FOREIGN PATENT DOCUMENTS

| | | | |
|---|---|---|---|
| EP | 0453302 | A1 | 10/1991 |
| EP | 0479421 | A1 | 4/1992 |
| EP | 0557023 | A1 | 8/1993 |
| EP | 0579374 | A1 | 1/1994 |
| EP | 0660213 | A2 | 6/1995 |
| EP | 0747598 | A2 | 12/1996 |
| EP | 0877462 | A2 | 11/1998 |
| EP | 0982497 | A1 | 3/2000 |
| EP | 1008816 | A2 | 6/2000 |
| EP | 1087142 | A2 | 3/2001 |
| EP | 1087184 | A2 | 3/2001 |
| EP | 1138949 | A2 | 10/2001 |
| EP | 1139037 | A1 | 10/2001 |
| EP | 1187021 | A2 | 3/2002 |
| EP | 1209427 | A1 | 5/2002 |
| EP | 1241417 | A1 | 9/2002 |
| EP | 1245912 | A2 | 10/2002 |
| EP | 1245913 | A1 | 10/2002 |
| EP | 1393034 | A1 | 3/2004 |
| EP | 1435002 | A1 | 7/2004 |
| EP | 1487077 | A2 | 12/2004 |
| EP | 1541869 | A1 | 6/2005 |
| EP | 2180270 | A1 | 4/2010 |
| FR | 2472862 | A1 | 7/1981 |
| FR | 2582430 | A1 | 11/1986 |
| FR | 2589561 | A1 | 5/1987 |
| FR | 2628558 | A1 | 9/1989 |
| FR | 2660739 | A1 | 10/1991 |
| GB | 2062919 | A | 5/1981 |
| GB | 2064818 | A | 6/1981 |
| GB | 2075774 | A | 11/1981 |
| GB | 2116635 | A | 9/1983 |
| GB | 2229295 | A | 9/1990 |
| GB | 2347217 | A | 8/2000 |
| JP | 56010639 | A | 2/1981 |
| JP | 59145392 | A | 8/1984 |
| JP | 61046485 | A | 3/1986 |
| JP | 62116844 | A | 5/1987 |
| JP | 63061783 | A | 3/1988 |
| JP | 63302238 | A | 12/1988 |
| JP | 01014554 | A | 1/1989 |
| JP | 02110242 | A | 4/1990 |
| JP | 02294580 | A | 12/1990 |
| JP | 04080578 | A | 3/1992 |
| JP | 06058273 | A | 3/1994 |
| JP | 08021675 | A | 1/1996 |
| JP | 08087229 | A | 4/1996 |
| JP | 08284842 | A | 10/1996 |
| JP | H08261541 | A | 10/1996 |
| JP | 2000350490 | A | 12/2000 |
| JP | 2002155868 | A | 5/2002 |
| JP | 2003018883 | A | 1/2003 |
| JP | 2003176788 | A | 6/2003 |
| JP | 2004316504 | A | 11/2004 |
| JP | 2005188790 | A | 7/2005 |
| JP | 2005241089 | A | 9/2005 |
| JP | 2005345096 | A | 12/2005 |
| JP | 2006046219 | A | 2/2006 |
| JP | 2006046519 | A | 2/2006 |
| JP | 2006274807 | A | 10/2006 |
| JP | 2009002651 | A | 1/2009 |
| JP | 2009229184 | A | 10/2009 |
| KR | 10-1998-0036844 | A | 8/1998 |
| KR | 1020000000261 | | 1/2000 |
| KR | 1020000025265 | | 5/2000 |
| KR | 1020020041977 | | 6/2002 |
| KR | 20030042857 | A | 6/2003 |
| KR | 20040021281 | A | 3/2004 |
| KR | 1020040021281 | | 3/2004 |
| KR | 1020060020353 | | 3/2006 |
| RU | 30009 | U1 | 6/2003 |
| RU | 55218 | U1 | 7/2006 |
| WO | 8601262 | A1 | 2/1986 |
| WO | 8703988 | A1 | 7/1987 |
| WO | 8705097 | A1 | 8/1987 |
| WO | 8802527 | A1 | 4/1988 |
| WO | 8806703 | A1 | 9/1988 |
| WO | 9718636 | A2 | 5/1997 |
| WO | 9748161 | A1 | 12/1997 |
| WO | 9917066 | A1 | 4/1999 |
| WO | 9961847 | A1 | 12/1999 |
| WO | 9965681 | A1 | 12/1999 |
| WO | 0021047 | A1 | 4/2000 |
| WO | 0051223 | A1 | 8/2000 |
| WO | 0169147 | A1 | 9/2001 |
| WO | 0214968 | A1 | 2/2002 |
| WO | 0249178 | A2 | 6/2002 |
| WO | 02075227 | A1 | 9/2002 |
| WO | 02/090840 | A2 | 11/2002 |
| WO | 02/090913 | A1 | 11/2002 |
| WO | 02090914 | A1 | 11/2002 |
| WO | 03031996 | A1 | 4/2003 |
| WO | 03090000 | A1 | 10/2003 |
| WO | 2004049088 | A1 | 6/2004 |
| WO | 2005022049 | A2 | 3/2005 |
| WO | 2005065355 | A2 | 7/2005 |
| WO | 2005073686 | A1 | 8/2005 |
| WO | 2005108882 | A2 | 11/2005 |
| WO | 2006023075 | A2 | 3/2006 |
| WO | 2006025880 | A1 | 3/2006 |
| WO | 2006091521 | A2 | 8/2006 |
| WO | WO-2008010988 | A1 | 1/2008 |
| WO | WO-2008079108 | A1 | 7/2008 |
| WO | 2009058356 | A1 | 5/2009 |
| WO | 2009061370 | A1 | 5/2009 |
| WO | 2012118550 | A1 | 9/2012 |

OTHER PUBLICATIONS

Restriction Requirement regarding U.S. Appl. No. 14/244,967, dated Jul. 14, 2015.

Interview Summary regarding U.S. Appl. No. 13/369,067, dated Jul. 16, 2015.

Applicant-Initiated Interview Summary and Advisory Action regarding U.S. Appl. No. 13/369,067, dated Jul. 23, 2015.

Faramarzi et al., "Performance Evaluation of Rooftop Air Conditioning Units at High Ambient Temperatures," 2004 ACEEE Summer Study on Energy Efficiency in Buildings—http://aceee.org/files/proceedings/2004/data/papers/SSO4_Panel3_Paper05.pdf, dated 2004.

Notice of Allowance regarding U.S. Appl. No. 12/261,643, dated Jul. 29, 2015.

Official Action regarding Australian Patent Application No. 2008325240, dated Jan. 19, 2011.

Second Office Action regarding Chinese Patent Application No. 200890100287.3, dated Jan. 27, 2011. English translation provided by Unitalen Attorneys at Law.

First Office Action regarding Chinese Patent Application No. 200780032977.X, dated Sep. 27, 2010. English translation provided by Unitalen Attorneys at Law.

First Office Action regarding Chinese Patent Application No. 201010117657.8, dated Dec. 29, 2010. English translation provided by Unitalen Attorneys at Law.

International Search Report for International Application No. PCT/US2008/009618, dated Dec. 8, 2008.

Written Opinion of International Searching Authority for International Application No. PCT/US2008/009618, dated Dec. 8, 2008.

International Preliminary Report on Patentability for International Application No. PCT/US2008/009618, dated Apr. 1, 2010.

First Office Action issued by the Chinese Patent Office for Application No. 200480015875.3, dated Sep. 5, 2008.

Second Office Action issued by the Chinese Patent Office for Application No. 200480015875.3, dated Feb. 27, 2009.

BChydro, "Power Factor" Guides to Energy Management: The GEM Series, Dec. 2000.

European Search Report for Application No. EP 06 02 6263, dated Jul. 17, 2007.

European Search Report for Application No. EP 04 81 5853, dated Jul. 17, 2007.

(56) References Cited

OTHER PUBLICATIONS

European Search Report for Application No. EP 02 25 1531, dated Sep. 30, 2002.
International Search Report for International Application No. PCT/US04/43859, dated Mar. 2, 2006.
European Search Report for Application No. EP 01 30 1752, dated Mar. 26, 2002.
Final Office Action dated Dec. 7, 2010 for U.S. Appl. No. 12/054,011.
Non-Final Office Action dated Mar. 3, 2011 for U.S. Appl. No. 12/054,011.
Non-Final Office Action dated Aug. 13, 2010 for U.S. Appl. No. 12/054,011.
Final Office Action for U.S. Appl. No. 12/054,011, dated Jun. 30, 2011.
First Office Action regarding Chinese Application No. 200880106319.5, dated May 25, 2011. English translation provided by Unitalen Attorneys at Law.
Non-Final Office Action for U.S. Appl. No. 12/054,011, dated Oct. 20, 2011.
Non-Final Office Action for U.S. Appl. No. 11/776,879, dated Mar. 16, 2012.
Final Office Action regarding U.S. Appl. No. 12/261,643, dated Jul. 7, 2011.
Office Action regarding U.S. Appl. No. 12/261,643, dated Nov. 2, 2011.
Office Action regarding U.S. Appl. No. 12/261,677, dated Aug. 4, 2011.
Notice of Allowance regarding U.S. Appl. No. 12/261,677, dated Dec. 15, 2011.
Office Action regarding U.S. Appl. No. 12/261,643, dated Feb. 15, 2012.
Examiner's Report No. 2 regarding Australian Patent Application No. 2008325240, dated Mar. 5, 2012.
Non-Final Office Action regarding U.S. Appl. No. 13/176,021, dated May 8, 2012.
Final Office Action regarding U.S. Appl. No. 12/261,643, dated Jun. 27, 2012.
Non-Final office Action regarding U.S. Appl. No. 11/850,846, dated Apr. 24, 2012.
Non-Final Office Action for U.S. Appl. No. 12/054,011, dated Apr. 10, 2012.
Notice of Allowance regarding U.S. Appl. No. 11/776,879, dated Jul. 9, 2012.
European Search Report regarding Application No. 04022784.5-2315 / 1500821, dated Aug. 14, 2012.
Patent Examiantion Report No. 3 regarding Australian Patent Application No. 2008325240, dated Jul. 19, 2012.
Third Office Action regarding Chinese Application No. 2005100059078 from the State Intellectual Property Office of People's Republic of China, dated Aug. 24, 2011. Translation provided by Unitalen Attorneys at Law.
Fourth Office Action from the State Intellectual Property Office of People's Republic of China regarding Chinese Patent Applicaiton No. 200510005907.8, dated Dec. 8, 2011. Translation provided by Unitalen Attorneys at Law.
Final Office Action for U.S. Appl. No. 11/850,846, dated Aug. 13, 2012.
Examiner's First Report on Australian Patent Application No. 2007292917 dated Jan. 10, 2012.
Examiner's First Report on Australian Patent Application No. 2008319275, dated Jan. 31, 2011.
Non-Final Office Action for U.S. Appl. No. 13/030,549, dated Nov. 5, 2012.
Notification of First Office Action from the State Intellectual Property Office of People's Republic of China regarding Chinese Patent Application No. 200880122964.6, dated Nov. 5, 2012. Translation provided by Unitalen Attorneys at Law.
Notice of Panel Decision from Pre-Appeal Brief Review regarding U.S. Appl. No. 09/977,552, dated Aug. 4, 2009.
Final Office Action regarding U.S. Appl. No. 09/977,552, dated Oct. 22, 2008.
Office Action regarding U.S. Appl. No. 09/977,552, dated Jan. 11, 2008.
Final Office Action regarding U.S. Appl. No. 09/977,552, dated Jul. 23, 2007.
Office Action Communication regarding U.S. Appl. No. 09/977,552, dated Apr. 18, 2007.
Election/Restriction Requirement regarding U.S. Appl. No. 09/977,552, dated Jan. 25, 2007.
Office Action regarding U.S. Appl. No. 09/977,552, dated Jul. 12, 2006.
Advisory Action Before the Filing of an Appeal Brief regarding U.S. Appl. No. 09/977,552, dated Nov. 10, 2005.
U.S. Appl. No. 11/776,879, filed Jul. 12, 2007.
U.S. Appl. No. 13/770,479, filed Feb. 19, 2013.
U.S. Appl. No. 13/932,611, filed Jul. 1, 2013.
U.S. Appl. No. 12/261,643, filed Oct. 30, 2008.
U.S. Appl. No. 13/770,123, filed Feb. 19, 2013.
U.S. Appl. No. 11/850,846, filed Sep. 6, 2007.
U.S. Appl. No. 13/737,566, filed Jan. 9, 2013.
Office Action regarding U.S. Appl. No. 11/120,166, dated Jun. 5, 2008.
Office Action regarding U.S. Appl. No. 11/120,166, dated Jul. 20, 2009.
Office Action regarding U.S. Appl. No. 11/394,380, dated Sep. 25, 2009.
Office Action regarding U.S. Appl. No. 11/497,644, dated Jan. 29, 2010.
Office Action regarding U.S. Appl. No. 11/497,644, dated Jun. 14, 2010.
Office Action regarding U.S. Appl. No. 10/061,964, dated Oct. 3, 2003.
Office Action regarding U.S. Appl. No. 10/675,137, dated Feb. 4, 2005.
Office Action regarding U.S. Appl. No. 10/675,137, dated Jun. 29, 2005.
Office Action regarding U.S. Appl. No. 10/675,137, dated Sep. 7, 2004.
Office Action regarding U.S. Appl. No. 10/698,048, dated Mar. 21, 2005.
Office Action regarding U.S. Appl. No. 10/940,877, dated Oct. 27, 2006.
Office Action regarding U.S. Appl. No. 10/940,877, dated Nov. 14, 2005.
Office Action regarding U.S. Appl. No. 10/940,877, dated Dec. 8, 2008.
Office Action regarding U.S. Appl. No. 10/940,877, dated May 21, 2007.
Office Action regarding U.S. Appl. No. 10/940,877, dated Jun. 5, 2008.
Office Action regarding U.S. Appl. No. 11/256,641, dated Apr. 29, 2008.
Office Action regarding U.S. Appl. No. 11/337,918, dated Mar. 25, 2008.
Office Action regarding U.S. Appl. No. 11/337,918, dated Aug. 17, 2009.
Office Action regarding U.S. Appl. No. 11/337/918, dated Oct. 28, 2008.
Office Action regarding U.S. Appl. No. 13/303,286, dated Mar. 26, 2012.
Palani, M. et al, Monitoring the Performance of a Residential Central Air Conditioner under Degraded Conditions on a Test Bench, ESL-TR-92/05-05, May 1992.
Palani, M. et al, The Effect of Reducted Evaporator Air Flow on the Performance of a Residential Central Air Conditioner, ESL-HH-92-05-04, Energy Systems Laboratory, Mechanical Engineering Department, Texas A&M University, Eighth Symposium on Improving Building System in Hot and Humid Climates, May 13-14, 1992.
Pin, C. et al., "Predictive Models as Means to Quantify the Interactions of Spoilage Organisms," International Journal of Food Microbiology, vol. 41, No. 1, 1998, pp. 59-72, XP-002285119.

(56) References Cited

OTHER PUBLICATIONS

Reh, F. John, "Cost Benefit Analysis", http://management.about.com/cs/money/a/CostBenefit.htm, Dec. 8, 2003.
Restriction from related U.S. Appl. No. 13/269,188 dated Apr. 9, 2013; 5 pages.
Restriction Requirement regarding U.S. Appl. No. 10/940,877, dated Jul. 25, 2005.
Restriction Requirement regarding U.S. Appl. No. 11/214,179, dated Feb. 2, 2010.
Second Examination Communication regarding European Application No. EP02729051.9, dated Jul. 3, 2006.
Second Office Action received from the Chinese Patent Office dated Jun. 26, 2009 regarding Application No. 2004800114631, translated by CCPIT Patent and Trademark Law Office.
Second Official Report regarding Australian Patent Application No. 2007214381, dated Oct. 30, 2009.
Supplementary European Search Report for EP 02 73 1544, dated Jun. 18, 2004, 2 Pages.
Supplementary European Search Report regarding Application No. EP 07 81 1712, dated Jan. 7, 2014.
Supplementary European Search Report regarding Application No. PCT/US2006/005917, dated Nov. 23, 2009.
Supplementary European Search Report regarding European Application No. EP06790063, dated Jun. 15, 2010.
Tamarkin, Tom D., "Automatic Meter Reading," Public Power magazine, vol. 50, No. 5, Sep.-Oct. 1992, http://www.energycite.com/news/amr.html, 6 pages.
Texas Instruments, Inc. Mechanical Data for "PT (S-PQFP-G48) Plastic Quad Flatpack," Revised Dec. 1996, 2 pages.
Texas Instruments, Inc., Product catalog for "TRF690 1 Single-Chip RF Transceiver," Copyright 2001-2003, Revised Oct. 2003, 27 pages.
The Honeywell HVAC Service Assistant, A Tool for Reducing Electrical Power Demand and Energy Consumption, Field Diagnostics, 2003.
The LS2000 Energy Management System, User Guide, http://www.surfnetworks.com/htmlmanuals/IonWorksEnergyManagement-LS2000-Load-Shed-System-by-Surf-Networks,Inc.html, Sep. 2004, 20 pages.
Torcellini, P., et al., "Evaluation of the Energy Performance and Design Process of the Thermal Test Facility at the National Renewable Energy Laboratory", dated Feb. 2005.
Trane EarthWise™ CenTra Vac™ Water-Cooled Liquid Chillers 165-3950 Tons 50 and 60 Hz; CTV PRC007-EN; Oct. 2002; 56 pages.
Udelhoven, Darrell, "Air Conditioner EER, SEER Ratings, BTUH Capacity Ratings, & Evaporator Heat Load," http://www.udarrell.com/air-conditioner-capacity-seer.html, Apr. 3, 2003, 15 pages.
Udelhoven, Darrell, "Air Conditioning System Sizing for Optimal Efficiency," http:/ /www.udarrell.com/ airconditioning-sizing.html, Oct. 6, 2003, 7 pages.
Udelhoven, Darrell, "Optimizing Air Conditioning Efficiency TuneUp Optimizing the Condensor Output, Seer, Air, HVAC Industry," http://www.udarrell.com/air-conditioning-efficiency.html, Jul. 19, 2002, 13 pages.
UltraSite User's Guide, Computer Process Controls, Apr. 1, 1996.
Vandenbrink et al.,"Design of a Refrigeration Cycle Evaporator Unit," Apr. 18, 2003.
Watt, James; Development of Empirical Temperature and Humidity-Based Degraded-Condition Indicators for Low-Tonnage Air Conditioners; ESL-TH-97/12-03; Dec. 1997.
Written Opinion from related PCT Application No. PCT/US2014/028074 dated Jun. 19, 2014.
Written Opinion of the International Searching Authority regarding Application No. PCT/US2010/036601, dated Dec. 29, 2010.
Written Opinion of the International Searching Authority, Int'l. App. No. PCT/US 06/05917, dated Sep. 26, 2007.
U.S. Office Action regarding U.S. Appl. No. 13/269,188, dated May 8, 2015.
U.S. Office Action regarding U.S. Appl. No. 14/212,632, dated May 15, 2015.
First Chinese Office Action regarding Application No. 201380005300.2, dated Apr. 30, 2015. Translation provided by Unitalen Attorneys at Law.
Advisory Action and Interview Summary regarding U.S. Appl. No. 13/407,180, dated May 27, 2015.
Office Action regarding U.S. Appl. No. 11/850,846, dated Aug. 13, 2010.
Second Office Action regarding Chinese Patent Appplication No. 200780030810X, dated Aug. 4, 2010. English translation provided by Unitalen Attorneys at Law.
"A Practical Example of a Building's Automatic Control," cited in First Office Action from the Patent Office of the People's Republic of China dated Jun. 29, 2007, regarding Application No. 200510005907.8, including translation by CCPIT Patent and Trademark Law Office.
"Manual for Freezing and Air Conditioning Technology," Fan Jili, Liaoning Science and Technology Press, Sep. 1995 (cited in First Office Action issued by the Chinese Patent Office regarding Application No. 200780030810.X dated Dec. 25, 2009).
"Product Performance Introduction of York Company," cited in First Office Action from the Patent Office of the People's Republic of China dated Jun. 29, 2007 regarding Application No. 200510005907.8, including translation by CCPIT Patent and Trademark Law Office.
"Small-type Freezing and Air Conditioning Operation," Chinese State Economy and Trading Committee, China Meteorological Press, Mar. 2003 (cited in First Office Action issued by the Chinese Patent Office regarding Application No. 200780030810.X dated Dec. 25, 2009).
Building Control Unit (BCU) Installation and Operation Manual, Computer Process Controls, Jan. 28, 1998.
Building Environmental Control (BEC) Installation and Operation Manual, Computer Process Controls, Jan. 5, 1998.
Einstein RX-300 Refrigeration Controller Installation and Operation Manual, Computer Process Controls, Apr. 1, 1998.
First Office Action from the Patent Office of the People's Republic of China regarding Application No. 200510005907.8, dated Jun. 29, 2007.
First Office Action issued by the Chinese Patent Office dated May 30, 2008 regarding Application No. 200580013451.8.
First Office Action issued by the Chinese Patent Office regarding Application No. 200780030810.X dated Dec. 25, 2009.
International Preliminary Report on Patentability for International Application No. PCT/US2008/012362, dated May 4, 2010.
International Preliminary Report on Patentability for International Application No. PCT/US2008/012364, dated May 4, 2010.
International Preliminary Report on Patentability regarding International Application No. PCT/US2007/019563 dated Mar. 10, 2009.
International Search Report for International Application No. PCT/US2005/11154, dated Oct. 19, 2005.
International Search Report for International Application No. PCT/US2007/016135 dated Oct. 22, 2007.
International Search Report for International Application No. PCT/US2008/012362, dated Feb. 12, 2009.
International Search Report for International Application No. PCT/US2008/012364 dated Mar. 13, 2009.
Refrigeration Monitor and Case Control Installation and Operation Manual, Computer Process Controls, Aug. 12, 1999.
Second Office action issued by the Chinese Patent Office dated Jun. 19, 2009 regarding Application No. 200510005907.8, translation provided by CCPIT Patent and Trademark Law Office.
Second Office Action issued by the Chinese Patent Office dated Mar. 6, 2009 regarding Application No. 200580013451.8.
The International Search Report regarding International Application No. PCT/US2007/019563.
Third Office Action issued by the Chinese Patent Office dated Jun. 19, 2009 regarding Application No. 200580013451.8, translated by CCPIT Patent and Trademark Law Office.
Translation of Claims and Abstract of KR Patent Laying-Open No. 2000-0000261; 4 pages. KIPI Machine Translation.

(56) References Cited

OTHER PUBLICATIONS

Ultrasite 32 User's Guide, Computer Process Controls, Sep. 28, 1999.
Ultrasite User's Guide BCU Supplement, Computer Process Controls, Sep. 4, 1997.
Ultrasite User's Guide BEC Supplement, Computer Process Controls, Oct. 6, 1997.
Ultrasite User's Guide RMCC Supplement, Computer Process Controls, Jun. 9, 1997.
Written Opinion of the International Searching Authority for International Application No. PCT/US2008/012364 dated Mar. 12, 2009.
Written Opinion of the International Searching Authority regarding International Application No. PCT/US2007/019563.
Notice of Allowance and Fees Due and Notice of Allowability regarding U.S. Appl. No. 11/098,582, dated Feb. 24, 2009.
Office Action regarding U.S. Appl. No. 11/098,582 dated Mar. 3, 2010.
Office Action regarding U.S. Appl. No. 11/098,582, dated Jul. 7, 2008.
Office Action regarding U.S. Appl. No. 11/098,582, dated Aug. 4, 2009.
Office Action regarding U.S. Appl. No. 11/098,582, dated Sep. 21, 2007.
Office Action regarding U.S. Appl. No. 11/098,575, dated Mar. 26, 2008.
Office Action regarding U.S. Appl. No. 11/098,575, dated Sep. 9, 2008.
Office Action regarding U.S. Appl. No. 11/098,575, dated Jan. 29, 2009.
Office Action regarding U.S. Appl. No. 11/098,575, dated Jul. 13, 2009.
Advisory Action Before the Filing of an Appeal Brief regarding U.S. Appl. No. 11/098,575, dated Sep. 28, 2009.
Advisory Action Before the Filing of an Appeal Brief regarding U.S. Appl. No. 11/098,575, dated Nov. 16, 2009.
Advisory Action Before the Filing of an Appeal Brief regarding U.S. Appl. No. 11/098,575, dated Jan. 27, 2010.
Non-Final Office Action for U.S. Appl. No. 11/098,575 dated Jan. 27, 2010.
Final Office Action regarding U.S. Appl. No. 11/098,575, dated Jun. 17, 2010.
Interview Summary regarding U.S. Appl. No. 11/098,582, dated Apr. 27, 2010.
Notice of Allowance and Fees Due and Notice of Allowability regarding U.S. Appl. No. 11/098,582, dated Sep. 24, 2010.
Office Action regarding U.S. Appl. No. 11/776,879, dated Sep. 17, 2010.
First Office Action from the State Intellectual Property Office of the People's Republic of China regarding Chinese Patent Application No. 200890100287.3, dated Oct. 25, 2010. Translation provided by Unitalen Attorneys at Law.
Non-Final Office Action regarding U.S. Appl. No. 12/261,643, dated Jan. 27, 2011.
Final Office Action regarding U.S. Appl. No. 09/977,552, dated May 13, 2005.
Office Action regarding U.S. Appl. No. 09/977,552, dated Oct. 18, 2004.
Final Office Action regarding U.S. Appl. No. 09/977,552, dated Apr. 26, 2004.
Response to Rule 312 Communication regarding U.S. Appl. No. 09/977,552, dated Oct. 31, 2003.
Office Action regarding U.S. Appl. No. 09/977,552, dated Dec. 3, 2003.
Final Office Action regarding U.S. Appl. No. 09/977,552, dated Jun. 18, 2003.
Office Action regarding U.S. Appl. No. 09/977,552, dated Jan. 14, 2003.
Examiner's Answer regarding U.S. Appl. No. 09/977,552, dated Dec. 17, 2009.
Record of Oral Hearing regarding U.S. Appl. No. 09/977,552, dated Nov. 29, 2012.
European Search Report for Application No. EP 12 182 243.1, dated Oct. 29, 2012.
Non-Final Office Action regarding U.S. Appl. No. 12/261,643, dated Mar. 12, 2013.
Non-Final Office Action in U.S. Appl. No. 12/685,375, dated Jan. 19, 2012.
First Office Action regarding Chinese Patent Application No. 200910211779.0, dated May 3, 2012. English translation provided by Unitalen Attorneys at Law.
Non-Final Office Action for U.S. Appl. No. 12/685,375, dated Aug. 6, 2012.
Second Office Action regarding Chinese Patent Application No. 200910211779.0, dated Feb. 4, 2013. English translation provided by Unitalen Attorneys at Law.
International Search Report regarding Application No. PCT/US2013/021161, dated May 8, 2013.
Written Opinion of the International Searching Authority regarding Application No. PCT/US2013/021161, dated May 8, 2013.
Non-Final Office Action in U.S. Appl. No. 11/850,846, dated May 24, 2013.
Non-Final Office Action regarding U.S. Appl. No. 13/770,123, dated Jul. 3, 2013.
Third Office Action regarding Chinese Patent Application No. 200910211779.0, dated Sep. 4, 2013. English translation provided by Unitalen Attorneys at Law.
Final Office Action regarding U.S. Appl. No. 12/261,643, dated Sep. 16, 2013.
First Examination Report regarding Australian Patent Application No. 2012241185, dated Sep. 27, 2013.
First Office Action received from the Chinese Patent Office dated Feb. 2, 2007 regarding Application No. 200480011463.2, translated by CCPIT Patent and Trademark Law Office.
First Office Action regarding Canadian Patent Application No. 2,777,349, dated Jul. 19, 2013.
First Official Report regarding Australian Patent Application No. 2007214381, dated Dec. 12, 2008.
Flow & Level Measurement: Mass Flowmeters, http://www.omega.com/literature/transactions/volume4/T9904-10-MASS.html, 2001, 19 pages.
Frequently Asked Questions, http://www.lipaedge.com/faq.asp, Copyright © 2001, 5 pages.
Honeywell, A7075A1000 HVAC Service Assistant, 2001.
Honeywell, Advanced Portable A/C Diagnostics, The HVAC Service Assistant, 2003.
Honeywell, Excel 5000® System, Excel Building Supervisor—Integrated, 74-2034, Copyright © 1994, Rev. 11-94, 12 pages.
Honeywell, Excel 5000® System, Excel Building Supervisor, 74-2033-1, Copyright © 1996, Rev. 6-96, 12 pages.
Honeywell, HVAC Service Assistant, TRGpro PalmTM OS Interface and HVAC Service Assistant A7075A1000, 2002.
HVAC Service Assistant, ACRx Efficiency and Capacity Estimating Technology, Field Diagnostics, 2004.
International Preliminary Examination Report regarding PCT/US02/13456, dated Sep. 15, 2003.
International Preliminary Report on Patentability for International Application No. PCT/US2008/009618, dated Mar. 24, 2010.
International Preliminary Report on Patentability regarding Application No. PCT/US2010/056315, mailed May 24, 2012.
International Search Report and Written Opinion of the International Searching Authority regarding International Application No. PCT/US06/33702, dated Sep. 26, 2007.
International Search Report for International Application No. PCT/US07/019563, dated Jan. 15, 2008, 3 Pages.
International Search Report for PCT/US02/13459; ISA/US; dated Sep. 19, 2002.
International Search Report for PCT/US2012/026973, dated Sep. 3, 2012, 5 pages.
International Search Report for PCT/US2013/061389, dated Jan. 22, 2014, 7 pages.
International Search Report from PCT /US2008/060900, dated Aug. 4, 2008, 6 pages.

(56) References Cited

OTHER PUBLICATIONS

International Search Report from related PCT Application No. PCT/US2014/028074 dated Jun. 19, 2014.
International Search Report regarding Application No. PCT/US2010/036601, dated Dec. 29, 2010.
International Search Report regarding Application No. PCT/US2010/056315, dated Jun. 28, 2011.
International Search Report, Int'l. App. No. PCT/US 06/05917, dated Sep. 26, 2007.
International Search Report, International Application No. PCT/US02/13456, dated Aug. 22, 2002, 2 Pages.
International Search Report, International Application No. PCT/US04/13384; dated Aug. 1, 2004; 1 Page.
International Search Report, International Application No. PCT/US2004/027654, dated Aug. 25, 2004, 4 Pages. cited by other.
International Search Report, International Application No. PCT/US2006/040964, dated Feb. 15, 2007, 2 Pages.
International Search Report; International Application No. PCT/IB96/01435; dated May 23, 1997; 1 Page.
International Search Report; International Application No. PCT/US98/18710; dated Jan. 26, 1999; 1 Page.
Interview Summary from related U.S. Appl. No. 12/054,011 dated Jan. 30, 2012.
Interview Summary regarding U.S. Appl. No. 11/497,644, dated May 4, 2010.
Interview Summary regarding U.S. Appl. No. 11/214,179, dated Jan. 30, 2009.
Interview Summary regarding U.S. Appl. No. 11/497,579, dated Jul. 15, 2010.
Issue Notification regarding U.S. Appl. No. 11/214,179, dated Mar. 14, 2012.
Jeffus, Larry, "Refrigeration and Air Conditioning: An Introduction to HVAC/R," Appendix C, pp. 1060-1063, Copyright 2004.
Jeffus, Larry, "Refrigeration and Air Conditioning: An Introduction to HVAC/R," Section II, Chapter 4, pp. 176-201, Copyright 2004.
Jeffus, Larry, "Refrigeration and Air Conditioning: An Introduction to HVAC/R," Section II, Chapter 5, pp. 239-245, Copyright 2004.
Jeffus, Larry, "Refrigeration and Air Conditioning: An Introduction to HVAC/R," Section II, Chapter 6, p. 322, Copyright 2004.
Jeffus, Larry, "Refrigeration and Air Conditioning: An Introduction to HVAC/R," Section IV, Chapter 9, pp. 494-504, Copyright 2004.
K. A. Manske et al.; Evaporative Condenser Control in Industrial Refrigeration Systems; University of Wisconsin—Madison, Mechanical Engineering Department; International Journal of Refrigeration, vol. 24, No. 7; pp. 676-691; 2001, 21 pages.
Liao et al., A Correlation of Optimal Heat Rejection Pressures in Transcritical Carbon Dioxide Cycles, Applied Thermal Engineering 20 (2000), Jul. 25, 1999, 831-841.
LIPA Launches Free, First-in-Nation Internet-Based Air Conditioner Control Program to Help LIPA and Its Customers Conserve Electricity & Save Money, Apr. 19, 2001, http://www.lipower.org/newscmter/pr/2001/aprill9_0l.html, 3 pages.
Low-Cost Multi-Service Home Gateway Creates New Business Opportunities, Coactive Networks, Copyright 1998-1999, 7 pages.
Nickles, Donald, "Broadband Communications Over Power Transmission Lines," A Guest Lecture From the Dr. Shreekanth Mandaynam Engineering Frontiers Lecture Series, May 5, 2004, 21 pages.
Non Final Office Action for related U.S. Appl. No. 13/369,067 dated Aug. 12, 2014.
Non Final Office Action for related U.S. Appl. No. 13/835,621 dated Aug. 8, 2014.
Non Final Office Action from related U.S. Appl. No. 13/269,188 dated Aug. 14, 2012; 9 pages.
Non Final Office Action from related U.S. Appl. No. 13/269,188 dated Oct. 4, 2013; 11 pages.
Non Final Office Action from related U.S. Appl. No. 13/269,188 dated Feb. 20, 2014; 9 pages.
Advisory Action regarding U.S. Appl. No. 13/269,188, dated Apr. 13, 2015.
Notice of Allowance regarding U.S. Appl. No. 13/835,742, dated Apr. 17, 2015.
Notice of Allowance regarding U.S. Appl. No. 13/836,453, dated Apr. 15, 2015.
Notice of Grounds for Refusal regarding Korean Patent Application No. 10-2009-7000850, dated Oct. 4, 2013. English translation provided by Y.S. Chang & Associates.
Notice of Allowance regarding U.S. Appl. No. 10/940,877, dated Sep. 4, 2009.
Notice of Allowance regarding U.S. Appl. No. 12/685,424, dated Apr. 25, 2011.
Notice of Allowance regarding U.S. Appl. No. 13/303,286, dated Jul. 19, 2012.
Office Action dated Apr. 19, 2006 from Related U.S. Appl. No. 10/916,223 (Kates.003A).
Office Action dated Aug. 17, 2007 from Related U.S. Appl. No. 11/417,609.
Office Action dated Aug. 17, 2007 from Related U.S. Appl. No. 11/417,701.
Office Action dated Aug. 21, 2007 from Related U.S. Appl. No. 11/417,557.
Office Action dated Feb. 1, 2007 from Related U.S. Appl. No. 11/130,562 (Kates.021A).
Office Action dated Feb. 13, 2009 from Related U.S. Appl. No. 12/033,765.
Office Action dated Feb. 13, 2009 from Related U.S. Appl. No. 12/050,821.
Office Action dated Feb. 15, 2008 from Related U.S. Appl. No. 11/417,557.
Office Action dated Feb. 3, 2009 from Related U.S. Appl. No. 11/866,295.
Office Action dated Jan. 18, 2006 from Related U.S. Appl. No. 11/130,601 (Kates.020A).
Office Action dated Jan. 18, 2006 from Related U.S. Appl. No. 11/130,871 (Kates.002A).
Office Action dated Jan. 23, 2007 from Related U.S. Appl. No. 10/916,222.
Office Action dated Jan. 6, 2006 from Related U.S. Appl. No. 11/130,562 (Kates.021A).
Office Action dated Jan. 6, 2006 from Related U.S. Appl. No. 10/916,222.
Office Action dated Jul. 1, 2008 from Related U.S. Appl. No. 11/927,425.
Office Action dated Jul. 11, 2006 from Related U.S. Appl. No. 11/130,562 (Kates.021A).
Office Action dated Jul. 11, 2006 from Related U.S. Appl. No. 10/916,222.
Office Action dated Jul. 11, 2007 from Related U.S. Appl. No. 11/417,609 (Kates.021DV1).
Office Action dated Jul. 11, 2007 from Related U.S. Appl. No. 11/417,701 (Kates.020DV1).
Office Action dated Jul. 16, 2008 from Related U.S. Appl. No. 11/417,701.
Office Action dated Jul. 24, 2008 from Related U.S. Appl. No. 11/417,557.
Office Action dated Jul. 27, 2006 from Related U.S. Appl. No. 11/130,871 (Kates.002A).
Office Action dated Jun. 17, 2009 from Related U.S. Appl. No. 12/033,765.
Office Action dated Jun. 19, 2009 from Related U.S. Appl. No. 11/866,295.
Office Action dated Jun. 22, 2009 from Related U.S. Appl. No. 12/050,821.
Office Action dated Jun. 27, 2007 from Related U.S. Appl. No. 11/417,557 (Kates.012DV1).
Office Action dated Mar. 30, 2006 from Related U.S. Appl. No. 11/130,569 (Kates.022A).
Office Action dated May 4, 2005 from Related U.S. Appl. No. 10/916,223 (Kates.003A).
Office Action dated May 6, 2009 from Related U.S. Appl. No. 11/830,729.
Office Action dated Nov. 14, 2006 from Related U.S. Appl. No. 11/130,569 (Kates.022A).

(56) References Cited

OTHER PUBLICATIONS

Office Action dated Nov. 16, 2006 from Related U.S. Appl. No. 10/916,223 (Kates.003A).
Office Action dated Nov. 8, 2005 from Related U.S. Appl. No. 10/916,222.
Office Action dated Nov. 9, 2005 from Related U.S. Appl. No. 11/130,562 (Kates.021A).
Office Action dated Nov. 9, 2005 from Related U.S. Appl. No. 11/130,601 (Kates.020A).
Office Action dated Nov. 9, 2005 from Related U.S. Appl. No. 11/130,871 (Kates.002A).
Office Action dated Oct. 27, 2005 from Related U.S. Appl. No. 10/916,223 (Kates.003A).
Office Action dated Sep. 18, 2007 from Related U.S. Appl. No. 11/130,562.
Office Action for U.S. Appl. No. 11/394,380, dated Jan. 6, 2009.
Office Action for U.S. Appl. No. 11/497,579, dated Oct. 27, 2009.
Office Action for U.S. Appl. No. 11/497,644, dated Dec. 19, 2008.
Office Action for U.S. Appl. No. 11/497,644, dated Jul. 10, 2009.
Office Action regarding U.S. Appl. No. 10/286,419, dated Jun. 10, 2004.
Office Action regarding U.S. Appl. No. 11/120,166, dated Oct. 2, 2006.
Office Action regarding U.S. Appl. No. 11/120,166, dated Oct. 2, 2007.
Office Action regarding U.S. Appl. No. 11/120,166, dated Dec. 15, 2008.
Office Action regarding U.S. Appl. No. 11/120,166, dated Feb. 17, 2010.
Office Action regarding U.S. Appl. No. 11/120,166, dated Apr. 12, 2007.
Written Opinion regarding PCT/US02/13459, dated Apr. 23, 2003.
Examiner's Report No. 1 regarding Australian Patent Application No. 2013202431, dated Nov. 25, 2014.
Final Office Action for U.S. Appl. No. 13/770,123 dated Dec. 22, 2014.
International Search Report and Written Opinion for related PCT Application No. PCT/US2014/028859, dated Aug. 22, 2014.
International Search Report and Written Opinion of the ISA regarding International Application No. PCT/US2014/032927, ISA/KR dated Aug. 21, 2014.
Non Final Office Action for U.S. Appl. No. 13/407,180, dated Dec. 2, 2014.
Non-Final Office Action regrding U.S. Appl. No. 13/932,611, dated Jan. 30, 2015.
Notice of Allowance and Fees Due regarding U.S. Appl. No. 13/737,566, dated Sep. 24, 2014.
Notice of Allowance for U.S. Appl. No. 13/835,742 dated Dec. 24, 2014.
Notice of Allowance for U.S. Appl. No. 13/835,810 dated Jan. 2, 2015.
Notice of Allowance for U.S. Appl. No. 13/836,043 dated Feb. 4, 2015.
Notice of Allowance for U.S. Appl. No. 13/836,453 dated Dec. 24, 2014.
Notice of Allowance for related U.S. Appl. No. 13/836,043, dated Oct. 9, 2014.
Notice of Allowance for related U.S. Appl. No. 13/836,244, dated Oct. 30, 2014.
Office Action for U.S. Appl. No. 13/269,188 dated Feb. 10, 2015.
Office Action for U.S. Appl. No. 13/767,479 dated Feb. 6, 2015.
Office Action for U.S. Appl. No. 13/835,621 dated Dec. 29, 2014.
Office Action for Canadian Application No. 2,828,740 dated Jan. 12, 2015.
Office Action for related U.S. Appl. No. 13/269,188, dated Oct. 6, 2014.
Office Action for related U.S. Appl. No. 13/767,479, dated Oct. 21, 2014.
Patent Examination Report for Austrialian Application No. 2012223466 dated Jan. 6, 2015.
Second Office Action from the State Intellectual Property Office of People's Republic of China regarding Chinese Patent Application No. 201110349785.X, dated Jul. 25, 2014. Translation provided by Unitalen Attorneys at Law.
Third Chinese Office Action regarding Application No. 201110349785.X, dated Jan. 30, 2015. Translation provided by Unitalen Attorneys at Law.
Final Office Action and Interview Summary regarding U.S. Appl. No. 13/407,180, dated Mar. 13, 2015.
Haiad et al., "EER & SEER as Predictors of Seasonal Energy Performance", Oct. 2004, Southern California Edison, http://www.doe2.com/download/DEER/SEER%2BProgThermostats/EER-SEER_CASE_ProjectSummary_Oct2004_V6a.pdf.
Interview Summary regarding U.S. Appl. No. 13/269,188, dated Mar. 18, 2015.
Notice of Allowance regarding U.S. Appl. No. 13/767,479, dated Mar. 31, 2015.
Notice of Allowance regarding U.S. Appl. No. 13/835,621, dated Mar. 10, 2015.
Office Action from U.S. Appl. No. 13/369,067 dated Apr. 3, 2015.
Office Action regarding U.S. Appl. No. 13/770,479, dated Mar. 16, 2015.
Office Action regarding U.S. Appl. No. 13/770,123, dated Apr. 2, 2015.
Non Final Office Action from related U.S. Appl. No. 13/269,188 dated Jul. 17, 2014; 10 pages.
Non Final Office Action from related U.S. Appl. No. 13/369,067 dated Jan. 16, 2014; 16 pages.
Non Final Office Action from related U.S. Appl. No. 13/767,479 dated Oct. 24, 2013; 8 pages.
Non Final Office Action from related U.S. Appl. No. 13/767,479 dated Jul. 23, 2014; 9 pages.
Non Final Office Action from related U.S. Appl. No. 13/835,621 dated Oct. 30, 2013; 8 pages.
Non Final Office Action from related U.S. Appl. No. 13/835,621 dated Apr. 2, 2014; 11 pages.
Non Final Office Action from related U.S. Appl. No. 13/835,742 dated Oct. 7, 2013; 9 pages.
Non Final Office Action from related U.S. Appl. No. 13/835,810 dated Nov. 15, 2013; 9 pages.
Non Final Office Action from related U.S. Appl. No. 13/836,043 dated Oct. 23, 2013; 8 pages.
Non Final Office Action from related U.S. Appl. No. 13/836,043 dated Jul. 11, 2014; 5 pages.
Non Final Office Action from related U.S. Appl. No. 13/836,244 dated Oct. 15, 2013; 11 pages.
Non Final Office Action from related U.S. Appl. No. 13/836,244 dated Feb. 20, 2014; 10 pages.
Non Final Office Action from related U.S. Appl. No. 13/836,453 dated Aug. 20, 2013; 8 pages.
Non-Final Office Action in U.S. Appl. No. 13/784,890, dated Jun. 11, 2013.
Non-Final Office Action regarding U.S. Appl. No. 11/214,179, dated Jan. 24, 2011.
Non-Final Office Action regarding U.S. Appl. No. 11/214,179, dated Nov. 5, 2008.
Non-Final Office Action regarding U.S. Appl. No. 11/214,179, dated Jun. 8, 2010.
Non-Final Office Action regarding U.S. Appl. No. 12/943,626, dated Dec. 20, 2012.
Non-Final Office Action regarding U.S. Appl. No. 12/955,355, dated Sep. 11, 2012.
Non-Final Office Action regarding U.S. Appl. No. 13/435,543, dated Jun. 21, 2012.
Non-Final Office Action regarding U.S. Appl. No. 13/770,123, dated Jun. 11, 2014.
Notice of Allowance and Fee(s) Due regarding U.S. Appl. No. 12/789,562, dated Oct. 26, 2012.
Notice of Allowance and Fees Due and Notice of Allowability regarding U.S. Appl. No. 11/256,641, dated May 19, 2009.
Notice of Allowance and Fees Due regarding U.S. Appl. No. 12/261,643, dated Jun. 23, 2014.

(56) References Cited

OTHER PUBLICATIONS

Notice of Allowance and Fees Due regarding U.S. Appl. No. 12/943,626, dated Jun. 19, 2014.
Notice of Allowance and Fees Due regarding U.S. Appl. No. 13/737,566, dated Jun. 18, 2014.
Notice of Allowance and Fees Due, Interview Summary and Notice of Allowability regarding U.S. Appl. No. 11/214,179, dated Nov. 23, 2011.
Notice of Allowance and Notice of Allowability regarding U.S. Appl. No. 10/286,419, dated Dec. 2, 2004.
Notice of Allowance and Notice of Allowability regarding U.S. Appl. No. 10/675,137, dated Dec. 16, 2005.
Notice of Allowance dated Dec. 21, 2007 from Related U.S. Appl. No. 11/417,609.
Notice of Allowance dated Dec. 3, 2007 from Related U.S. Appl. No. 11/130,562.
Notice of Allowance dated Feb. 12, 2007 from Related U.S. Appl. No. 11/130,871 (Kates.002A).
Notice of Allowance dated Jul. 13, 2006 from Related U.S. Appl. No. 11/130,601 (Kates.020A).
Notice of Allowance dated Jul. 25, 2007 from Related U.S. Appl. No. 10/916,223 (Kates.003A).
Notice of Allowance dated Jun. 11, 2007 from Related U.S. Appl. No. 10/916,222.
Notice of Allowance dated May 2, 2007 from Related U.S. Appl. No. 11/130,569 (Kates.022A).
Notice of Allowance dated May 29, 2007 from Related U.S. Appl. No. 11/130,569 (Kates.022A).
Notice of Allowance dated Nov. 3, 2008 from Related U.S. Appl. No. 11/417,701.
Notice of Allowance dated Oct. 26, 2007 from Related U.S. Appl. No. 10/916,223.
Notice of Allowance for related U.S. Appl. No. 13/835,810 dated Aug. 5, 2014.
Notice of Allowance for U.S. Appl. No. 10/698,048, dated Sep. 1, 2005.
Notice of Allowance from related U.S. Appl. No. 13/835,742 dated Jan. 31, 2014; 7 pages.
Notice of Allowance from related U.S. Appl. No. 13/835,742 dated Jun. 2, 2014; 8 pages.
Notice of Allowance from related U.S. Appl. No. 13/835,810 dated Mar. 20, 2014; 9 pages.
Notice of Allowance from related U.S. Appl. No. 13/836,453 dated Jan. 14, 2014; 8 pages.
Notice of Allowance from related U.S. Appl. No. 13/836,453 dated Apr. 21, 2014; 8 pages.
Notice of Allowance from related U.S. Appl. No. 13/836,453 dated Aug. 4, 2014.
Notice of Allowance from related U.S. Appl. No. 13/836,244 dated Jul. 2, 2014; 8 pages.
Notice of Allowance regarding U.S. Appl. No. 10/061,964, dated Jul. 19, 2004.
Advisory Action regarding U.S. Appl. No. 12/261,643, dated Nov. 22, 2013.
Final Office Action regarding U.S. Appl. No. 13/770,123, dated Nov. 15, 2013.
First Office Action regarding Chinese Patent Application No. 201110349785.X, dated Nov. 21, 2013, and Search Report. English translation provided by Unitalen Attorneys at Law.
Non-Final Office Action regarding U.S. Appl. No. 13/932,611, dated Nov. 25, 2013.
European Search Report regarding Application No. 07811712.4-1608 / 2069638 PCT/US2007019563, dated Jan. 7, 2014.
Office Action regarding U.S. Appl. No. 13/737,566, dated Dec. 20, 2013.
Fourth Office Action regarding Chinese Patent Application No. 200910211779.0, dated Jan. 6, 2014. English translation provided by Unitalen Attorneys at Law.
Final Office Action regarding U.S. Appl. No. 11/850,846, dated Jan. 17, 2014.
Non-Final Office Action regarding U.S. Appl. No. 13/770,479, dated Jan. 16, 2014.
Non-Final Office Action regarding U.S. Appl. No. 13/784,890, dated Jun. 11, 2013.
Final Office Action regarding U.S. Appl. No. 13/784,890, dated Dec. 30, 2013.
Notice of Allowance regarding U.S. Appl. No. 13/770,123, dated Aug. 13, 2015.
Notice of Allowance and Interview Summary regarding U.S. Appl. No. 13/269,188, dated Aug. 26, 2015.
Office Action regarding Indian Patent Application No. 733/KOLNP/2009, dated Aug. 12, 2015.
Applicant-Initiated Interview Summary regarding U.S. Appl. No. 14/212,632, dated Sep. 2, 2015.
Notice of Allowance regarding U.S. Appl. No. 13/369,067, dated Sep. 2, 2015.
Notice of Allowance regarding U.S. Appl. No. 13/407,180, dated Sep. 4, 2015.
Final Office Action regarding U.S. Appl. No. 13/770,479, dated Sep. 4, 2015.
Office Action regarding U.S. Appl. No. 14/209,415, dated Sep. 10, 2015.
Search Report regarding European Patent Application No. 13736303.2-1806, dated Sep. 17, 2015.
First Office Action regarding Chinese Patent Application No. 201280010796.8, dated Sep. 14, 2015. Translation provided by Unitalen Attorneys at Law.
Notice of Allowance regarding U.S. Appl. No. 13/770,123, dated Oct. 1, 2015.
Interview Summary regarding U.S. Appl. No. 13/407,180, dated Jun. 11, 2015.
Interview Summary regarding U.S. Appl. No. 13/770,479, dated Jun. 16, 2015.
Extended European Search Report regarding European Application No. 08845689.2-1608/2207964, dated Jun. 19, 2015.
Extended European Search Report regarding European Application No. 08848538.8-1608 / 2220372, dated Jun. 19, 2015.
"Air Conditioning Equipment and Diagnostic Primer," Field Diagnostic Services, Inc., Sep. 9, 2002.
About CABA: CABA eBulletin, http://www.caba.org/aboutus/ebulletin/issue17/domosys.html, 2 pages, Aug. 20, 2004.
Advanced Utility Metering: Period of Performance, Subcontractor Report, National Renewable Energy Laboratory, Sep. 2003, 59 pages.
Advisory Action from related U.S. Appl. No. 13/784,890 dated Mar. 14, 2014.
Advisory Action regarding U.S. Appl. No. 11/214,179, dated Aug. 28, 2009.
BChydro, "Power Factor" Guides to Energy Management: The GEM Series, Oct. 1999.
Case Studies: Automated Meter Reading and Load Shed System, http://groupalpha.corn/CaseStudies2.html, Aug. 23, 2004, 1 page.
Communication from European Patent Office concerning Substantive Examination regarding European Patent Application No. 06790063.9, dated Jun. 6, 2011.
Cost Cutting Techniques Used by the Unscrupulous, http://www.kellyshvac.com/howto.html, Oct. 7, 2004, 3 pages.
European Search Report for EP 01 30 7547; dated Feb. 20, 2002; 1 Page.
European Search Report for EP 02 25 0266; dated May 17, 2002; 3 Pages.
European Search Report for EP 02 72 9050, dated Jun. 17, 2004, 2 pages.
European Search Report for EP 82306809.3; dated Apr. 28, 1983; 1 Page.
European Search Report for EP 91 30 3518; dated Jul. 22, 1991; 1 Page.
European Search Report for EP 93 30 4470; dated Oct. 26, 1993; 1 Page.
European Search Report for EP 94 30 3484; dated Apr. 3, 1997; 1 Page.
European Search Report for EP 96 30 4219; dated Dec. 1, 1998; 2 Pages.

(56) References Cited

OTHER PUBLICATIONS

European Search Report for EP 98 30 3525; dated May 28, 1999; 2 Pages.
European Search Report for EP 99 30 6052; dated Dec. 28, 1999; 3 Pages.
European Search Report regarding Application No. EP02729051, dated Feb. 17, 2005.
Examination Report received from Australian Government IP Australia dated Oct. 29, 2009 regarding patent application No. 2008202088.
Examiner Interview regarding U.S. Appl. No. 11/256,641, dated Sep. 16, 2008.
Examiner Interview Summary regarding U.S. Appl. No. 11/394,380, dated Jul. 29, 2010.
Examiner Interview Summary regarding U.S. Appl. No. 10/940,877, dated Dec. 8, 2008.
Examiner Interview Summary regarding U.S. Appl. No. 10/940,877, dated Mar. 2, 2007.
Examiner Interview Summary regarding U.S. Appl. No. 10/940,877, dated Mar. 25, 2008.
Examiner's Answer from related U.S. Appl. No. 13/784,890 dated Jul. 3, 2014.
Examiner's First Report on Australian Patent Application No. 2002259066, dated Mar. 1, 2006.
Examiner-Initiated Interview Summary regarding U.S. Appl. No. 11/214,179, dated Dec. 11, 2009.
Extended European Search Report regarding Application No. 07796879.0-1602 / 2041501 PCT/US2007016135, dated Jul. 14, 2014.
Final Office Action from related U.S. Appl. No. 13/269,188 dated May 23, 2013; 11 pages.
Final Office Action from related U.S. Appl. No. 13/369,067 dated May 1, 2014; 19 pages.
Final Office Action from related U.S. Appl. No. 13/767,479 dated Mar. 14, 2014; 6 pages.
Final Office Action from related U.S. Appl. No. 13/836,043 dated Mar. 12, 2014; 5 pages.
Final Office Action regarding U.S. Appl. No. 11/497,579, dated May 14, 2010.
Final Office Action regarding U.S. Appl. No. 11/497,644, dated Dec. 22, 2010.
Final Office Action regarding U.S. Appl. No. 13/932,611, dated May 28, 2014.
Final Office Action regarding U.S. Appl. No. 11/214,179, dated Jul. 21, 2011.
Final Office Action regarding U.S. Appl. No. 10/061,964, dated Mar. 8, 2004.
Final Office Action regarding U.S. Appl. No. 10/940,877, dated Nov. 13, 2007.
Final Office Action regarding U.S. Appl. No. 10/940,877, dated Apr. 27, 2009.
Final Office Action regarding U.S. Appl. No. 10/940,877, dated May 2, 2006.
Final Office Action regarding U.S. Appl. No. 11/214,179, dated May 29, 2009.
Final Office Action regarding U.S. Appl. No. 11/256,641, dated Feb. 2, 2009.
Final Office Action regarding U.S. Appl. No. 11/337,918, dated Feb. 17, 2011.
Final Office action regarding U.S. Appl. No. 11/337,918, dated Feb. 4, 2010.
First Examination Communication regarding European Application No. EP02729051.9, dated Dec. 23, 2005.
First Examination Report regarding Australian Patent Application No. 2010319488, dated Jan. 10, 2013.
First Office Action from the Patent Office of the People's Republic of China dated Jun. 8, 2007, Application No. 200480027753.6 and Translation provided by CCPIT.
Office Action regarding Australian Patent Application No. 2013323760, dated Sep. 25, 2015.
Office Action and Interview Summary regarding U.S. Appl. No. 14/244,967, dated Oct. 7, 2015.
Office Action regarding U.S. Appl. No. 14/255,519, dated Nov. 9, 2015.
Office Action regarding U.S. Appl. No. 14/212,632, dated Nov. 19, 2015.
Interview Summary regarding U.S. Appl. No. 13/770,479, dated Nov. 25, 2015.
Office Action regarding Chinese Patent Application No. 201380049458.X, dated Nov. 13, 2015. Translation provided by Unitalen Attorneys at Law.
Search Report regarding European Patent Application No. 08251185.8-1605 / 2040016, dated Dec. 4, 2015.
Interview Summary regarding U.S. Appl. No. 12/054,011, dated Jan. 30, 2012.
Office Action regarding U.S. Appl. No. 14/193,568, dated Nov. 3, 2015.
Office Action regarding Chinese Patent Application No. 201380005300.2, dated Jan. 4, 2016. Translation provided by Unitalen Attorneys at Law.
Office Action regarding Australian Patent Application No. 2015207920, dated Dec. 4, 2015.
Advisory Action regarding U.S. Appl. No. 14/212,632, dated Feb. 9, 2016.
Office Action regarding U.S. Appl. No. 14/244,967, dated Feb. 12, 2016.
Office Action regarding European Patent Application No. 08848538.8-1608, dated Feb. 3, 2016.
Advisory Action regarding U.S. Appl. No. 14/212,632, dated Mar. 8, 2016.
Office Action regarding U.S. Appl. No. 14/209,415, dated Mar. 10, 2016.
Office Action regarding U.S. Appl. No. 14/212,632, dated Apr. 7, 2016.
Office Action regarding U.S. Appl. No. 12/943,626, dated May 4, 2016.
Office Action regarding Australian Patent Application No. 2014229103, dated Apr. 28, 2016.
Office Action regarding U.S. Appl. No. 14/617,451, dated Jun. 2, 2016.
Office Action regarding U.S. Appl. No. 14/193,568, dated Jun. 1, 2016.
Interview Summary regarding U.S. Appl. No. 14/209,415, dated Jun. 20, 2016.
Search Report regarding European Patent Application No. 13841699.5, dated Jun. 30, 2016.
Office Action regarding Chinese Patent Application No. 201480016023.X, dated Jun. 22, 2016. Translation provided by Unitalen Attorneys at Law.
Interview Summary regarding U.S. Appl. No. 14/617,451, dated Jul. 28, 2016.
Office Action regarding U.S. Appl. No. 14/208,636, dated Aug. 4, 2016.
Advisory Action regarding U.S. Appl. No. 14/193,568, dated Aug. 10, 2016.
Office Action regarding U.S. Appl. No. 14/727,756, dated Aug. 22, 2016.
Office Action regarding U.S. Appl. No. 14/244,967, dated Aug. 29, 2016.
U.S. Appl. No. 15/450,404, filed Mar. 6, 2017, Wallis et al.
Advisory Action and Examiner-Initiated Interview Summary regarding U.S. Appl. No. 13/770,479, dated May 23, 2017.
Advisory Action regarding U.S. Appl. No. 14/208,636, dated Mar. 23, 2017.
Applicant-Initiated Interview Summary regarding U.S. Appl. No. 13/770,479, dated Dec. 9, 2016.
Interview Summary regarding U.S. Appl. No. 13/770,479, dated May 10, 2017.
Louis Goodman et al. "Vertical Motion of Neutrally Buoyant Floats." Journal of Atmospheric and Oceanic Technology. vol. 7. Feb. 1990.
Office Action regarding Australian Patent Application No. 2015255255, dated Sep. 8, 2016.

(56) References Cited

OTHER PUBLICATIONS

Office Action regarding Canadian Patent Application No. 2,904,734, dated Sep. 13, 2016.
Office Action regarding Canadian Patent Application No. 2,908,362, dated Sep. 21, 2016.
Office Action regarding Indian Patent Application No. 102/KOLNP/2009, dated Mar. 10, 2017.
Office Action regarding U.S. Appl. No. 12/943,626, dated Nov. 4, 2016.
Office Action regarding U.S. Appl. No. 13/770,479, dated Mar. 17, 2017.
Office Action regarding U.S. Appl. No. 13/770,479, dated Sep. 7, 2016.
Office Action regarding U.S. Appl. No. 14/208,636, dated Jan. 26, 2017.
Office Action regarding U.S. Appl. No. 14/244,967, dated Jan. 20, 2017.
Office Action regarding U.S. Appl. No. 14/255,519, dated Oct. 5, 2016.
Office Action regarding U.S. Appl. No. 14/300,782, dated Sep. 30, 2016.
Office Action regarding U.S. Appl. No. 15/096,196, dated Sep. 13, 2016.
Richard E. Lofftus, Jr. "System Charge and Performance Evaluation." HVAC/R Training, Vatterott College. Jan. 2007.
Search Report regarding European Patent Application No. 12752872.7, dated May 4, 2017.
Search Report regarding European Patent Application No. 14763232.7, dated Oct. 27, 2016.
Search Report regarding European Patent Application No. 14764311.8, dated Oct. 27, 2016.
Search Report regarding European Patent Application No. 14780284.7, dated Nov. 2, 2016.
Search Report regarding European Patent Application No. 16187893.9, dated Jan. 19, 2017.
Office Action regarding European Patent Application No. 07796879.0, dated Oct. 19, 2017.

* cited by examiner

| Fault Area | Diagnostics | Sensors: Current and Voltage | Discharge-Line Temperature | Outdoor Temperature | Liquid-Line Temperature |
|---|---|---|---|---|---|
| Compressor | Locking Rotor | X | | | |
| | Motor Failure | X | | | |
| | Insufficient Pumping | | X | | |
| System- High Side | Cycling on Protection | | | | |
| | Cond Low Air/ Dirty Coil | X | | X | X |
| | Overcharge/ Non- Cond. | X | | X | X |
| System- Low Side | Excessive Run Time | | | | |
| | Loss of Charge | X | X | | X |
| | Evap Low Air/ Stuck Orifice | X | X | | |
| System- Electrical | Open Run Circuit | X | | | |
| | Open Start Circuit | X | | | |
| | Open Circuit | X | | | |
| | Welded Contractor | X | | | |
| | Low Voltage | X | | | |
| | Short Cycling | X | | | |
| System Performance | Monitor Efficiency | X | X | X | X |
| | Installation Check | X | X | X | X |

Fig-11

PROTECTION AND DIAGNOSTIC MODULE FOR A REFRIGERATION SYSTEM

CROSS-REFERENCE TO RELATED APPLICATIONS

This application is a continuation of U.S. patent application Ser. No. 11/776,879, filed on Jul. 12, 2007. which claims the benefit of U.S. Provisional Application No. 60/831,755, filed on Jul. 19, 2006. The disclosures of the above applications are incorporated herein by reference.

FIELD

The present disclosure relates to compressors, and more particularly, to a diagnostic system for use with a compressor.

BACKGROUND

The statements in this section merely provide background information related to the present disclosure and may not constitute prior art.

Compressors are used in a wide variety of industrial and residential applications to circulate refrigerant within a refrigeration, heat pump, HVAC, or chiller system (generically referred to as "refrigeration systems") to provide a desired heating and/or cooling effect. In any of the foregoing applications, the compressor should provide consistent and efficient operation to ensure that the particular refrigeration system functions properly.

Refrigeration systems and associated compressors may include a protection system that intermittently restricts power to the compressor to prevent operation of the compressor and associated components of the refrigeration system (i.e., evaporator, condenser, etc.) when conditions are unfavorable. The types of faults that may cause protection concerns include electrical, mechanical, and system faults. Electrical faults typically have a direct effect on an electrical motor associated with the compressor, while mechanical faults generally include faulty bearings or broken parts. Mechanical faults often raise a temperature of working components within the compressor, and thus, may cause malfunction of, and possible damage to, the compressor.

In addition to electrical faults and mechanical faults associated with the compressor, the compressor and refrigeration system components may also be affected by system faults attributed to system conditions such as an adverse level of fluid disposed within the system or to a blocked-flow condition external to the compressor. Such system conditions may raise an internal compressor temperature or pressure to high levels, thereby damaging the compressor and causing system inefficiencies and/or failures. To prevent system and compressor damage or failure, the compressor may be shut down by the protection system when any of the aforementioned conditions are present.

Conventional protection systems typically sense temperature and/or pressure parameters as discrete switches and interrupt power supplied to the electrical motor of the compressor should a predetermined temperature or pressure threshold be exceeded. Typically, a plurality of sensors are required to measure and monitor the various system and compressor operating parameters. With each parameter measured, at least one sensor is typically required, and therefore results in a complex protection system in which many sensors are employed.

Sensors associated with conventional protection systems are required to quickly and accurately detect particular faults experienced by the compressor and/or system. Without such plurality of sensors, conventional systems would merely shut down the compressor when a predetermined threshold mode and/or current is experienced. Repeatedly shutting down the compressor whenever a fault condition is experienced results in frequent service calls and repairs to the compressor to properly diagnose and remedy the fault. In this manner, while conventional protection devices adequately protect a compressor and system to which the compressor may be tied, conventional protection systems fail to precisely indicate a particular fault and often require a plurality of sensors to diagnose the compressor and/or system.

SUMMARY

A system is provided and may include a compressor functioning in a refrigeration circuit. An ambient temperature sensor may produce a signal indicative of an ambient temperature. Processing circuitry may calculate an energy efficiency rating of the refrigeration circuit and may generate a relationship of the calculated energy efficiency rating and ambient temperature. The processing circuitry may compare the calculated energy efficiency rating to a base energy efficiency rating to determine if a fault condition exists.

In another configuration, a system may include a compressor functioning in a refrigeration circuit. An ambient temperature sensor may produce a signal indicative of an ambient temperature. Processing circuitry may calculate an energy efficiency rating of the refrigeration circuit and may generate an efficiency index by dividing the calculated energy efficiency rating by the last stored value of the calculated energy efficiency rating for a particular ambient temperature to determine changes in efficiency of the refrigeration circuit over time.

A method is provided and may include producing a signal indicative of an ambient temperature, calculating by processing circuitry an energy efficiency rating of a refrigeration circuit, and generating by the processing circuitry a relationship of the calculated energy efficiency rating and ambient temperature. The method may also include comparing by the processing circuitry the calculated energy efficiency rating to a base energy efficiency rating and determining by the processing circuitry if a fault condition exists based on the comparison.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

FIG. 11 is a table illustrating various sensor combinations used to detect specific fault conditions;

DETAILED DESCRIPTION

Figure 1:
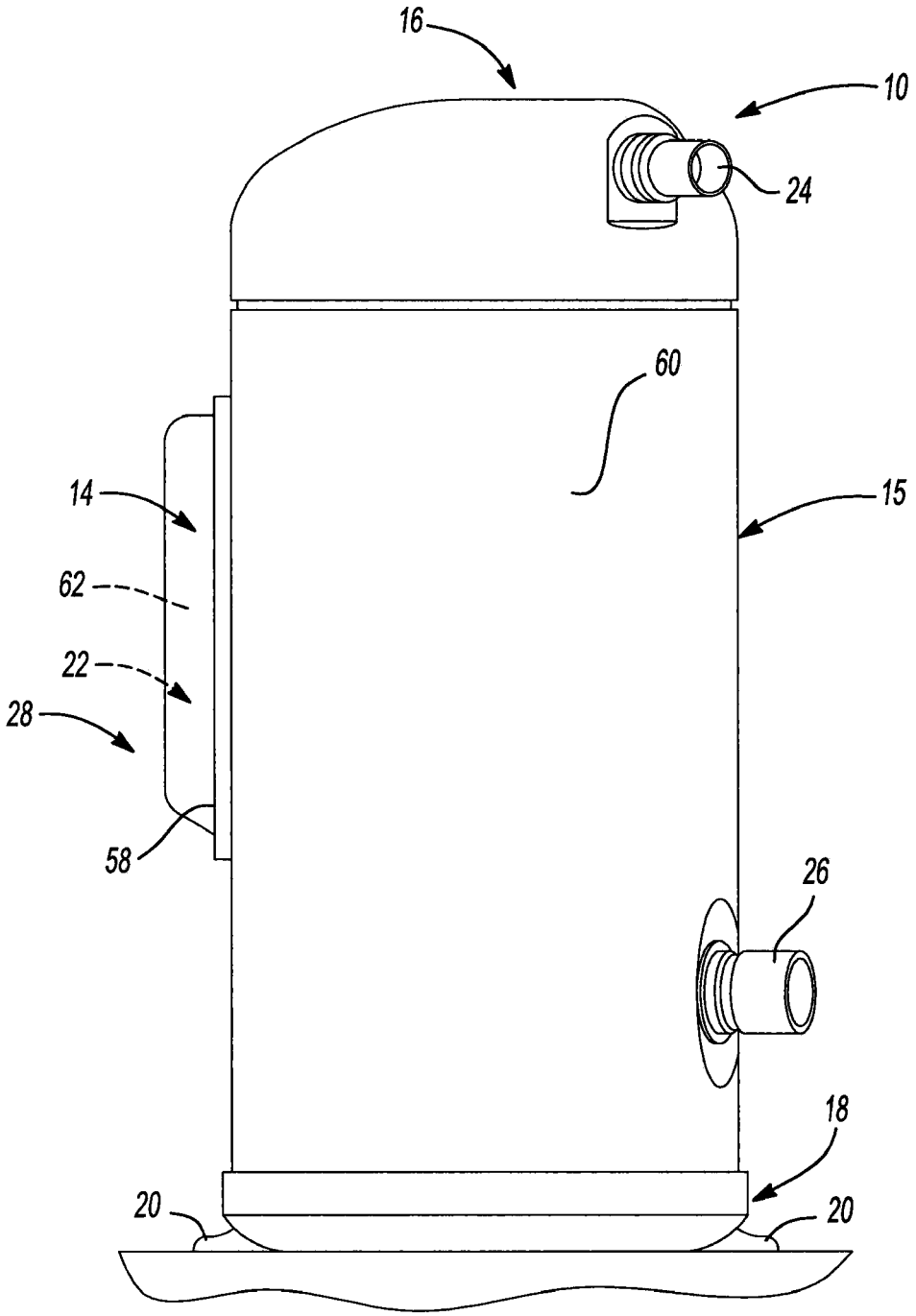
FIG. 1 is a perspective view of a compressor incorporating a protection system in accordance with the principles of the present teachings.

The following description is merely exemplary in nature and is not intended to limit the present disclosure, application, or uses. It should be understood that throughout the drawings, corresponding reference numerals indicate like or corresponding parts and features.

With reference to the drawings, a compressor 10 is shown incorporated into a refrigeration system 12. A protection and control system 14 is associated with the compressor 10 and the refrigeration system 12 to monitor and diagnose both the compressor 10 and the refrigeration system 12. The protection and control system 14 utilizes a series of sensors to determine non-measured operating parameters of the compressor 10 and/or refrigeration system 12. The protection and control system 14 uses the non-measured operating parameters in conjunction with measured operating parameters from the sensors to diagnose and protect the compressor 10 and/or refrigeration system 12.

Figure 2:
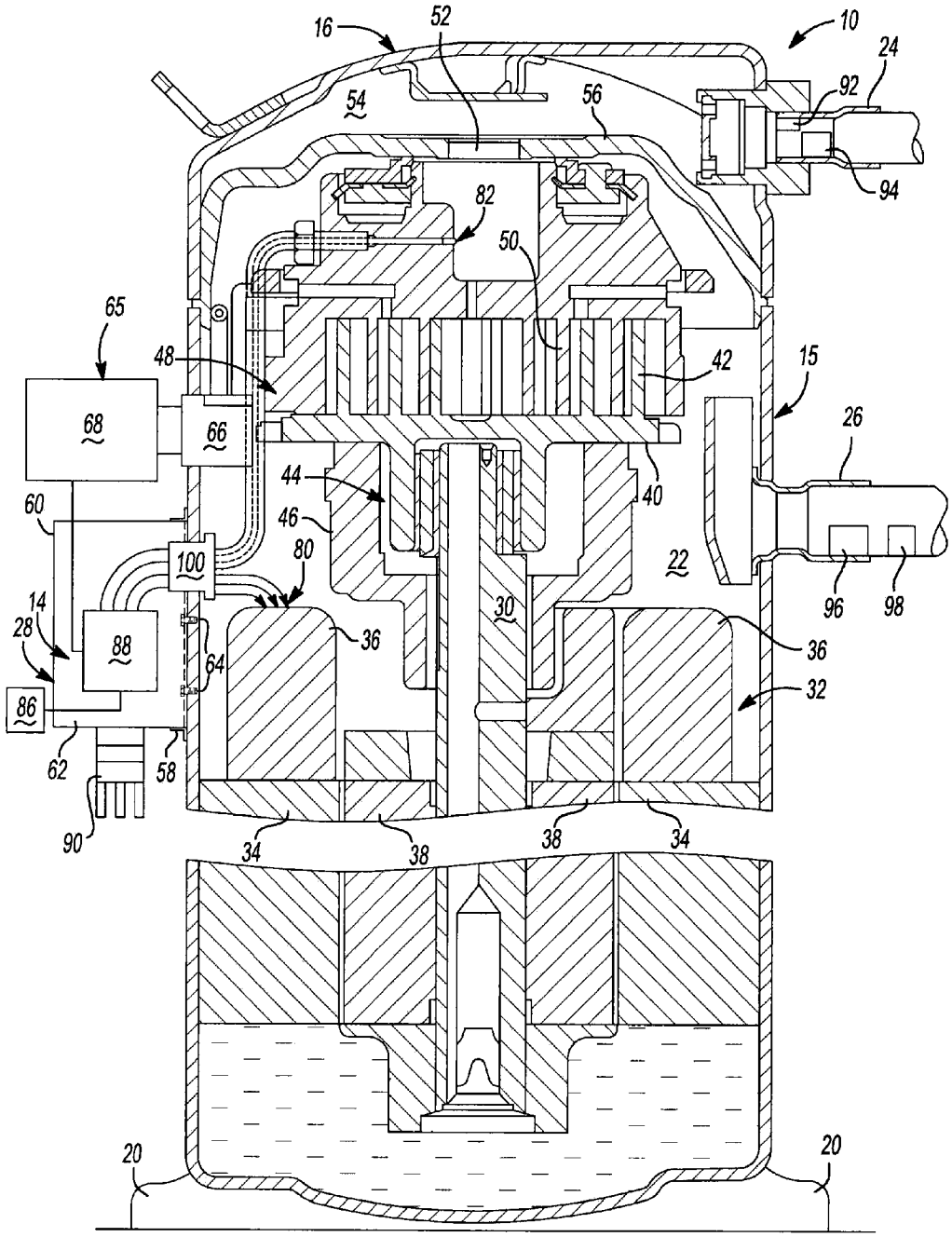
FIG. 2 is a cross-sectional view of the compressor of FIG. 1.

With particular reference to FIGS. 1 and 2, the compressor 10 is shown to include a generally cylindrical hermetic shell 15 having a welded cap 16 at a top portion and a base 18 having a plurality of feet 20 welded at a bottom portion. The cap 16 and the base 18 are fitted to the shell 15 such that an interior volume 22 of the compressor 10 is defined. The cap 16 is provided with a discharge fitting 24, while the shell 15 is similarly provided with an inlet fitting 26, disposed generally between the cap 16 and base 18, as best shown in FIG. 2. In addition, an electrical enclosure 28 is fixedly attached to the shell 15 generally between the cap 16 and the base 18 and operably supports a portion of the protection and control system 14 therein.

A crankshaft 30 is rotatably driven by an electric motor 32 relative to the shell 15. The motor 32 includes a stator 34 fixedly supported by the hermetic shell 15, windings 36 passing therethrough, and a rotor 38 press-fit on the crankshaft 30. The motor 32 and associated stator 34, windings 36, and rotor 38 cooperate to drive the crankshaft 30 relative to the shell 15 to compress a fluid.

The compressor 10 further includes an orbiting scroll member 40 having a spiral vein or wrap 42 on an upper surface thereof for use in receiving and compressing a fluid. An Oldham coupling 44 is disposed generally between the orbiting scroll member 40 and bearing housing 46 and is keyed to the orbiting scroll member 40 and a non-orbiting scroll member 48. The Oldham coupling 44 transmits rotational forces from the crankshaft 30 to the orbiting scroll member 40 to compress a fluid disposed generally between the orbiting scroll member 40 and the non-orbiting scroll member 48. Oldham coupling 44, and its interaction with orbiting scroll member 40 and non-orbiting scroll member 48, is preferably of the type disclosed in assignee's commonly owned U.S. Pat. No. 5,320,506, the disclosure of which is incorporated herein by reference.

Non-orbiting scroll member 48 also includes a wrap 50 positioned in meshing engagement with the wrap 42 of the orbiting scroll member 40. Non-orbiting scroll member 48 has a centrally disposed discharge passage 52, which communicates with an upwardly open recess 54. Recess 54 is in fluid communication with the discharge fitting 24 defined by the cap 16 and a partition 56, such that compressed fluid exits the shell 15 via discharge passage 52, recess 54, and fitting 24. Non-orbiting scroll member 48 is designed to be mounted to bearing housing 46 in a suitable manner such as disclosed in assignee's commonly owned U.S. Pat. Nos. 4,877,382 and 5,102,316, the disclosures of which are incorporated herein by reference.

The electrical enclosure 28 includes a lower housing 58, an upper housing 60, and a cavity 62. The lower housing 58 is mounted to the shell 15 using a plurality of studs 64, which are welded or otherwise fixedly attached to the shell 15. The upper housing 60 is matingly received by the lower housing 58 and defines the cavity 62 therebetween. The cavity 62 is positioned on the shell 15 of the compressor 10 and may be used to house respective components of the protection and control system 14 and/or other hardware used to control operation of the compressor 10 and/or refrigeration system 12.

With particular reference to FIG. 2, the compressor 10 includes an actuation assembly 65 that selectively separates the orbiting scroll member 40 from the non-orbiting scroll member 48 to modulate a capacity of the compressor 10 between a reduced-capacity mode and a full-capacity mode. The actuation assembly 65 may include a solenoid 66 connected to the orbiting scroll member 40 and a controller 68 coupled to the solenoid 66 for controlling movement of the solenoid 66 between an extended position and a retracted position.

Movement of the solenoid 66 into the extended position separates the wraps 42 of the orbiting scroll member 40 from the wraps 50 of the non-orbiting scroll member 48 to reduce an output of the compressor 10. Conversely, movement of the solenoid 66 into the retracted position moves the wraps 42 of the orbiting scroll member 40 closer to the wraps 50 of the non-orbiting scroll member 48 to increase an output of the compressor. In this manner, the capacity of the compressor 10 may be modulated in accordance with demand or in response to a fault condition. While movement of the solenoid 66 into the extended position is described as separating the wraps 42 of the orbiting scroll member 40 from the wraps 50 of the non-orbiting scroll member 48, movement of the solenoid 66 into the extended position could alternately move the wraps 42 of the orbiting scroll member 40 into engagement with the wraps 50 of the non-orbiting scroll member 48. Similarly, while movement of the solenoid 66 into the retracted position is described as moving the wraps 42 of the orbiting scroll member 40 closer to the wraps 50 of the non-orbiting scroll member 48, movement of the solenoid 66 into the retracted position could alternately move the wraps 42 of the orbiting scroll member 40 away from the wraps 50 of the non-orbiting scroll member 48. The actuation assembly 65 may be of the type disclosed in assignee's commonly owned U.S. Pat. No. 6,412,293, the disclosure of which is incorporated herein by reference.

Figure 3:
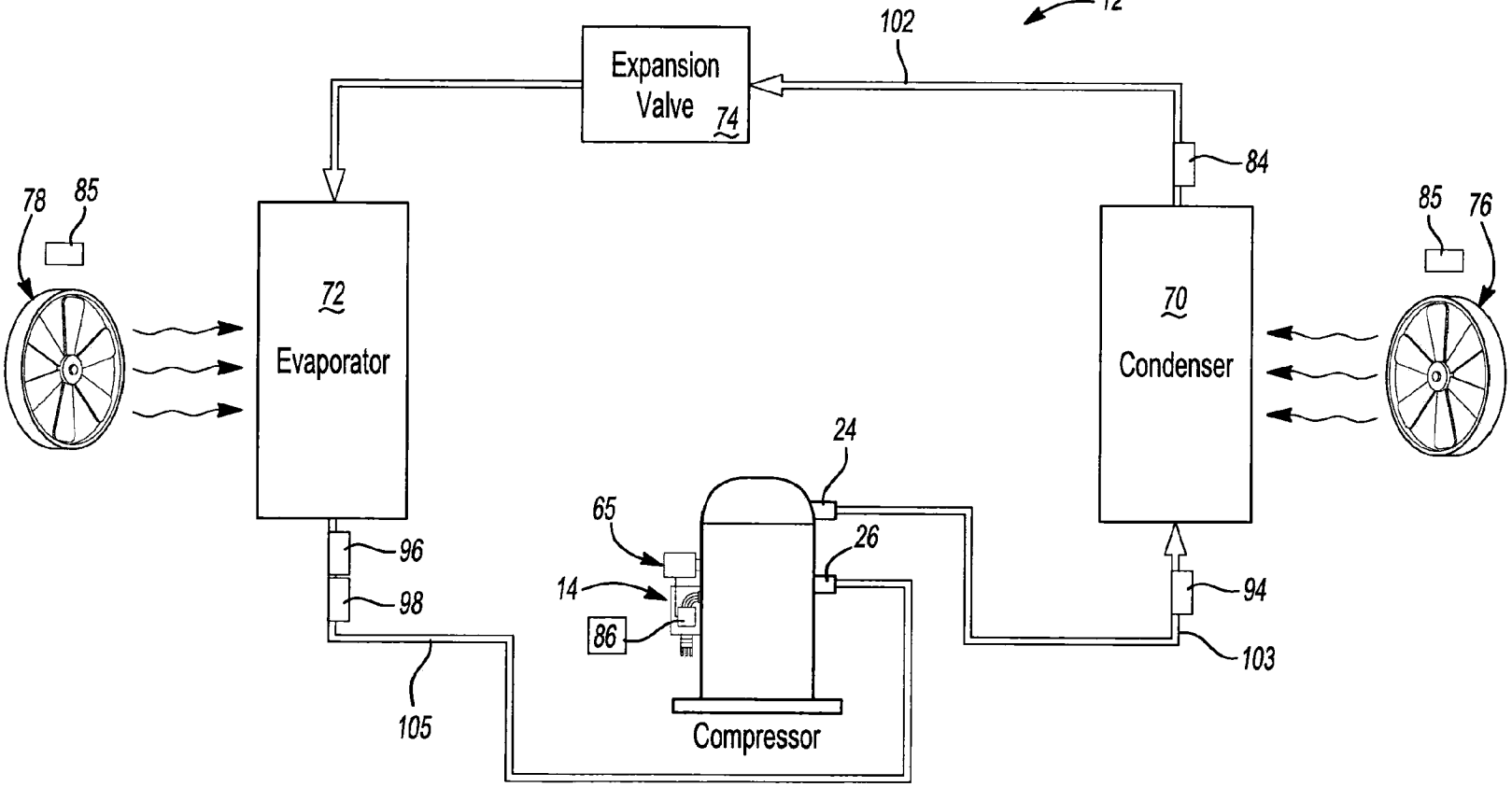
FIG. 3 is a schematic representation of a refrigeration system incorporating the compressor of FIG. 1.

With particular reference to FIG. 3, the refrigeration system 12 is shown to include a condenser 70, an evaporator 72, and an expansion device 74 disposed generally between the condenser 70 and the evaporator 72. The refrigeration system 12 also includes a condenser fan 76 associated with the condenser 70 and an evaporator fan 78 associated with the evaporator 72. Each of the condenser fan 76 and the evaporator fan 78 may be variable-speed fans that can be controlled based on a cooling and/or heating demand of the refrigeration system 12. Furthermore, each of the condenser fan 76 and evaporator fan 78 may be controlled by the protection and control system 14 such that operation of the condenser fan 76 and evaporator fan 78 may be coordinated with operation of the compressor 10.

In operation, the compressor 10 circulates refrigerant generally between the condenser 70 and evaporator 72 to produce a desired heating and/or cooling effect. The compressor 10 receives vapor refrigerant from the evaporator 72 generally at the inlet fitting 26 and compresses the vapor refrigerant between the orbiting scroll member 40 and the non-orbiting scroll member 48 to deliver vapor refrigerant at discharge pressure at discharge fitting 24.

Once the compressor 10 has sufficiently compressed the vapor refrigerant to discharge pressure, the discharge-pressure refrigerant exits the compressor 10 at the discharge fitting 24 and travels within the refrigeration system 12 to the condenser 70. Once the vapor enters the condenser 70, the refrigerant changes phase from a vapor to a liquid, thereby rejecting heat. The rejected heat is removed from the condenser 70 through circulation of air through the condenser 70 by the condenser fan 76. When the refrigerant has sufficiently changed phase from a vapor to a liquid, the refrigerant exits the condenser 70 and travels within the refrigeration system 12 generally towards the expansion device 74 and evaporator 72.

Upon exiting the condenser 70, the refrigerant first encounters the expansion device 74. Once the expansion device 74 has sufficiently expanded the liquid refrigerant, the liquid refrigerant enters the evaporator 72 to change phase from a liquid to a vapor. Once disposed within the evaporator 72, the liquid refrigerant absorbs heat, thereby changing from a liquid to a vapor and producing a cooling effect. If the evaporator 72 is disposed within an interior of a building, the desired cooling effect is circulated into the building to cool the building by the evaporator fan 78. If the evaporator 72 is associated with a heat-pump refrigeration system, the evaporator 72 may be located remote from the building such that the cooling effect is lost to the atmosphere and the rejected heat experienced by the condenser 70 is directed to the interior of the building to heat the building. In either configuration, once the refrigerant has sufficiently changed phase from a liquid to a vapor, the vaporized refrigerant is received by the inlet fitting 26 of the compressor 10 to begin the cycle anew.

With particular reference to FIGS. 2 and 3, the protection and control system 14 is shown to include a high-side sensor 80, a low-side sensor 82, a liquid-line temperature sensor 84, and an outdoor/ambient temperature sensor 86. The protection and control system 14 also includes processing circuitry 88 and a power-interruption system 90, each of which may be disposed within the electrical enclosure 28 mounted to the shell 15 of the compressor 10. The sensors 80, 82, 84, 86 cooperate to provide the processing circuitry 88 with sensor data for use by the processing circuitry 88 in determining non-measured operating parameters of the compressor 10 and/or refrigeration system 12. The processing circuitry 88 uses the sensor data and the determined non-measured operating parameters to diagnose the compressor 10 and/or refrigeration system 12 and selectively restricts power to the electric motor of the compressor 10 via the power-interruption system 90, depending on the identified fault.

The high-side sensor 80 generally provides diagnostics related to high-side faults such as compressor mechanical failures, motor failures, and electrical component failures such as missing phase, reverse phase, motor winding current imbalance, open circuit, low voltage, locked rotor current, excessive motor winding temperature, welded or open contactors, and short cycling. The high-side sensor 80 may be a current sensor that monitors compressor current and voltage to determine and differentiate between mechanical failures, motor failures, and electrical component failures. The high-side sensor 80 may be mounted within the electrical enclosure 28 or may alternatively be incorporated inside the shell 15 of the compressor 10 (FIG. 2). In either case, the high-side sensor 80 monitors current drawn by the compressor 10 and generates a signal indicative thereof, such as disclosed in assignee's commonly owned U.S. Pat. No. 6,615,594, U.S. patent application Ser. No. 11/027,757 filed on Dec. 30, 2004 and U.S. patent application Ser. No. 11/059,646 filed on Feb. 16, 2005, the disclosures of which are incorporated herein by reference.

While the high-side sensor 80 as described herein may provide compressor current information, the protection and control system 14 may also include a discharge pressure sensor 92 mounted in a discharge pressure zone and/or a temperature sensor 94 mounted within or near the compressor shell 15 such as within the discharge fitting 24 (FIG. 2). The temperature sensor 94 may additionally or alternatively be positioned external of the compressor 10 along a conduit 103 extending generally between the compressor 10 and the condenser 70 (FIG. 3) and may be disposed in close proximity to an inlet of the condenser 70. Any or all of the foregoing sensors may be used in conjunction with the high-side sensor 80 to provide the protection and control system 14 with additional system information.

The low-side sensor 82 generally provides diagnostics related to low-side faults such as a low charge in the refrigerant, a plugged orifice, an evaporator fan failure, or a leak in the compressor 10. The low-side sensor 82 may be disposed proximate to the discharge fitting 24 or the discharge passage 52 of the compressor 10 and monitors a discharge-line temperature of a compressed fluid exiting the compressor 10. In addition to the foregoing, the low-side sensor 82 may be disposed external from the compressor shell 15 and proximate to the discharge fitting 24 such that vapor at discharge pressure encounters the low-side sensor 82. Locating the low-side sensor 82 external of the shell 15 allows flexibility in compressor and system design by providing the low-side sensor 82 with the ability to be readily adapted for use with practically any compressor and any system.

While the low-side sensor 82 may provide discharge-line temperature information, the protection and control system 14 may also include a suction pressure sensor 96 or a low-side temperature sensor 98, which may be mounted proximate to an inlet of the compressor 10 such as the inlet fitting 26 (FIG. 2). The suction pressure sensor 96 and low-side temperature sensor 98 may additionally or alternatively be disposed along a conduit 105 extending generally between the evaporator 72 and the compressor 10 (FIG. 3) and may be disposed in close proximity to an outlet of the evaporator 72. Any or all of the foregoing sensors may be used in conjunction with the low-side sensor 82 to provide the protection and control system 14 with additional system information.

While the low-side sensor 82 may be positioned external to the shell 15 of the compressor 10, the discharge temperature of the compressor 10 can similarly be measured within the shell 15 of the compressor 10. A discharge core temperature, taken generally at the discharge fitting 24, could be used in place of the discharge-line temperature arrangement shown in FIG. 2. A hermetic terminal assembly 100 may be used with such an internal discharge temperature sensor to maintain the sealed nature of the compressor shell 15.

The liquid-line temperature sensor 84 may be positioned either within the condenser 70 or positioned along a conduit 102 extending generally between an outlet of the condenser 70 and the expansion valve 74. In this position, the temperature sensor 84 is located in a position within the refrigeration system 12 that represents a liquid location that is common to both a cooling mode and a heating mode if the refrigeration system 12 is a heat pump.

Because the liquid-line temperature sensor 84 is disposed generally near an outlet of the condenser 70 or along the conduit 102 extending generally between the outlet of the condenser 70 and the expansion valve 74, the liquid-line temperature sensor 84 encounters liquid refrigerant (i.e., after the refrigerant has changed from a vapor to a liquid within the condenser 70) and therefore can provide an indication of a temperature of the liquid refrigerant to the processing circuitry 88. While the liquid-line temperature sensor 84 is described as being near an outlet of the condenser 70 or along a conduit 102 extending between the condenser 70 and the expansion valve 74, the liquid-line temperature sensor 84 may also be placed anywhere within the refrigeration system 12 that would allow the liquid-line temperature sensor 84 to provide an indication of a temperature of liquid refrigerant within the refrigeration system 12 to the processing circuitry 88.

The ambient temperature sensor or outdoor/ambient temperature sensor 86 is located external from the compressor shell 15 and generally provides an indication of the outdoor/ambient temperature surrounding the compressor 10 and/or refrigeration system 12. The outdoor/ambient temperature sensor 86 may be positioned adjacent to the compressor shell 15 such that the outdoor/ambient temperature sensor 86 is in close proximity to the processing circuitry 88 (FIG. 2). Placing the outdoor/ambient temperature sensor 86 in close proximity to the compressor shell 15 provides the processing circuitry 88 with a measure of the temperature generally adjacent to the compressor 10. Locating the outdoor/ambient temperature sensor 86 in close proximity to the compressor shell 15 not only provides the processing circuitry 88 with an accurate measure of the surrounding air around the compressor 10, but also allows the outdoor/ambient temperature sensor 86 to be attached to or within the electrical enclosure 28.

Figure 4:
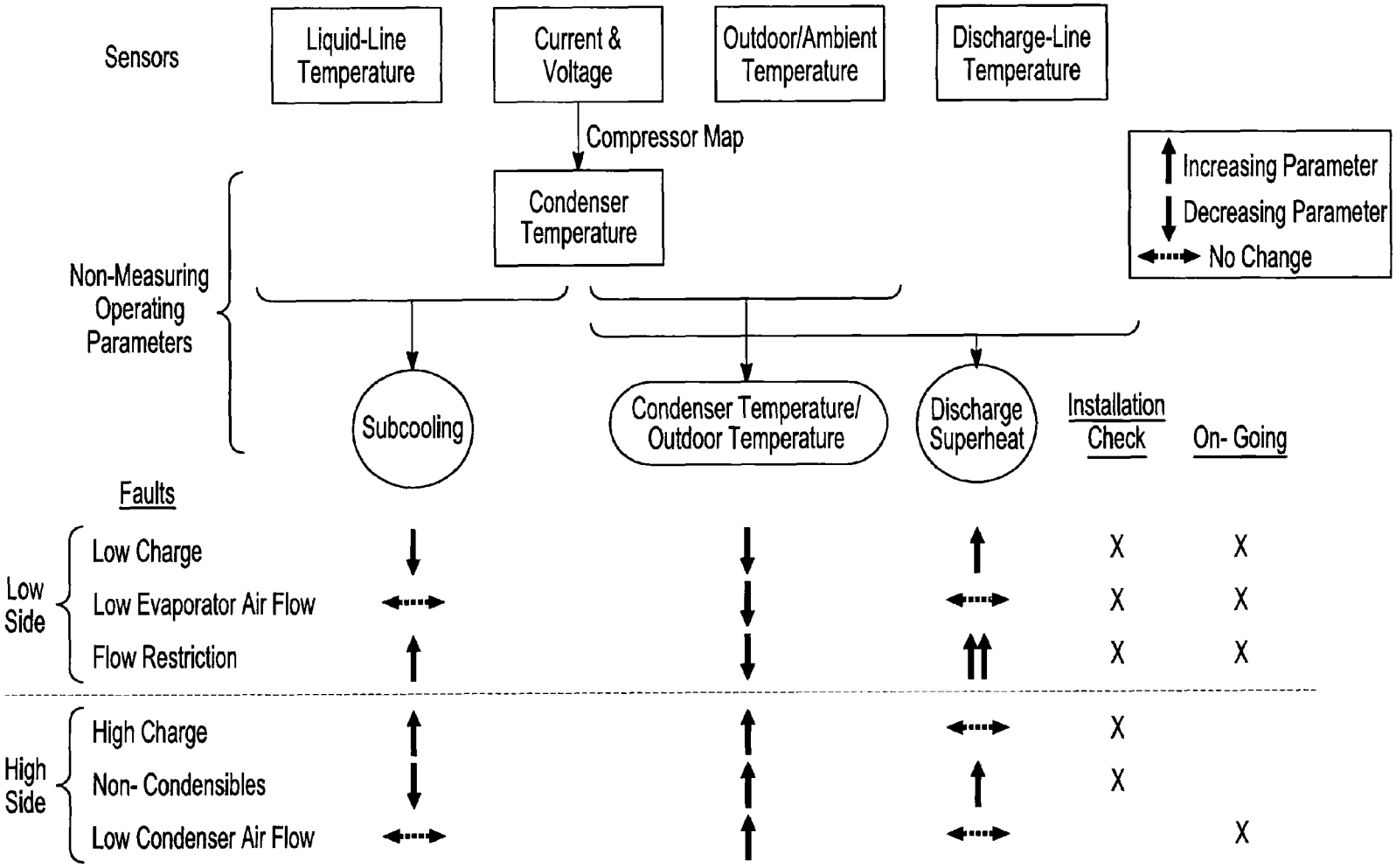
FIG. 4 is a table illustrating various sensor combinations used to detect specific fault conditions.
Figure 5:
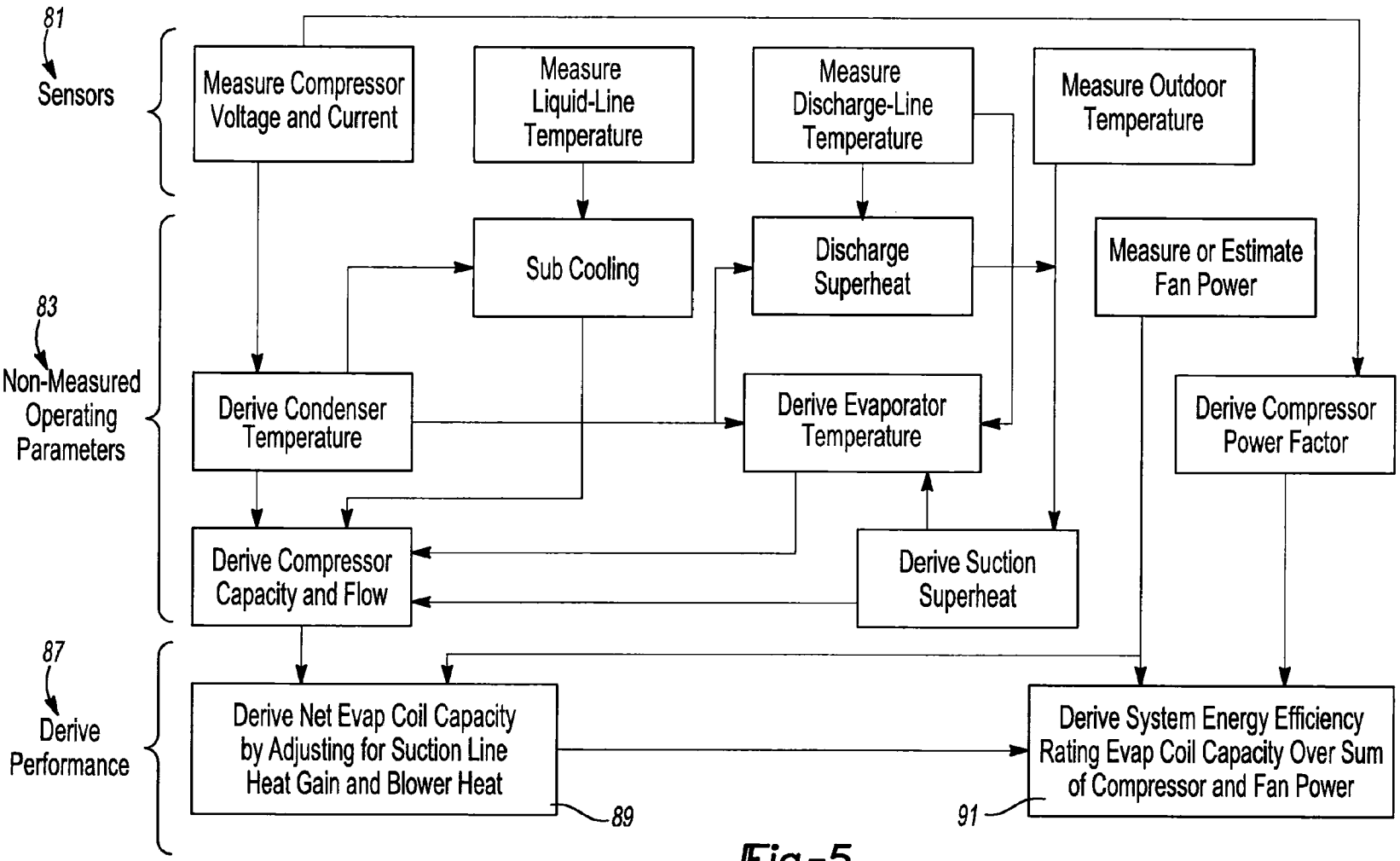
FIG. 5 is a flow chart depicting a process for determining system energy efficiency.

The processing circuitry 88 receives sensor data from the high-side sensor 80, low-side sensor 82, liquid-line temperature sensor 84, and outdoor/ambient temperature sensor 86. As shown in FIGS. 4 and 5, the processing circuitry 88 may use the sensor data from the respective sensors 80, 82, 84, 86 to determine non-measured operating parameters of the compressor 10 and/or refrigeration system 12.

The processing circuitry 88 determines the non-measured operating parameters of the compressor 10 and/or refrigeration system 12 based on the sensor data received from the respective sensors 80, 82, 84, 86 without requiring individual sensors for each of the non-measured operating parameters. The processing circuitry 88 is able to determine a condenser temperature ($T_{cond}$), subcooling of the refrigeration system 12, a temperature difference between the condenser temperature and outdoor/ambient temperature (TD), and a discharge superheat of the refrigeration system 12.

The processing circuitry 88 may determine the condenser temperature by referencing compressor power on a compressor map. The derived condenser temperature is generally the saturated condenser temperature equivalent to the discharge pressure for a particular refrigerant. The condenser temperature should be close to a temperature at a mid-point of the condenser 70. Using a compressor map to determine the condenser temperature provides a more accurate representation of the overall temperature of the condenser 70 when compared to a condenser temperature value provided by a temperature sensor mounted on a coil of the condenser 70 as the condenser coil likely includes many parallel circuits having different temperatures.

Figure 6:
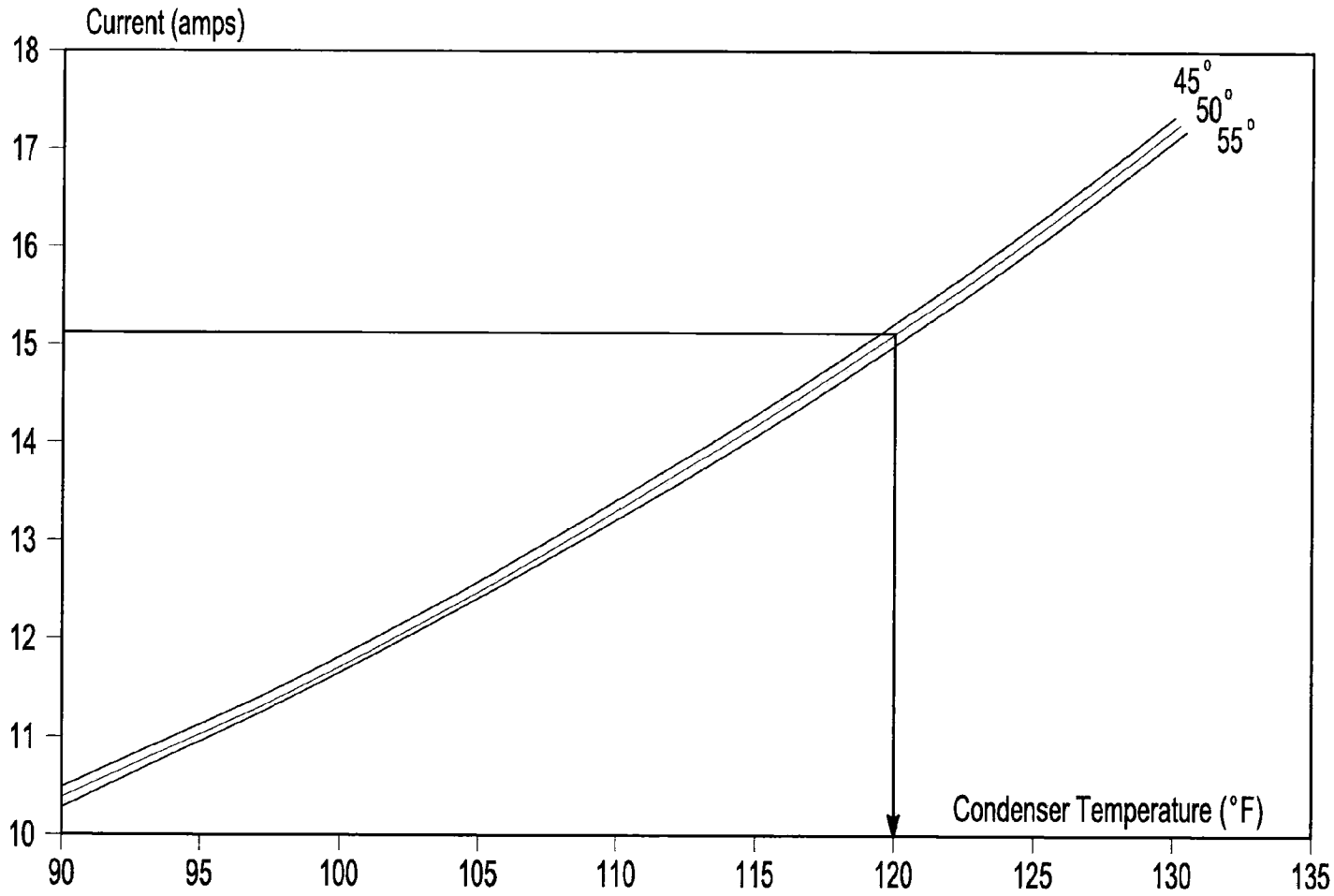
FIG. 6 is a graph of current drawn by a compressor versus condenser temperature for use in determining condenser temperature at a given evaporator temperature.

FIG. 6 is an example of a compressor map showing compressor current versus condenser temperature at various evaporator temperatures ($T_{evap}$). As shown, current remains fairly constant irrespective of evaporator temperature. Therefore, while an exact evaporator temperature can be determined by a second degree polynomial (i.e., a quadratic function), for purposes of control, the evaporator temperature can be determined by a first degree polynomial (i.e., a linear function) and can be approximated as roughly 45, 50, or 55 degrees Fahrenheit. The error associated with choosing an incorrect evaporator temperature is minimal when determining the condenser temperature. While compressor current is shown, compressor power and/or voltage may be used in place of current for use in determining condenser temperature. Compressor power may determined based on the current drawn by motor 32, as indicated by the high-side sensor 80.

Once the compressor current is known and is adjusted for voltage based on a baseline voltage contained in a compressor map (FIG. 6), the condenser temperature may be determined by comparing compressor current with condenser temperature using the graph shown in FIG. 6. The above process for determining the condenser temperature is described in assignee's commonly-owned U.S. patent application Ser. No. 11/059,646 filed on Feb. 16, 2005, the disclosure of which is herein incorporated by reference.

Once the condenser temperature is known, the processing circuitry 88 is then able to determine the subcooling of the refrigeration system 12 by subtracting the liquid-line temperature as indicated by the liquid-line temperature sensor 84 from the condenser temperature and then subtracting an additional small value (typically 2-3° F.) representing the pressure drop between an outlet of the compressor 10 and an outlet of the condenser 70. The processing circuitry 88 is therefore able to determine not only the condenser temperature but also the subcooling of the refrigeration system 12 without requiring an additional temperature sensor for either operating parameter.

The processing circuitry 88 is also able to calculate a temperature difference (TD) between the condenser 70 and the outdoor/ambient temperature surrounding the refrigeration system 12. The processing circuitry 88 is able to determine the condenser temperature by referencing either the power or current drawn by the compressor 10 against the graph shown in FIG. 6 without requiring a temperature sensor to be positioned within the condenser 70. Once the condenser temperature is known (i.e., derived), the processing circuitry 88 can determine the temperature difference (TD) by subtracting the ambient temperature as received from the outdoor/ambient temperature sensor 86 from the derived condenser temperature.

The discharge superheat of the refrigeration system 12 can also be determined once the condenser temperature is known. Specifically, the processing circuitry 88 can determine the discharge superheat of the refrigeration system 12 by subtracting the condenser temperature from the discharge-line temperature. As described above, the discharge-line temperature may be detected by the low-side sensor 82 and is provided to the processing circuitry 88. Because the processing circuitry 88 can determine the condenser temperature by referencing the compressor power against the graph shown in FIG. 6, and because the processing circuitry 88 knows the discharge-line temperature based on information received from the low-side sensor 82, the processing circuitry 88 can determine the discharge superheat of the compressor 10 by subtracting the condenser temperature from the discharge-line temperature.

As described above, the protection and control system 14 receives sensor data from the high-side sensor 80, low-side sensor 82, liquid-line temperature sensor 84, and outdoor/ambient temperature sensor 86, and derives non-measured operating parameters of the compressor 10 and/or refrigeration system 12 such as condenser temperature, subcooling of the refrigeration system 12, a temperature difference between the condenser 70 and outdoor/ambient temperature, and discharge superheat of the refrigeration system 12, without requiring individual sensors for each of the derived parameters. Therefore, the protection and control system 14 not only reduces the complexity of the compressor and refrigeration system, but also reduces costs associated with monitoring and diagnosing the compressor 10 and/or refrigeration system 12.

Once the processing circuitry 88 has received the sensor data and determined the non-measured operating parameters, the processing circuitry 88 can diagnose the compressor 10 and refrigeration system 12. As shown in FIGS. 4 and 5, the processing circuitry 88 is able to categorize a fault based on specific information received from the individual sensors and calculated non-measured operating parameters.

As shown in FIG. 4, once the processing circuitry 88 receives the sensor data and determines the non-measured operating parameters, the processing circuitry 88 can differentiate between specific low-side and high-side faults experienced by the compressor 10 and/or refrigeration system 12. Low-side faults may include a low charge condition, a low evaporator air flow condition, and/or a flow restriction at either or both of the condenser 70 and evaporator 72. A high-side fault may include a high-charge condition, a non-condensible condition (i.e., air in the refrigerant), and a low condenser air flow condition.

By way of example, the processing circuitry 88 may be able to determine that the compressor 10 and/or refrigeration system 12 is experiencing a low-charge condition if the discharge superheat of the refrigeration system 12 is increasing relative to a predetermined target stored within the processing circuitry 88 while both the subcooling and the condenser temperature difference (i.e., condensing temperature minus outdoor/ambient temperature) are decreasing relative to a predetermined target stored in the processing circuitry 88.

By way of another example, the processing circuitry 88 may be able to determine that the compressor 10 and/or refrigeration system 12 is experiencing a high-side fault such as a high charge condition if the subcooling of the refrigeration system 12 and the temperature difference (i.e., condensing temperature minus outdoor/ambient temperature) are each increasing relative to a predetermined target stored in the processing circuitry 88 while the discharge superheat of the refrigeration system 12 remains relatively unchanged relative to a predetermined target stored in the processing circuitry 88 for a thermal expansion valve/electronic expansion valve flow control system or decreases relative to a predetermined target stored in the processing circuitry 88 for an orifice flow control system.

Figure 16:
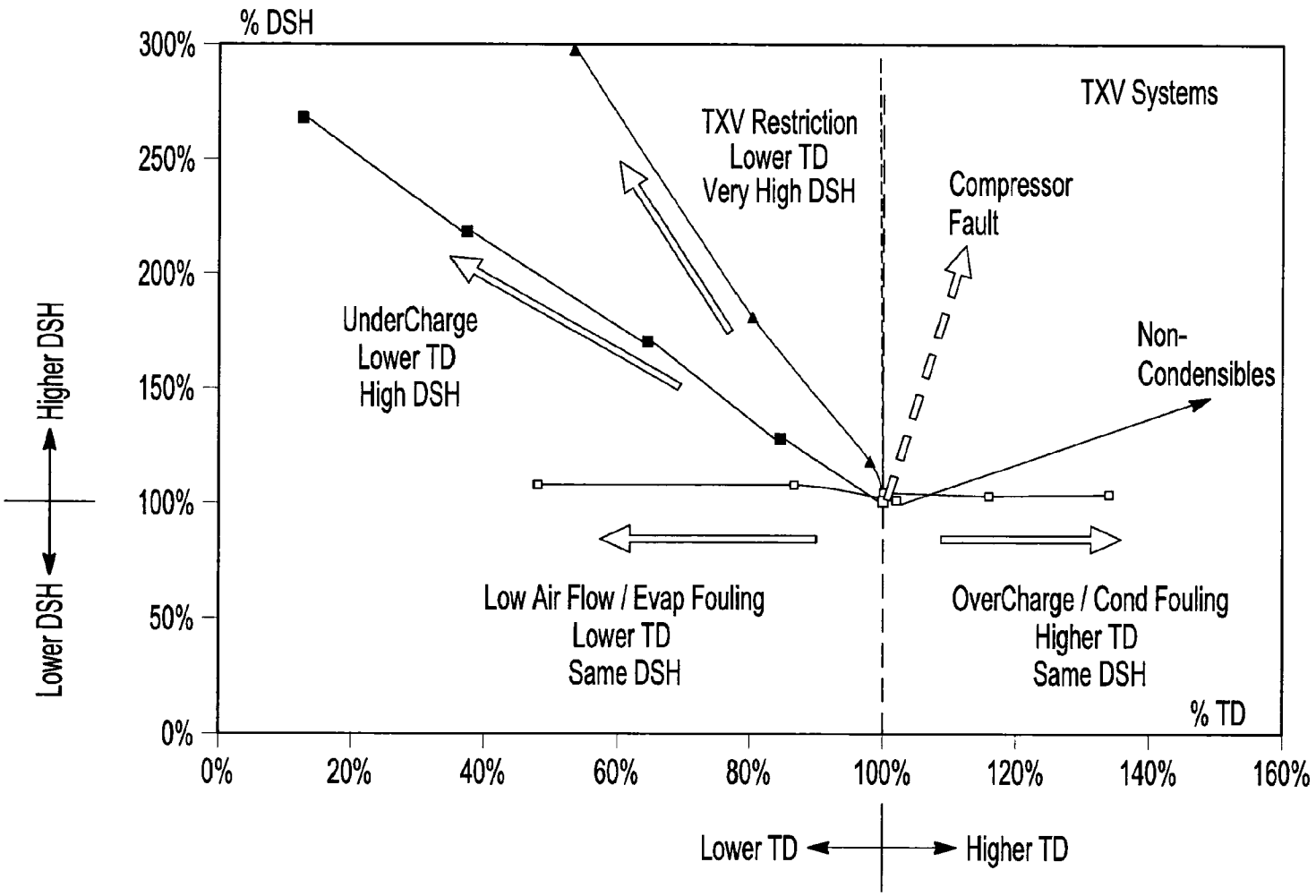
FIG. 16 is a graphical representation of various system and compressor faults based on condenser temperature difference and discharge superheat progressions.
Figure 17:
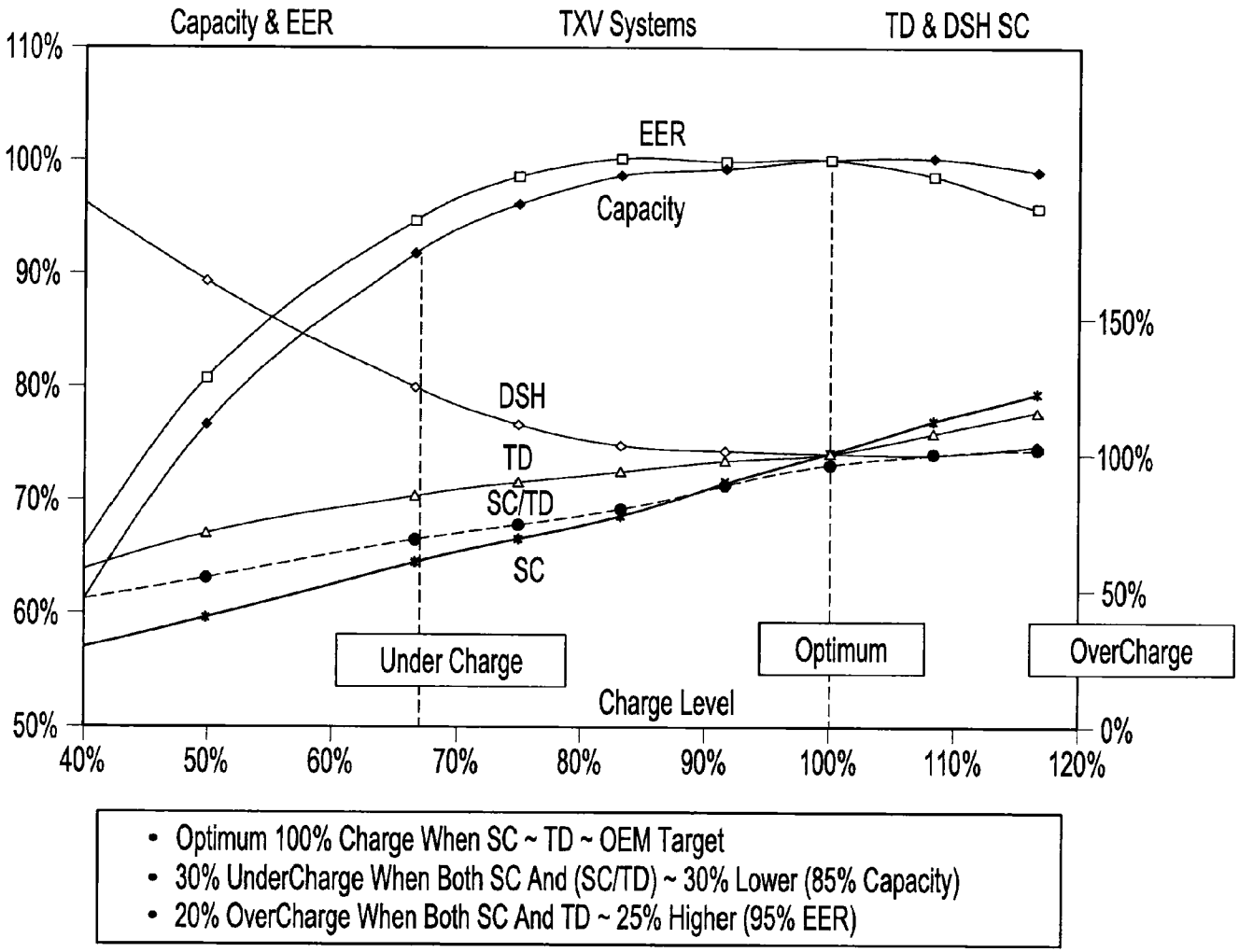
FIG. 17 is a graphical representation of subcooling, condenser temperature difference, discharge superheat, energy efficiency rating, and capacity for use in determining a charge level of a refrigeration system.
Figure 19:
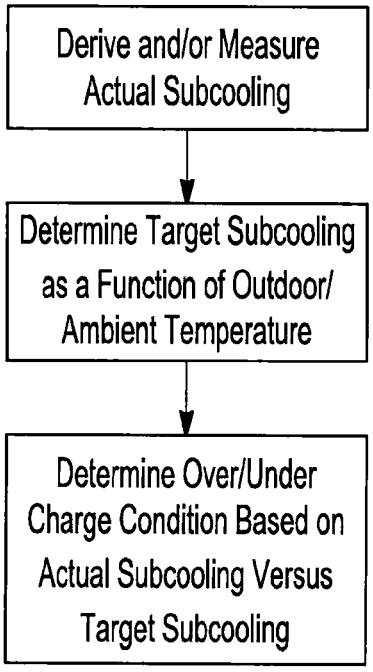
FIG. 19 is a flowchart illustrating a process for verifying a refrigerant charge of a refrigeration system.

High-efficiency systems tend to employ larger condenser coils, which tend to require less subcooling (i.e., less liquid in the condenser coil, in percentage, when compared to a smaller condenser coil) relative to the condenser temperature difference to deliver optimum charge, therefore both subcooling and condenser temperature difference can be used for a more precise charge verification. Therefore, the ratio of subcooling over condenser temperature difference may be used to check both subcooling and condenser temperature difference. This ratio may be pre-programmed as a target value in processing circuitry 88. The ratio of subcooling over condenser temperature difference is a function of efficiency and may be used to verify charge (FIGS. 16 and 17). For example, the efficiency for a standard refrigeration system may be 0.6, the efficiency for a mid-level refrigeration system may be 0.75, and the efficiency for a high-efficiency refrigeration system may be 0.9. Such target ratios may be programmed into the processing circuitry 88 to confirm proper operation of the refrigeration system (FIG. 19).

The various other low-side faults and high-side faults that may be determined by the processing circuitry 88 are shown in FIG. 4, where increasing parameters are identified by an upwardly pointing arrow, decreasing parameters are identified by a downwardly pointing arrow, and constant (i.e., unchanged) parameters are identified by a horizontal arrow.

While the protection and control system 14 is useful in diagnosing the compressor 10 and/or refrigeration system 12 by differentiating between various low-side faults and high-side faults during operation of the compressor 10 and refrigeration system 12, the protection and control system 14 may also be used during installation of the compressor 10 and/or refrigeration system 12. As noted in FIG. 4, the protection and control system 14 may be used to diagnose each of the low-side faults and high-side faults with the exception of a low condenser air-flow condition at installation. Such information is valuable during installation to ensure that the compressor 10 and respective components of the refrigeration system 12 are properly installed and functioning within acceptable limits.

As indicated in FIG. 4, each of the low-side faults are monitored by the protection and control system 14 on an on-going basis, while the only high-side fault monitored by the protection and control system 14 on an on-going basis is the low condenser-air-flow condition. The high-charge condition is typically not measured on an on-going basis by the protection and control system 14, as the charge of the system is generally set at installation. In other words, the charge of the refrigeration system 12 cannot be increased without physically supplying the system 12 with additional refrigerant. Therefore, the need for monitoring a high-charge condition after installation is generally unnecessary except when additional refrigerant is added to the refrigeration system 12. The protection and control system 14 does not typically monitor the non-condensibles high-side fault on an on-going basis because air is not usually injected into the refrigerant once the refrigerant is added to the refrigeration system 12. Air is only added into the refrigeration system 12 when a supply of refrigerant used to charge the refrigeration system 12 is contaminated with air.

While monitoring the high-charge condition and non-condensibles condition are described as not being monitored on an on-going basis, each parameter may be monitored on an on-going basis by the protection and control system 14 to continually monitor the condition of the refrigerant disposed within the compressor 10 and/or refrigeration system 12.

Once the processing circuitry 88 has received the sensor data and has derived the non-measured operating parameters, the processing circuitry 88 can use the sensor data and non-measured operating parameters to derive performance data regarding operation of the compressor 10 and/or refrigeration system 12. With reference to FIG. 5, a flow chart is provided detailing how the processing circuitry 88 can derive a coil capacity of the evaporator 72 and an efficiency of the refrigeration system 12.

The processing circuitry 88 first receives sensor data from the high-side sensor 80, low-side sensor 82, liquid-line temperature sensor 84, and outdoor/ambient temperature sensor 86. Once the sensor data is received, the processing circuitry 88 uses the sensor data to derive the non-measured operating parameters such as subcooling of the refrigeration system 12, discharge superheat, and condenser temperature at 83.

The processing circuitry 88 can determine the condenser temperature by referencing an approximated evaporator temperature (i.e., at 45 degrees F., 50 degrees F., or 55 degrees F.) against the current drawn by the compressor, as previously described. A plot of current versus condenser temperature may be used to reference an approximated evaporator temperature against current information received from the high-side sensor 80 (FIG. 6). By using a plot as shown in FIG. 6, the processing circuitry 88 can determine the condenser temperature by referencing current information received from the high-side sensor 80 against the approximated evaporator temperature values to determine the condenser temperature.

Figure 7:
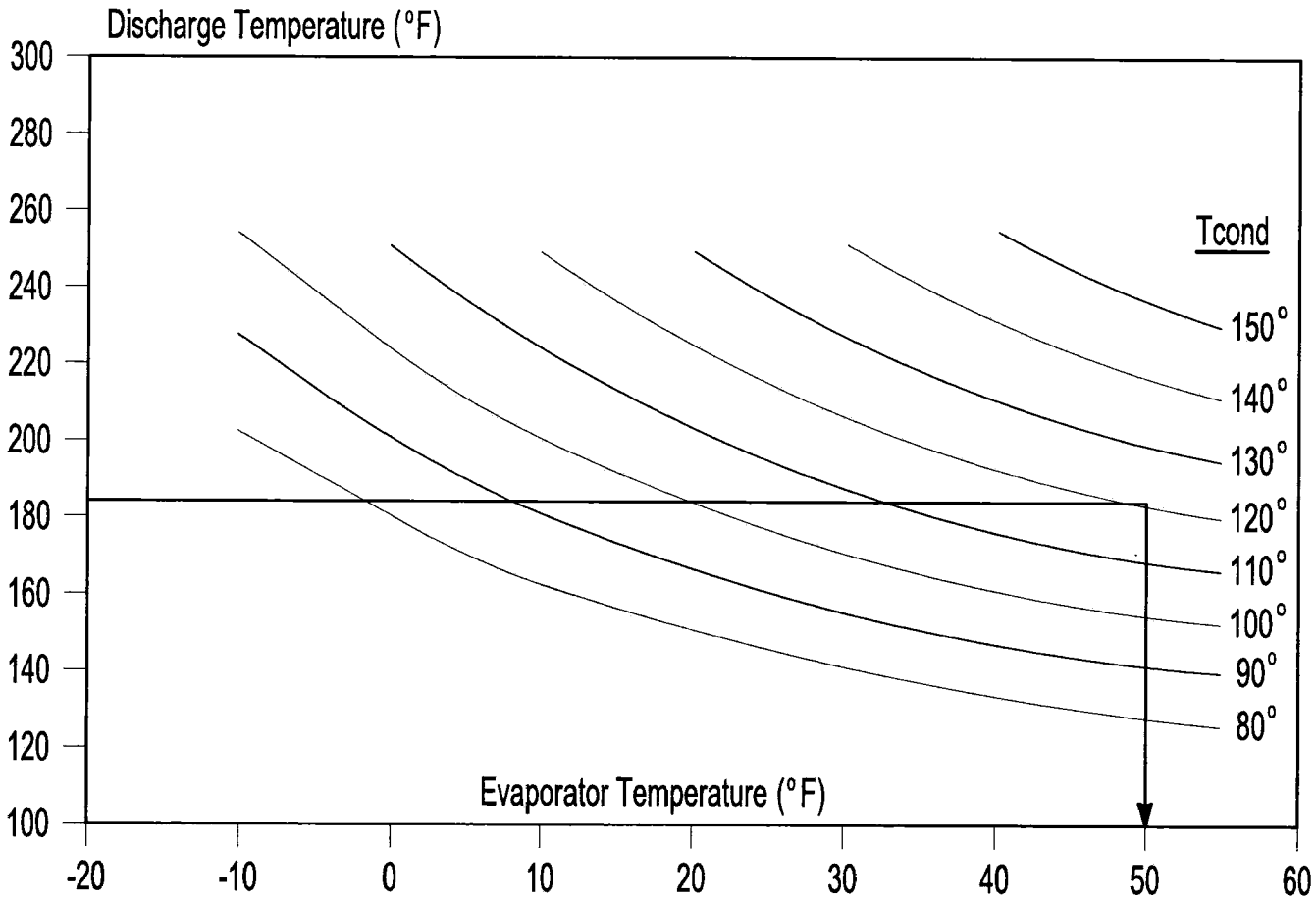
FIG. 7 is a graph of discharge temperature versus evaporator temperature for use in determining an evaporator temperature at a given condenser temperature.

Once the condenser temperature is determined, the processing circuitry 88 can then reference a plot as shown in FIG. 7 to determine the exact evaporator temperature based on discharge temperature information received from the low-side sensor 82. Once both the condenser temperature and the evaporator temperature are known, the processing circuitry 88 can then determine the compressor capacity and flow.

Figure 8:
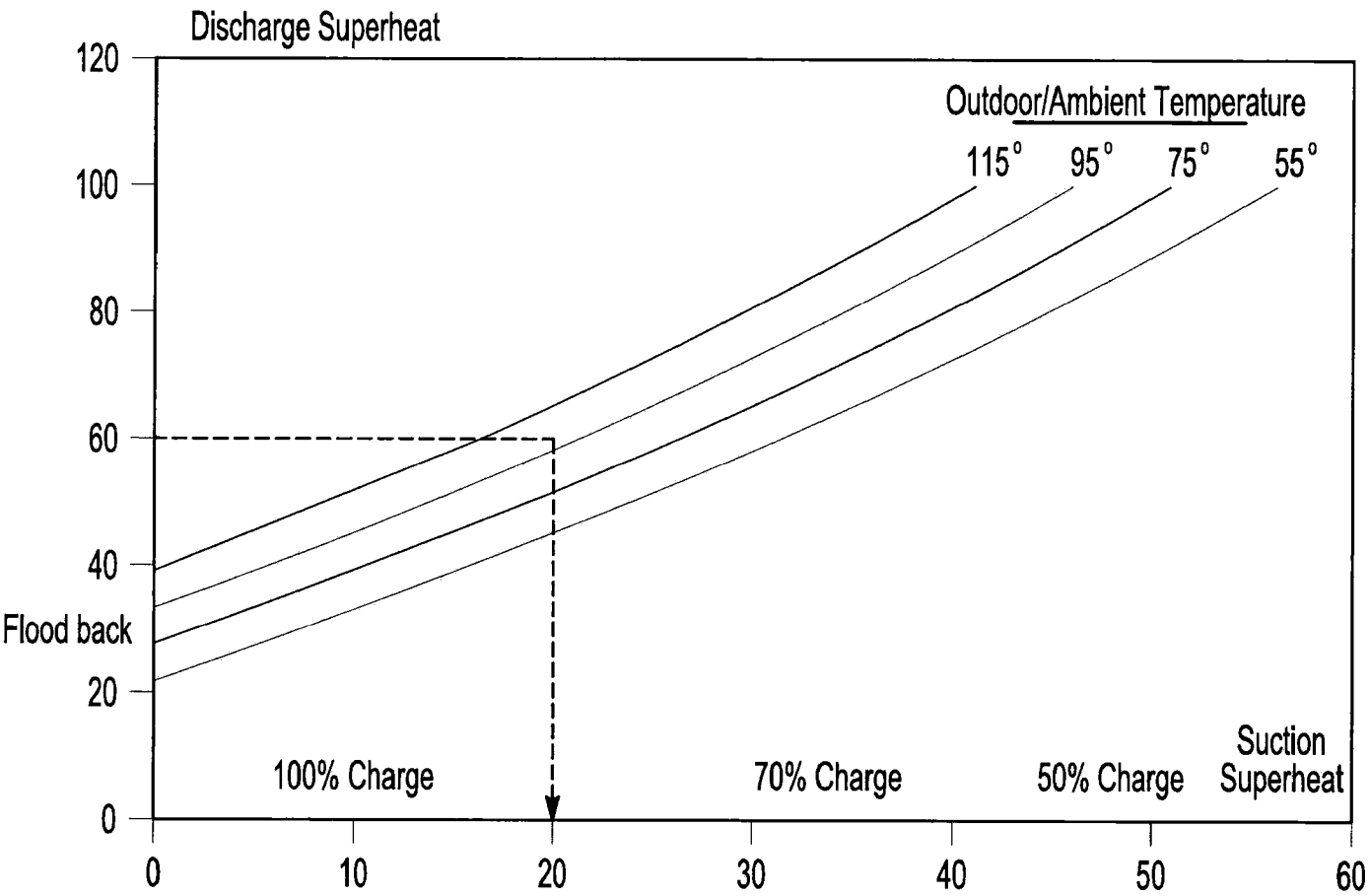
FIG. 8 is a graph of discharge superheat versus suction superheat to determine suction superheat at a given outdoor/ambient temperature.

The discharge superheat may be determined by subtracting the condenser temperature from the discharge-line temperature, as indicated by the low-side sensor 82. Once the discharge superheat is determined, the processing circuitry 88 can determine the suction superheat by referencing a plot as shown in FIG. 8. Specifically, the suction superheat may be determined by referencing the discharge superheat against the ambient temperature as indicated by the outdoor/ambient temperature sensor 86.

In addition to deriving the condenser temperature, evaporator temperature, subcooling, discharge superheat, compressor capacity and flow, and suction superheat, the processing circuitry 88 may also measure or estimate the fan power of the condenser fan 76 and/or evaporator fan 78 and derive a compressor power factor for use in determining the efficiency of the refrigeration system 12 and the capacity of the evaporator 72. The fan power of the condenser fan 76 and/or evaporator fan 78 may be directly measured by sensors 85 associated with the fans 76, 78 or may be estimated by the processing circuitry 88.

Once the non-measured operating parameters are determined, the performance of the compressor 10 and refrigeration system 12 can be determined at 87. The processing circuitry 88 uses compressor capacity and flow and suction superheat to determine a coil capacity of the evaporator 72 at 89. Because the processing circuitry 88 uses the fan power of the condenser fan 76 and/or evaporator fan 78 in determining the capacity of the evaporator 72, the processing circuitry 88 is able to adjust the capacity of the evaporator 72 based on an estimated heat of the condenser fan 76 and/or evaporator fan 78. In addition, because the compressor capacity and flow is determined using the suction superheat, the capacity of the evaporator 72 may also be adjusted based on suction-line heat gain.

Once the capacity of the evaporator 72 is determined, the efficiency of the refrigeration system 12 can be determined using the capacity of the evaporator 72 along with the fan power and compressor power factor at 91. Specifically, the processing circuitry 88 divides the capacity of the evaporator 72 by the sum of the compressor power and fan power. Dividing the capacity of the evaporator 72 by the sum of the fan power and compressor power provides an indication of the energy efficiency of the refrigeration system 12.

Figure 9:
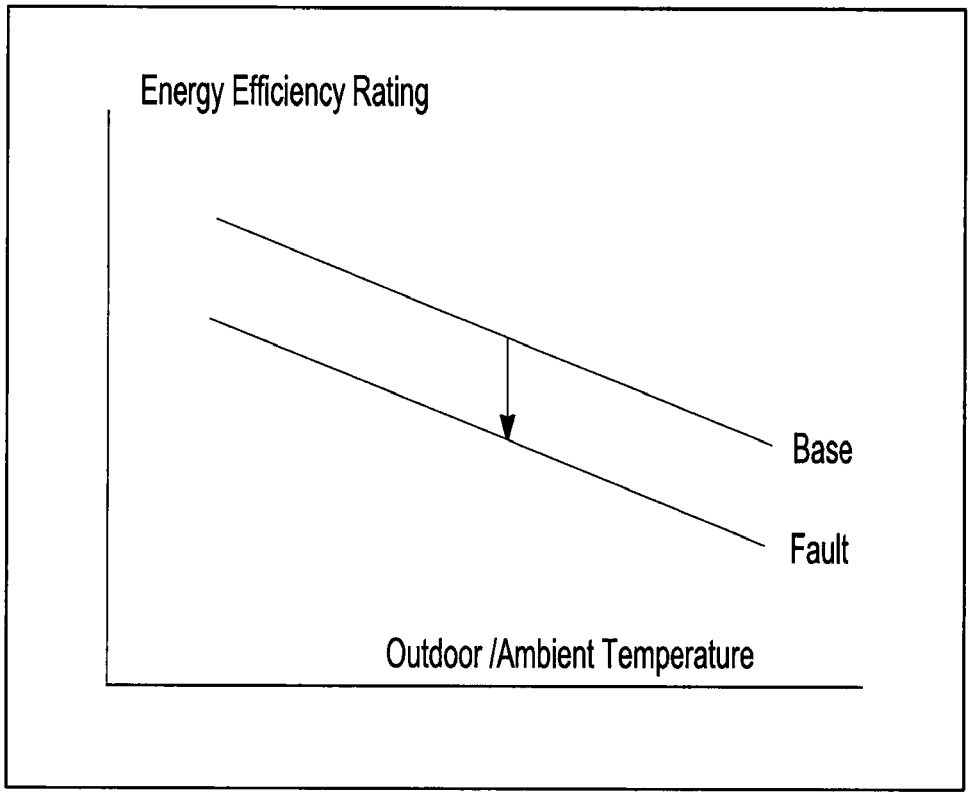
FIG. 9 is a graph of energy efficiency versus outdoor/ambient temperature for use in diagnosing a compressor and/or refrigeration system.
Figure 10:
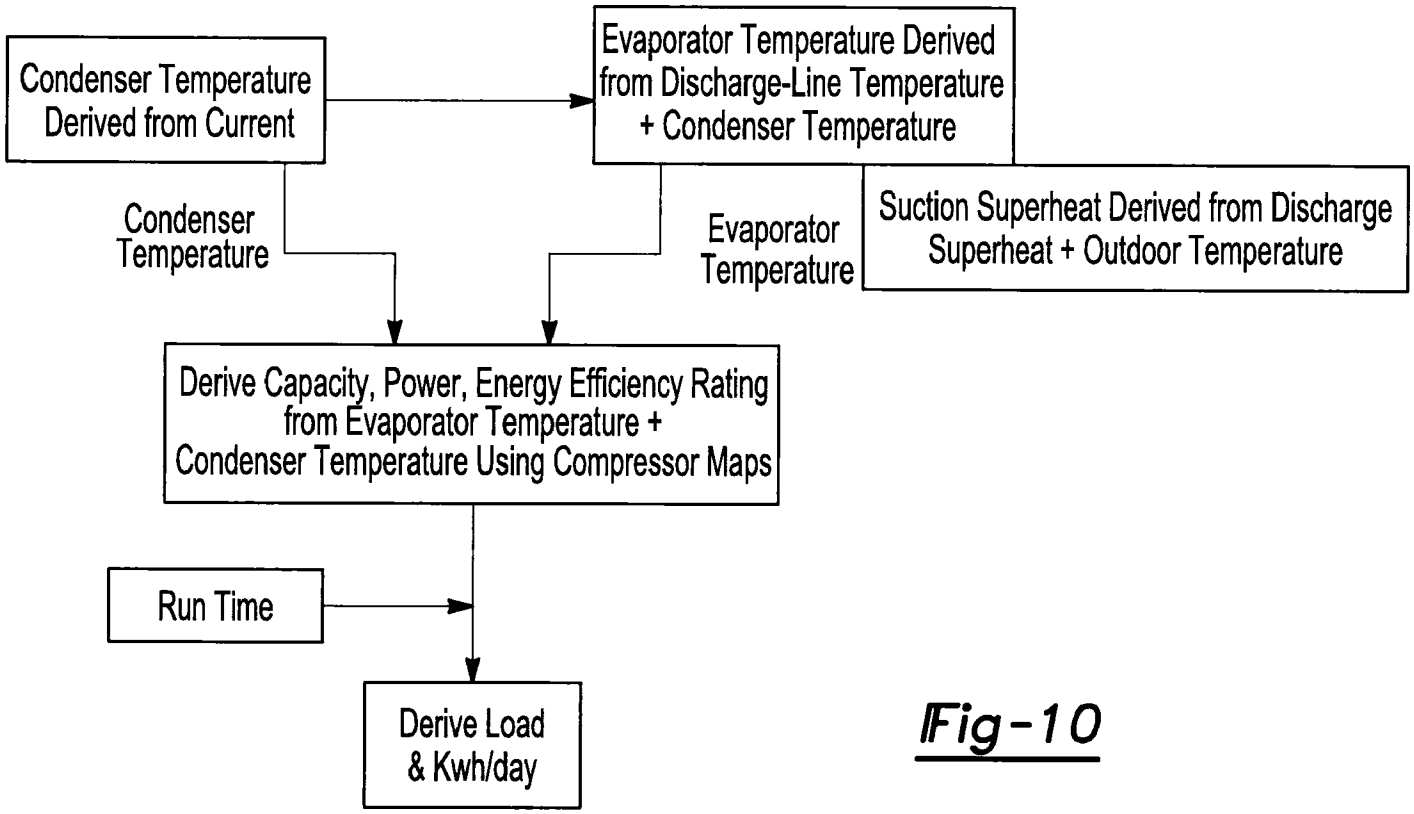
FIG. 10 is a flowchart illustrating a procedure used to determine system load and energy consumption of a refrigeration system.

The energy efficiency of the refrigeration system 12 may be used to diagnose the compressor 10 and/or refrigeration system 12 by plotting the determined energy efficiency rating for the refrigeration system 12 against a base energy efficiency rating to determine a fault condition (FIG. 9). If the determined energy efficiency rating of the refrigeration system 12 deviates from the base energy efficiency rating, the processing circuitry 88 can determine that the refrigeration system 12 is operating outside of predetermined limits. Because operation of the refrigeration system 12 varies with changing outdoor/ambient temperatures, the energy efficiency rating is plotted against the outdoor/ambient temperature to account for changes in the outdoor/ambient temperature and its affect on the refrigeration system 12.

Figure 12:
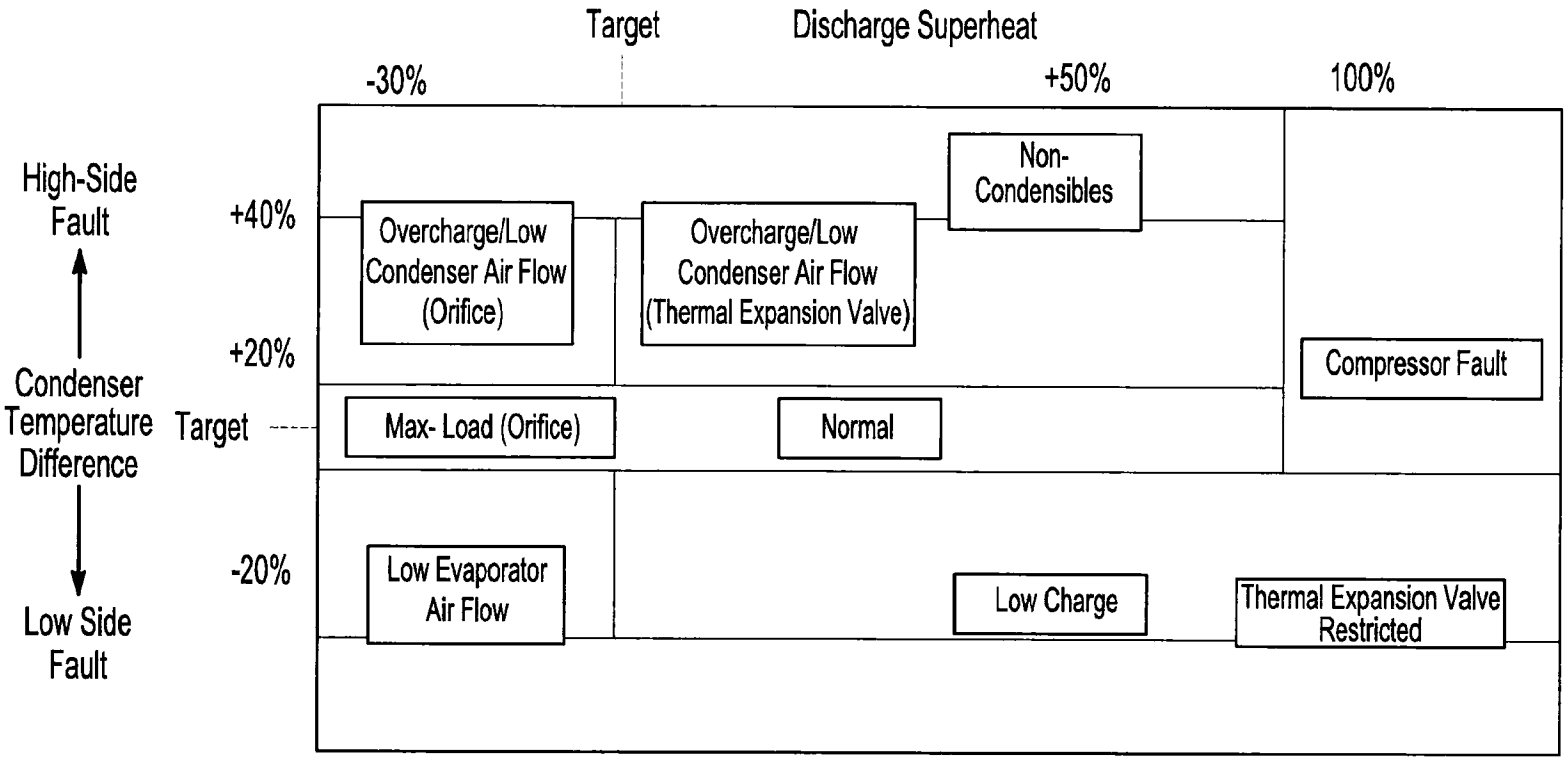
FIG. 12 is a graph depicting specific fault conditions at various discharge superheat conditions.

In addition to driving the energy efficiency of the refrigeration system 12, the processing circuitry 88 can also determine the load experienced by the refrigeration system 12 (i.e., kilowatt hours per day). As shown in FIG. 12, the processing circuitry 88 can determine the house load based on the capacity of the evaporator 72 and the run time of the compressor 10 (i.e., BTU per hour multiplied by run time (in hours) equals BTU load). This information, in combination with the run time of the compressor 10, may be used by the processing circuitry 88 to determine the overall load of the refrigeration system 12, and can be used by the processing circuitry 88 to diagnose the compressor 10 and/or refrigeration system 12.

Figure 18:
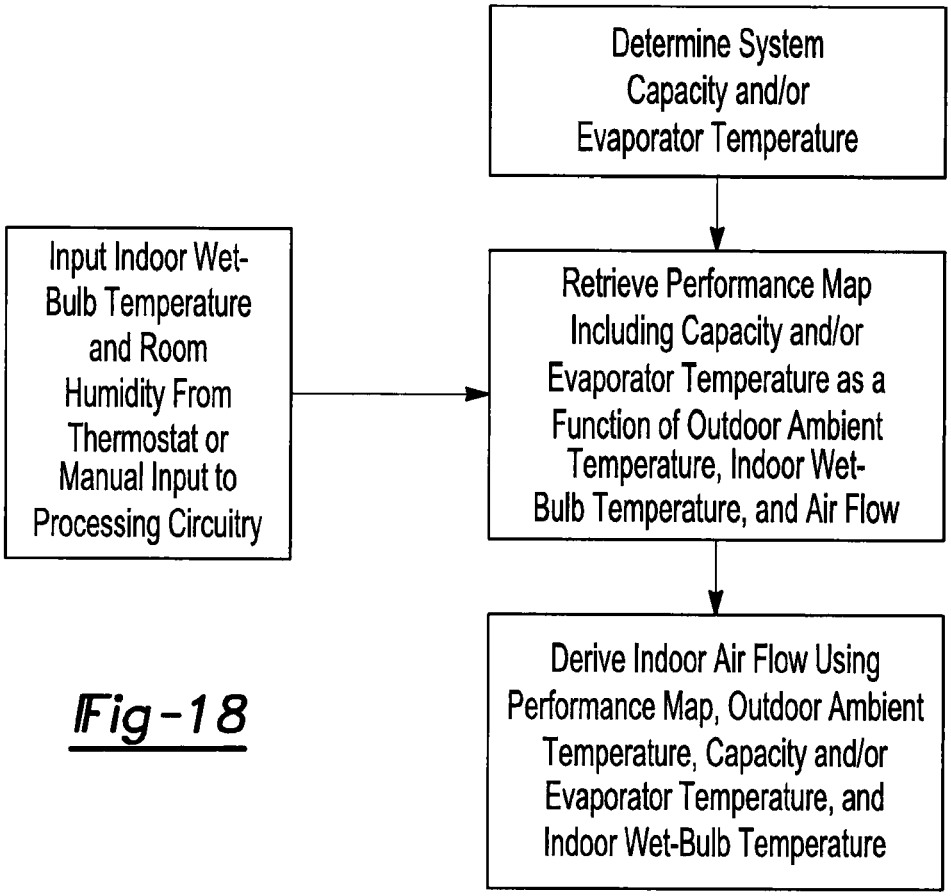
FIG. 18 is a flowchart illustrating a process for verifying air flow through an evaporator.

Once the capacity is derived, the processing circuitry 88 may then also derive the evaporator air flow (i.e., air flow through the evaporator 72) as shown in FIG. 18 based on a pre-determined table located in non-volatile memory of the processing circuitry 88. The processing circuitry 88 relates the capacity or evaporator temperature to air flow as a function of outdoor ambient and indoor room dry-bulb and wet-bulb temperatures (i.e., humidity).

Specifically, the processing circuitry 88 may receive the outdoor temperature from the outdoor temperature sensor 86 and may receive the wet-bulb and/or room humidity from a thermostat. The thermostat may communicate the wet-bulb temperature and/or room humidity to the processing circuitry 88 through digital serial communication. Alternatively, the wet-bulb temperature and room humidity can be manually input by a user. Once the outdoor ambient temperature and indoor wet-bulb temperatures are known, the processing circuitry 88 can reference the outdoor temperature and wet-bulb temperature on a performance map stored in the processing circuitry 88 to determine the air flow through the evaporator 72. The performance map may include pre-programmed capacity and/or evaporator temperature information as it relates to outdoor ambient temperature, wet-bulb temperature, and air flow. Verifying evaporator air flow may be used to confirm proper installation and system capacity.

As described, the protection and control system 14 uses the various sensor data and derived non-measured operating parameters to monitor and diagnose operation of the compressor 10 and/or refrigeration system 12. The sensor data received from the high-side sensor 80, low-side sensor 82, liquid-line temperature sensor 84, and outdoor/ambient temperature sensor 86 may be used by the processing circuitry 88 to differentiate between various fault areas to diagnose the compressor 10 and/or refrigeration system 12. FIG. 11 details various fault areas and diagnostics that the processing circuitry 88 can differentiate between based on sensor data received from the high-side sensor 80, low-side sensor 82, liquid-line temperature sensor 84, and outdoor/ambient temperature sensor 86.

For example, the processing circuitry 88 relies on information from the high-side sensor 80 and low-side sensor 82 to determine compressor faults such as a locked rotor, a motor failure, or insufficient pumping, while the processing circuitry 88 relies on information from the high-side sensor 80, low-side sensor 82, and liquid-line temperature sensor 84 to distinguish between high-side system faults such as cycling on protection (i.e., cycling under a tripped condition), low air-flow through the condenser 70, and an overcharged condition.

FIG. 12 further illustrates how the processing circuitry 88 is able to distinguish between high-side faults and low-side faults using discharge superheat. As described above, the discharge superheat is a derived parameter and is calculated based on information received from the high-side sensor 80 and low-side sensor 82. The processing circuitry 88 compares the discharge superheat with the condenser temperature difference to differentiate between various high-side faults such as an overcharged condition or a non-condensible condition and various low-side faults such as low air-flow through the evaporator 72 or a low-charge condition. The processing circuitry 88 is not only able to derive non-measured operating parameters, but is also able to use the non-measured operating parameters and the sensor data to diagnose the compressor 10 and refrigeration system 12.

Receiving sensor data and deriving non-measured operating parameters allows the protection and control system 14 to monitor and diagnose the compressor 10 and refrigeration system 12 during operation. In addition to diagnosing the compressor 10 and refrigeration system 12 during operation, the protection and control system 14 can also use the sensor data and the non-measured operating parameters during installation of the compressor and individual components of the refrigeration system 12 (i.e., condenser 70, evaporator 72, and expansion device 74) to ensure that the compressor 10 and individual components of the refrigeration system 12 are properly installed.

Figure 13:
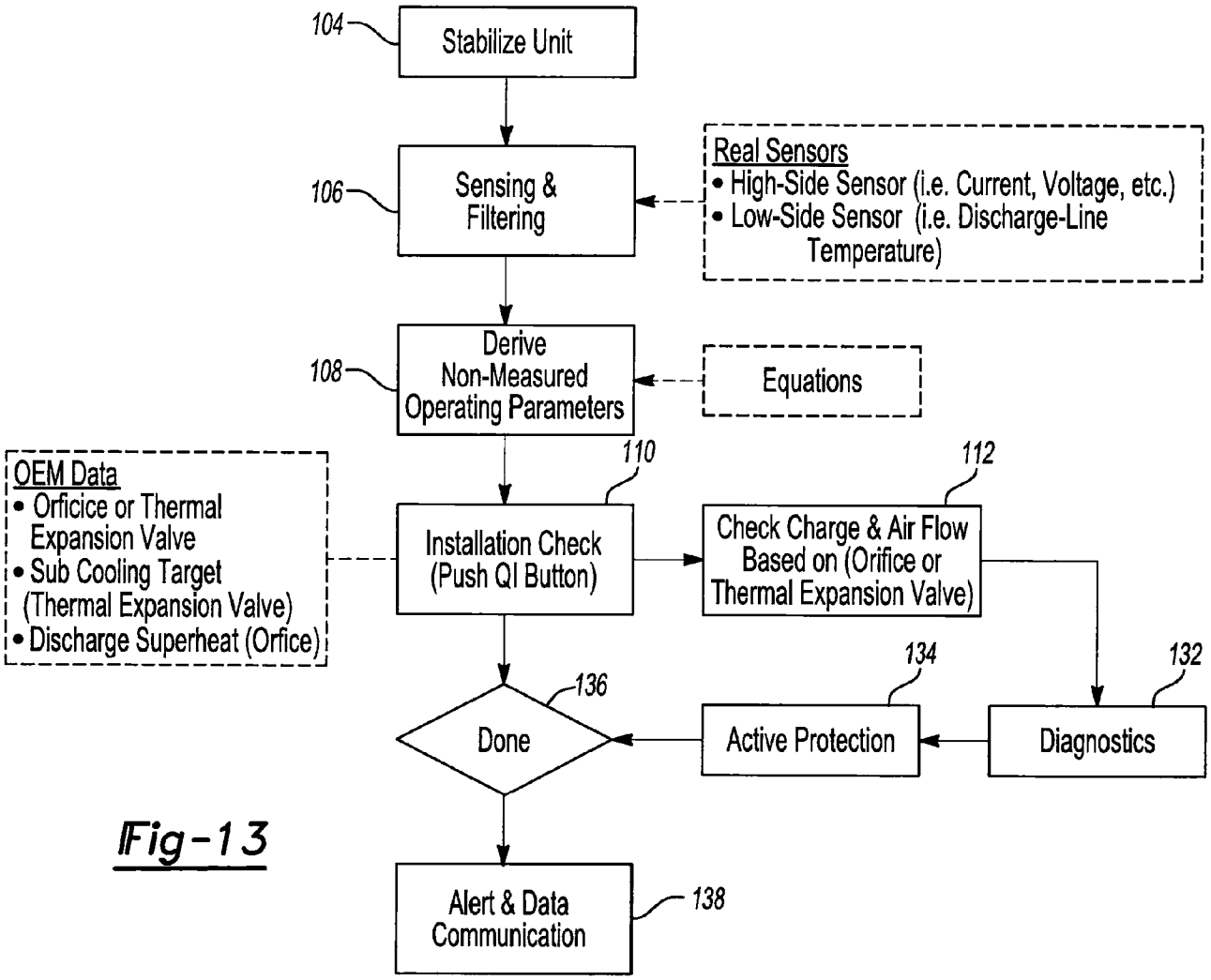
FIG. 13 is a flowchart depicting a process for installing and diagnosing a compressor and/or refrigeration system.

With reference to FIG. 13, an exemplary flow chart is provided detailing an installation check used by the protection and control system 14 during installation of the compressor 10 and/or components of the refrigeration system 12. Once the compressor 10 is installed into the refrigeration system 12, the compressor 10 is stabilized at 104. Once the compressor 10 is stabilized, the processing circuitry 88 receives sensor data from the high-side sensor 80, low-side sensor 82, liquid-line temperature sensor 84, and outdoor/ambient temperature sensor 86 at 106. As described above, the processing circuitry 88 uses the sensor data from the high-side sensor 80, low-side sensor 82, liquid-line temperature sensor 84, and outdoor/ambient temperature sensor 86 to derive non-measured operating parameters at 108. The non-measured operating parameters include, but are not limited to, condenser temperature, subcooling of the refrigeration system 12, condenser temperature difference (i.e., condenser temperature minus outdoor/ambient temperature), and discharge superheat of the refrigeration system 12. This information is used at an installation check 110 to determine whether the compressor 10 and various components of the refrigeration system 12 are property installed.

Original equipment manufacturing data (OEM Data) such as size, type, condenser coil pressure drop, compressor maps, and/or subcooling targets for refrigeration system components such as the expansion device 74 are input into the processing circuitry 88 to assist with the installation check 110. For example, tables of capacity as a function of indoor air flow (i.e., air flow through the evaporator 72) and indoor and outdoor temperatures may also be pre-programmed into the processing circuitry 88. The processing circuitry 88 can use this information, for example, to adjust a subcooling calculation made by reading a pressure at an outlet of the condenser 73 to account for a pressure drop through the condenser 73. This information is used by the processing circuitry 88 to determine whether the components of the refrigeration system 12 are operating within predetermined limits.

Figure 14:
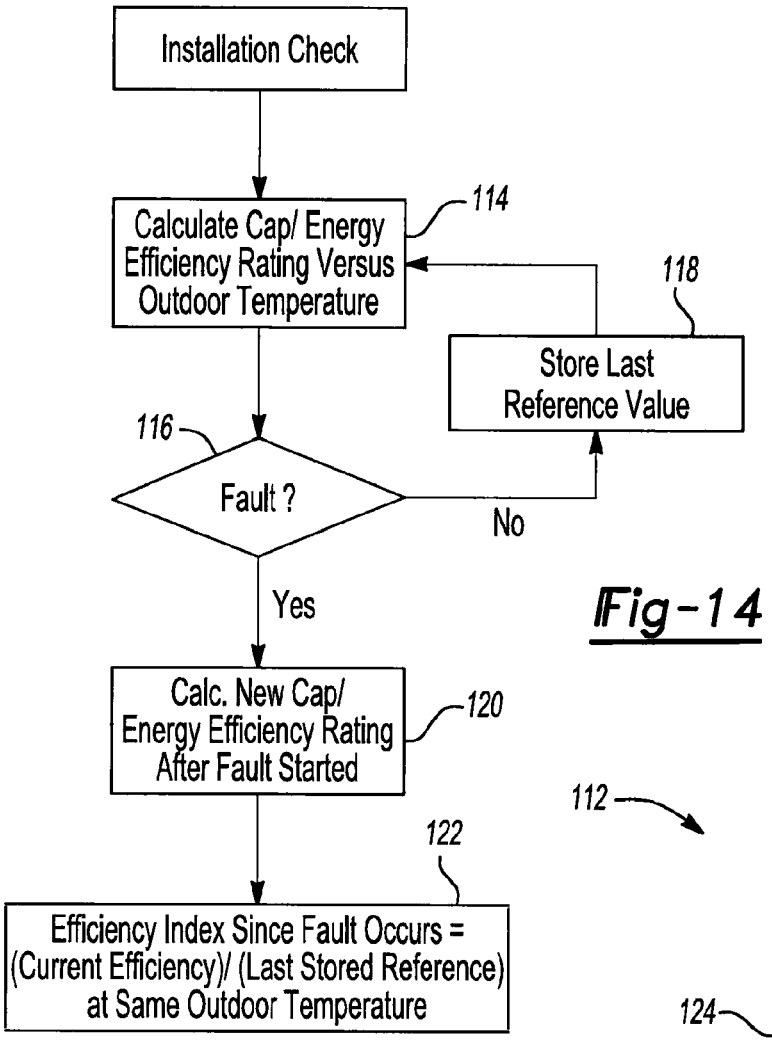
FIG. 14 is a flowchart depicting a compressor installation process.

With reference to FIG. 14, the processing circuitry 88 first calculates the energy efficiency rating of the refrigeration system 12 and plots the energy efficiency rating versus the outdoor/ambient temperature as provided by the outdoor/ambient temperature sensor 86 at 114. The processing circuitry 88 compares the calculated energy efficiency rating versus a base energy efficiency rating (FIG. 9) to determine if a fault exists at 116. If the energy efficiency rating is within an acceptable range such that the energy efficiency rating is sufficiently close to the base efficiency rating, the processing circuitry stores the value of the energy efficiency rating at 118. If the processing circuitry 88 determines a fault condition exists, the processing circuitry 88 calculates a new energy efficiency rating after the fault started at 120.

The processing circuitry 88 is able to track the energy efficiency of the refrigeration system 12 by generating an efficiency index at 122. The processing circuitry 88 generates the efficiency index by dividing the current efficiency by the last stored reference at the same outdoor/ambient temperature. This way, the processing circuitry 88 is able to track the change in efficiency of the refrigeration system 12 over time at the same outdoor/ambient temperature.

Figure 15:
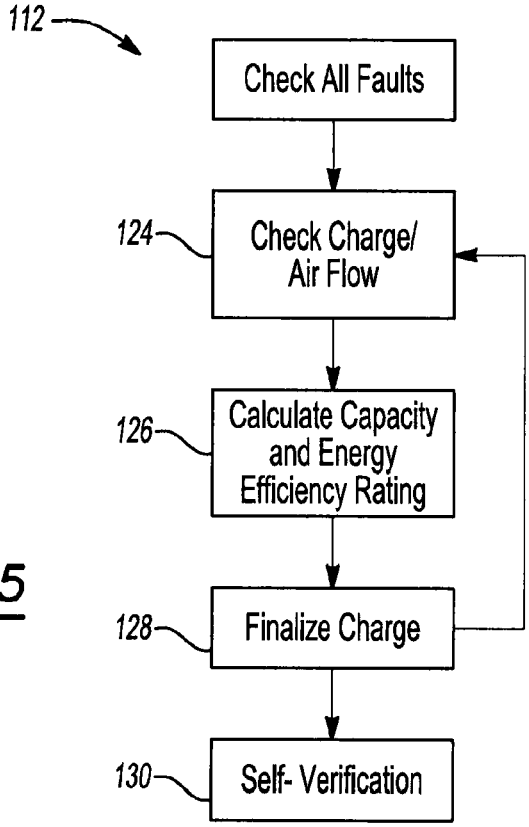
FIG. 15 is a flowchart depicting a compressor installation and refrigerant-charge process.

Once the installation check 110 is complete, the protection and control system 14 then determines the refrigerant charge within the refrigeration system 12, as well as the air flow through the condenser 70 and evaporator 72. With reference to FIG. 15, a flowchart detailing a process for determining the refrigerant charge is provided. The processing circuitry 88 first determines the initial charge within the refrigeration system 12 and the air flow through the condenser 70 and evaporator 72 at 124. Once the initial charge and air flow are determined, the processing circuitry 88 then calculates the capacity and energy efficiency rating of the refrigeration system 12 at 126.

The capacity and energy efficiency rating are compared to baseline values to determine whether the refrigeration system 12 contains a predetermined amount of refrigerant. If the capacity and/or energy efficiency rating indicates that the refrigeration system 12 is either undercharged or overcharged, the processing circuitry 88 indicates that either more charge or less charge is required at 128. Once the capacity and energy efficiency rating indicate that the refrigeration system 12 is properly charged, the level of refrigerant and airflow through the condenser 70 and evaporator 72 is verified by the processing circuitry 88 at 130.

Once the compressor 10 and components of the refrigeration system 12 are properly installed and the charge and air flow are verified, the protection and control system 14 is able to diagnose the compressor 10 and/or refrigeration system 12 at 132. The protection and control system 14 ensues active protection of the compressor 10 and/or refrigeration system 12 at 134, indicating that the installation is complete at 136. During operation of the compressor 10 and refrigeration system 12, the protection and control system 14 provides alerts and data at 138 indicative of operation of the compressor 10 and/or refrigeration system 12.

The protection and control system 14 is able to receive sensor data and determine non-measured operating parameters of a compressor and/or refrigeration system to reduce the overall number of sensors required to adequately protect and diagnose the compressor and/or refrigeration system. In so doing, the protection and control system 14 reduces costs associated with monitoring and diagnosing a compressor and/or a refrigeration system and simplifies such monitoring and diagnostics by driving virtual sensor data from a limited number of sensors.

What is claimed is:

1. A system comprising:

a compressor operable in a refrigeration circuit;

an ambient temperature sensor producing a signal indicative of an ambient temperature; and processing circuitry calculating a plurality of energy efficiency ratings of said refrigeration circuit for a plurality of ambient temperatures, generating a first plot of said plurality of calculated energy efficiency ratings versus said plurality of ambient temperatures and comparing said first plot to a second plot of a plurality of base energy efficiency ratings versus said plurality of ambient temperatures to determine if a fault condition exists.

2. The system of claim 1, wherein said processing circuitry determines whether said refrigeration circuit is operating within an acceptable range based on said comparison of said first plot and said second plot.

3. The system of claim 1, wherein said processing circuitry stores said plurality of calculated energy efficiency ratings.

4. The system of claim 3, wherein said processing circuitry generates an efficiency index by dividing a calculated energy efficiency rating for a particular ambient temperature by a previously stored value of said calculated energy efficiency rating for said particular ambient temperature.

5. The system of claim 4, wherein said processing circuitry tracks changes in efficiency of said refrigeration circuit over time based on said efficiency index.

6. The system of claim 1, wherein said processing circuitry tracks a change in said plurality of calculated energy efficiency ratings over time.

7. The system of claim 1, wherein said processing circuitry determines a charge of said refrigeration circuit based on said comparison of said first plot to said second plot.

8. A system comprising:

a compressor operable in a refrigeration circuit;

an ambient temperature sensor producing a signal indicative of an ambient temperature; and processing circuitry calculating an energy efficiency rating of said refrigeration circuit, said processing circuitry generating an efficiency index by dividing said calculated energy efficiency rating by a most recently stored value of said calculated energy efficiency rating for a particular ambient temperature to determine changes in efficiency of said refrigeration circuit over time.

9. The system of claim 8, wherein said processing circuitry generates a relationship of said calculated energy efficiency rating and said ambient temperature.

10. The system of claim 9, wherein generating said relationship of said calculated energy efficiency rating and said ambient temperature includes generating a first plot of said calculated energy efficiency rating versus said ambient temperature.

11. The system of claim 10, wherein said processing circuitry compares said calculated energy efficiency rating to a base energy efficiency rating.

12. The system of claim 11, wherein comparing said calculated energy efficiency rating to said base energy efficiency rating includes comparing said first plot of said calculated energy efficiency rating versus said ambient temperature to a second plot of said base energy efficiency rating versus said ambient temperature.

13. The system of claim 12, wherein said processing circuitry determines whether said calculated energy efficiency rating is within an acceptable range based on said comparison of said first plot and said second plot.

14. The system of claim 8, wherein said processing circuitry determines whether said calculated energy efficiency rating is within an acceptable range based on a comparison of said calculated energy efficiency rating and a base energy efficiency rating.

15. The system of claim 11, wherein said processing circuitry determines a charge of said refrigeration circuit based on said comparison of said calculated energy efficiency rating to said base energy efficiency rating.

16. A method comprising:

producing a signal indicative of an ambient temperature;

calculating by processing circuitry a plurality of energy efficiency ratings of a refrigeration circuit for a plurality of ambient temperatures;

generating by said processing circuitry a first plot of said plurality of calculated energy efficiency ratings versus said plurality of ambient temperatures;

comparing by said processing circuitry said first plot to a second plot of a plurality of base energy efficiency ratings versus said plurality of ambient temperatures; and determining by said processing circuitry if a fault condition exists based on said comparison.

17. The method of claim 16, further comprising generating an efficiency index by dividing a calculated energy efficiency rating for a particular ambient temperature by a previously stored value of said calculated energy efficiency rating for said particular ambient temperature to determine changes in efficiency of said refrigeration circuit over time.

* * * * *